US008960302B2

(12) United States Patent
Shilling et al.

(10) Patent No.: US 8,960,302 B2
(45) Date of Patent: Feb. 24, 2015

(54) MARINE SUBSEA FREE-STANDING RISER SYSTEMS AND METHODS

(75) Inventors: Roy Shilling, Houston, TX (US); Paul W. Gulgowski, Jr., Houston, TX (US); Philip D. Maule, Leatherhead (GB); Kevin Kennelley, Kemah, TX (US); Walter Greene, Houston, TX (US); Robert W. Franklin, Katy, TX (US); Vicki Corso, Richmond, TX (US); Tony Oldfield, Surrey (GB); Adam L. Ballard, Katy, TX (US); Graeme Steele, Houston, TX (US); David E. Wilkinson, Cleethorpes (GB); Ricky Thethi, Houston, TX (US); Chau Nguyen, Houston, TX (US); Steve Hatton, Surrey (GB)

(73) Assignees: BP Corporation North America, Inc., Houston, TX (US); BP Exploration Operating Company Limited, Middlesex (GB)

( * ) Notice: Subject to any disclaimer, the term of this patent is extended or adjusted under 35 U.S.C. 154(b) by 761 days.

(21) Appl. No.: 13/156,224

(22) Filed: Jun. 8, 2011

(65) Prior Publication Data

US 2012/0085544 A1 Apr. 12, 2012

Related U.S. Application Data

(60) Provisional application No. 61/392,443, filed on Oct. 12, 2010, provisional application No. 61/392,899, filed on Oct. 13, 2010.

(51) Int. Cl.

| | |
|---|---|
| ***E21B 17/01*** | (2006.01) |
| ***E21B 43/013*** | (2006.01) |
| ***E21B 36/00*** | (2006.01) |

(52) U.S. Cl.

CPC ..... *E21B 43/013* (2013.01); *E21B 17/015* (2013.01); *E21B 36/003* (2013.01); *E21B 36/005* (2013.01)

USPC ..... 166/345; 166/350; 166/367; 405/224.2; 405/224.3

(58) Field of Classification Search

CPC ..... E21B 17/012; E21B 43/01

USPC ..... 166/345, 350, 367, 304; 138/114; 405/224.2, 224.3

See application file for complete search history.

(56) References Cited

U.S. PATENT DOCUMENTS

| | | | | |
|---|---|---|---|---|
| 3,637,223 | A | 1/1972 | Weber | |
| 3,641,602 | A * | 2/1972 | Flory et al. | 441/5 |

(Continued)

FOREIGN PATENT DOCUMENTS

| | | |
|---|---|---|
| GB | 2346188 A | 8/2000 |
| GB | 2351301 A | 12/2000 |

(Continued)

OTHER PUBLICATIONS

ANSI/API Specification 6A, "Specification for Wellhead and Christmas Tree Equipment", ISO 10423:2009 (Modified) pp. 1-456, Oct. 2010, API Publishing Services, Washington D.C. 20005.

(Continued)

*Primary Examiner* — Matthew Buck

(74) *Attorney, Agent, or Firm* — Conley Rose, P.C.

(57) ABSTRACT

A free-standing riser system connects a subsea source to a surface structure. The system includes a concentric free-standing riser comprising inner and outer risers defining an annulus there between. A lower end of the riser is fluidly coupled to the subsea source through a lower riser assembly (LRA) and one or more subsea flexible conduits. An upper end of the riser is connected to a buoyancy assembly and the surface structure through an upper riser assembly (URA) and one or more upper flexible conduits, the riser also mechanically connected to a buoyancy assembly that applies upward tension to the riser. The riser may be insulated for flow assurance, either by a flow assurance fluid in the annulus, insulation of the outside of the outer riser, or both. The system may include a hydrate inhibition system and/or a subsea dispersant system. The surface structure may be dynamically positioned.

107 Claims, 63 Drawing Sheets

(56) References Cited

U.S. PATENT DOCUMENTS

| | | | | |
|---|---|---|---|---|
| 3,782,458 | A * | 1/1974 | Slack | 166/355 |
| 3,918,485 | A | 11/1975 | Weber et al. | |
| 4,234,047 | A | 11/1980 | Mott | |
| 4,294,477 | A | 10/1981 | Ahlstone | |
| 4,462,717 | A * | 7/1984 | Falcimaigne | 405/224.3 |
| 4,567,843 | A * | 2/1986 | d'Hautefeuille | 114/230.14 |
| 4,597,448 | A | 7/1986 | Baugh | |
| 4,646,840 | A | 3/1987 | Bartholomew | |
| 4,762,180 | A | 8/1988 | Wybro et al. | |
| 4,776,600 | A | 10/1988 | Kohn | |
| 4,846,277 | A | 7/1989 | Khalil | |
| 4,856,593 | A | 8/1989 | Matthews | |
| 4,893,842 | A | 1/1990 | Brammer | |
| 4,976,458 | A | 12/1990 | Hosie | |
| 5,046,896 | A | 9/1991 | Cole | |
| 5,076,364 | A | 12/1991 | Hale | |
| 5,183,581 | A | 2/1993 | Khalil | |
| 5,222,560 | A | 6/1993 | Brammer | |
| 5,232,292 | A | 8/1993 | Stackling | |
| 5,244,878 | A | 9/1993 | Sugier | |
| 5,255,743 | A | 10/1993 | Adam | |
| 5,259,459 | A | 11/1993 | Valka | |
| 5,279,369 | A | 1/1994 | Brammer | |
| 5,299,642 | A | 4/1994 | Nelson | |
| 5,330,201 | A | 7/1994 | Hart | |
| 5,460,728 | A | 10/1995 | Klomp | |
| 5,514,312 | A | 5/1996 | Hardy et al. | |
| 5,539,313 | A | 7/1996 | Meyer | |
| 5,566,761 | A | 10/1996 | Pallini, Jr. | |
| 5,580,391 | A | 12/1996 | Franco | |
| 5,775,427 | A | 7/1998 | Skeels | |
| 6,016,847 | A | 1/2000 | Jung et al. | |
| 6,035,933 | A | 3/2000 | Khalil | |
| 6,039,083 | A | 3/2000 | Loper | |
| 6,053,213 | A | 4/2000 | Jung et al. | |
| 6,067,829 | A | 5/2000 | Harmelin et al. | |
| 6,070,669 | A | 6/2000 | Radi | |
| 6,082,391 | A * | 7/2000 | Thiebaud et al. | 137/236.1 |
| 6,234,252 | B1 | 5/2001 | Pallini, Jr. | |
| 6,260,624 | B1 | 7/2001 | Pallini, Jr. | |
| 6,282,933 | B1 | 9/2001 | Dupoiron | |
| 6,293,343 | B1 | 9/2001 | Pallini, Jr. | |
| 6,321,844 | B1 * | 11/2001 | Thiebaud et al. | 166/345 |
| 6,401,760 | B2 | 6/2002 | Espinasse | |
| 6,461,083 | B1 * | 10/2002 | Pionetti et al. | 405/224.2 |
| 6,540,024 | B2 | 4/2003 | Pallini et al. | |
| 6,612,370 | B1 * | 9/2003 | Jahnsen et al. | 166/367 |
| 6,756,345 | B2 | 6/2004 | Pakulski et al. | |
| 6,955,221 | B2 * | 10/2005 | Bursaux | 166/303 |
| 6,978,839 | B2 | 12/2005 | Fenton et al. | |
| 7,073,593 | B2 * | 7/2006 | Hatton et al. | 166/367 |
| 7,240,735 | B2 | 7/2007 | Crozier | |
| 7,337,848 | B2 | 3/2008 | Fraser et al. | |
| 7,367,398 | B2 * | 5/2008 | Chiesa et al. | 166/302 |
| 7,434,624 | B2 * | 10/2008 | Wilson | 166/368 |
| 7,441,602 | B2 * | 10/2008 | Saint-Marcoux | 166/302 |
| 7,445,030 | B2 | 11/2008 | Hardy et al. | |
| 7,467,663 | B2 | 12/2008 | Reimert | |
| 7,503,391 | B2 | 3/2009 | McCanna et al. | |
| 7,537,057 | B2 | 5/2009 | Singeetham et al. | |
| 7,572,085 | B2 * | 8/2009 | Luppi | 405/158 |
| 7,735,562 | B2 | 6/2010 | Bennett et al. | |
| 7,770,603 | B2 | 8/2010 | Hardy | |
| 7,770,650 | B2 | 8/2010 | Young et al. | |
| 7,934,560 | B2 | 5/2011 | Roveri et al. | |
| 2001/0045286 | A1 | 11/2001 | Pallini et al. | |
| 2002/0122696 | A1 | 9/2002 | Sokol et al. | |
| 2006/0196674 | A1 | 9/2006 | Butler et al. | |
| 2007/0044972 | A1 | 3/2007 | Roveri et al. | |
| 2007/0081862 | A1 | 4/2007 | Wolbers et al. | |
| 2008/0210433 | A1 | 9/2008 | Bhat et al. | |
| 2008/0223583 | A1 * | 9/2008 | Roveri et al. | 166/336 |
| 2009/0032265 | A1 | 2/2009 | Borak, Jr. | |
| 2009/0103985 | A1 * | 4/2009 | Casola et al. | 405/170 |
| 2009/0277645 | A1 | 11/2009 | Pallini | |
| 2010/0018693 | A1 | 1/2010 | Duncan et al. | |
| 2010/0018717 | A1 * | 1/2010 | Espinasse et al. | 166/346 |
| 2010/0166500 | A1 * | 7/2010 | Roveri et al. | 405/169 |
| 2012/0132434 | A1 * | 5/2012 | Yemington | 166/345 |

FOREIGN PATENT DOCUMENTS

| | | | |
|---|---|---|---|
| GB | 2371065 | A | 7/2002 |
| WO | 0173261 | A2 | 10/2001 |
| WO | 0196797 | A1 | 12/2001 |
| WO | 2005059422 | A1 | 6/2005 |
| WO | 2005093309 | A1 | 10/2005 |
| WO | 2009133542 | A2 | 11/2009 |
| WO | 2010012898 | A1 | 2/2010 |

OTHER PUBLICATIONS

ANSI/API Specification 5L, "Specification for Line Pipe", ISO 3183:2007 (Modified), pp. 1-210, Oct. 1, 2007, API Publishing Services, Washington D.C. 20005.

Hatton et al., "Recent Developments in Free Standing Riser Technology", 3rd Workshop on Subsea Pipelines, Dec. 3-4, 2002, Rio De Janeiro, Brazil, 22 pages.

Szucs et al., "Heavy Oil Gas Lift Using the COR", SPE 97749, Canadian Heavy Oil Association, 2005, 5 pages.

Webb et al., "Dual Activities Without the Second Derrick—A Success Story", SPE 112869, 2008, 24 pages.

Luffrum et al., "Gas Lift Using the Concentric Offset Riser", 2H Offshore Engineering Ltd., http://www.2hoffshore.com/technical-papers/index.php?option=com_pdffiles&search=23, May 2006, 6 pages.

Nalco Company, "Oil Dispersant Expert Testimony—What the Experts Are Saying", downloaded from Nalco Company Internet Website, 2010, 9 pages.

Huff et al., "Base Material Considerations and the Selection of NACE Approved High-Strength Alloy Overlay for Use on HP/HT Exploration and Production Equipment", OTC, 2008, 11 pages.

FMC Technologies, "Well Access Systems", Brochure, pp. 1-12, 2008.

Shilling, et al., "Development of Fatigue Resistant Heavy Wall Riser Connectors for Deepwater HPHT Dry Tree Riser Systems", OMAE2009-79518, May 31-Jun. 5, 2009, Homolulu, Hawai, pp. 1-10.

RPSEA RFP2007DW1403, "Fatigue Performance of High Strength Riser Materials", Nov. 28, 2007, Part I, 28 pages.

RPSEA RFP2007DW1403, "Fatigue Performance of High Strength Riser Materials", Nov. 28, 2007, Part II, 18 pages.

RPSEA RFP2007DW1403, "Fatigue Performance of High Strength Riser Materials", Nov. 28, 2007, Part III, 21 pages.

Sparks, "Fundamentals of Marine Riser Mechanics", Chapter 11, pp. 151-169, 2007, PennWell Corporation.

Schilling et al., "Developments in Riser Technology for the Next Generation Ultra-Deep HPHT Wells", DOT Conference, 2008 Proceedings, 9 pages.

Faulds, D.K., "ROV Intervention Interfaces", pp. 1-4, UI2007.

Anelli et al., "Development of high grade seamless pipes for deepwater application by metallurgical design", la metallurgia italiana, pp. 33-40, 2005.

Grealish, F., "Alternative Solutions for Riser Bse Lift Gas Lift", pp. 1-13, Subsea UK Forum, Paris, 2007.

Auperin et al., "Lessons Learned From Development and Installation of Injection Single Hybrid Risers—Application to Production, Test Pipe-in-Pipe SHRs", pp. 1-10, OTC-17521, 2005.

"New Containment System Fact Sheet", pp. 1-2, Sep. 2010.

"Deepwater Riser Engineering Course Program", pp. 1-5, downloaded from the Internet Oct. 28, 2010.

Grottheim masters thesis, "Development and Assessment of Electronic Manual for Well Control and Blowout Containment", Texas A&M University, p. 1-159, 2005.

ExxonMobil,"Marine Well Containment System", downloaded from ExxonMobil's Internet website, pp. 1-2, Sep. 23, 2010.

Cameron, General Catalog, 2005-2006, Cooper Cameron Corporation, USA, 52 pages.

(56) References Cited

OTHER PUBLICATIONS

Milberger, et al., "Evolution of Metal Seal Principles and Their Application in Subsea Drilling and Production", OTC, Houston, Texas, May 4-7, 1992, pp. 125-132.
U.S. Appl. No. 13/156,258, filed Jun. 8, 2011 and subsequently abandoned on Feb. 19, 2012.
API Recommended Practice 2RD, "Design of Risers for Floating Production Systems (FPSs) and Tension-Leg Platforms (TLPs)", Washington, DC 20005-4070, First Edition, Jun. 1998, pp. 1-176.
Bai et al., "Subsea Engineering Handbook", Burlington, MA, Gulf Professional Pub, 2010, pp. 401,436-439.
API Standard 601, "Metallic Gaskets for Raised-Face Pipe Flanges and Flanged Connections (Double-Jacketed Corrugated and Spiral-Wound", Washington, D.C. 20005, Seventh Edition, Mar. 1988, p. 2-29.
U.S. Appl. No. 12/082,742, filed Apr. 14, 2008.
Sches et al., "Fatigue Resistant Threaded and Coupled Connectors: the New Standard for Deep Water Riser Applications", OMAE 2007-29263, Sand Diego, CA, Jun. 10-15, 2007, pp. 285-295.
Sches et al., Fatigue Resistant Threaded and Coupled Connectors for Deepwater Riser Systems: Design and Performance Evaluation by Analysis and Full Scale Tests, OMAE 2008-57603, Jun. 15-20, 2008, Estoril, Portugal, pp. 407-420.
Schilling et al., "Design and Qualification of Fatigue Resistant Heavy Wall Threaded & Coupled Premium Connectors for Drilling and Production Riser Applications in Deepwater HPHT Dry Tree Systems", OMAE 2010-20904, Jun. 6-11, 2010, Shanghai, China, pp. 1-9.
PCT International Search Report issued in International Application No. PCT/US2011/055695, mailed on Feb. 15, 2013, 20 pages.
Hatton S.A. et al: "Hybrid Riser Foundation Design and Optimisation", Offshore Technology Conference, No. OTC 17199, May 2, 2005, pp. 1-12, XP007921362.
BP, Kent Wells Technical Update—Sealing Cap Installation, 20100710, Free Standing Riser #1 and #2 showing flexible jumpers at bottom riser, p. 7, Jul. 10, 2010, pp. 1-8, XP007921003.
Elizabeth Tellier et al.: "The Evolution of Freestanding Risers", Proceedings of the ASME 28th International Conference on Ocean, Offshore and Arctic Engineering, OMAE2009-79487, May 31, 2009, pp. 1-11, XP007921371.
Roveri F. et al.: "The Roncador P-52 Oil Export System—Hybrid Riser at a 1800m Water Depth", Offshore Technology Conference, No. OTC 19336, May 5, 2008, pp. 1-15, XP007921369.

* cited by examiner 123
2FJB
107B
121
8
119A
119B
180
118
111
116A
110
116B
112
102
150A
150B
114A
114B
104
115A
115B
105
109A
14
108A
109B
106
108B
119
58

MARINE SUBSEA FREE-STANDING RISER SYSTEMS AND METHODS

CROSS-REFERENCE TO RELATED APPLICATIONS

This application claims domestic priority benefit under 35 U.S.C. §119(e) from applicants' U.S. provisional patent application Ser. Nos. 61/392,443, filed Oct. 12, 2010, and 61/392,899, filed Oct. 13, 2010, both of which are incorporated herein by reference. This application is also related to assignee's U.S. provisional patent application Ser. No. 61/480,368, filed Apr. 28, 2011 and assignee's U.S. non-provisional patent application Ser. No. 13/156,258, filed Jun. 8, 2011.

BACKGROUND INFORMATION

1. Technical Field

The present disclosure relates in general to systems and methods useful in the marine hydrocarbon exploration, production, well drilling, well completion, well intervention, and containment and disposal fields.

2. Background Art

Free-standing riser (FSR) systems have been used during production and completion operations. For a review, please see Hatton et al., "Recent Developments in Free Standing Riser Technology", 3rd Workshop on Subsea Pipelines, Dec. 3-4, 2002, Rio de Janeiro, Brazil. See also U.S. Pat. No. 7,434,624. For other examples of FSR systems, see U.S. Published Patent App. Nos. 20070044972 and 2008022358, which disclose FSR systems and methods of installing same. Other patents mentioning further features of riser systems are U.S. Pat. Nos. 4,234,047, 4,646,840, 4,762,180, 6,082,391 and 6,321,844.

"Riser base gas lift" is a technique for improving production flow, especially heavy oil flow, in FSR systems. Szucs et al., "*Heavy Oil Gas Lift Using the COR*", SPE 97749 (2005) discloses a riser base gas lift application using a concentric offset riser (COR).

American Petroleum Institute (API) Recommended Practice 2RD, (API-RP-2RD, First Edition June 1998), "*Design of Risers for Floating Production Systems (FPSs) and Tension-Leg Platforms (TLPs)*" is a standard in the subsea oil and gas production industry. Nitrogen is noted as a possible insulation medium for pipe-in-pipe risers in Bai et al., *Subsea Engineering Handbook*, page 437, (published December 2010), but only in the gap or annulus between the exterior surface of the outer riser and material insulation.

Webb et al., "*Dual Activities Without the Second Derrick—A Success Story*", SPE 112869 (2008) mentions riser annulus dewatering using nitrogen, and discloses a spar platform having a surface nitrogen supply rig and a permanent nitrogen line for annulus dewatering using nitrogen. Assignee's U.S. non-provisional patent application Ser. No. 12/082,742, filed Apr. 14, 2008 (Ballard et al) describes using nitrogen to remediate hydrate plugs in hydrocarbon production systems.

While use of free-standing riser systems and methods of installation have increased, there remains a need for more robust designs, particularly when flow assurance is a concern as during a containment and disposal period, and for designs which can handle large amounts of potentially hydrate-forming gas, both during normal production operation and during containment periods. The systems and methods of the present disclosure are directed to these needs.

SUMMARY

In accordance with the present disclosure, marine subsea concentric free-standing riser systems and methods of using same are described which may reduce or overcome many of the faults of previously known systems and methods.

A first aspect of the disclosure is a free-standing riser system connecting a subsea source to a surface structure, the system comprising:

a concentric free-standing riser comprising inner and outer risers defining an annulus there between, a lower end of the riser fluidly coupled to the subsea source through a lower riser assembly (LRA) and one or more subsea flexible conduits, and an upper end of the riser mechanically connected to a subsea buoyancy assembly and fluidly connected to the surface structure through an upper riser assembly (URA) and one or more upper flexible conduits;

the LRA comprising a first generally cylindrical member having a longitudinal bore, a lower end, an upper end, and an external generally cylindrical surface, the first generally cylindrical member comprising sufficient intake ports extending from the external surface to the bore to accommodate flow of hydrocarbons from the hydrocarbon fluid source as well as inflow of a functional fluid (flow assurance fluid or other fluid, for example a corrosion or scale inhibitor, kill fluid, and the like), at least one of the intake ports fluidly connected to an LRA production wing valve assembly, the upper end of the first generally cylindrical member comprising a profile suitable for fluidly connecting to the free-standing riser, the lower end of the first generally cylindrical member comprising a connector suitable for connecting to a seabed mooring; and the URA comprising a second generally cylindrical member having a longitudinal bore, a lower end, an upper end, and an external generally cylindrical surface, the second generally cylindrical member comprising sufficient outtake ports extending from the bore to the external surface to accommodate flow of hydrocarbons from the riser, and at least one port allowing flow of a functional fluid into the annulus, at least one of the outtake ports fluidly connected to a URA production wing valve assembly for fluidly connecting the second generally cylindrical member with the upper flexible conduit, the upper end of the generally cylindrical second member comprising a connector suitable for connecting to the subsea buoyancy assembly, and the lower end of the second generally cylindrical member comprising a profile suitable for fluidly connecting to the free-standing riser.

In certain embodiments the riser may be maintained in a near-vertical (or substantially vertical) position by tension applied by the buoyancy assembly.

A second aspect of the disclosure is a free-standing riser system connecting a subsea source to one or more surface structures, the system comprising:

at least two concentric free-standing risers laterally spaced apart in the sea, each concentric riser comprising inner and outer risers defining an annulus there between, each outer riser having an exterior surface, the exterior surface of each riser covered with an insulating amount of an insulation material, each annulus filled with a gas atmosphere consisting essentially of nitrogen, and a lower end of each riser coupled to the subsea source through respective lower riser assemblies (LRAs), one or more subsea flexible conduits, and one or more manifolds, and an upper end of each riser connected to its own subsea buoyancy assembly and to its own surface structure through respective upper riser assemblies (URAs) and one or more upper flexible conduits, optionally each riser being maintained in a near-vertical position by tension applied by the respective buoyancy assemblies.

A third aspect of the disclosure is a free-standing riser system connecting one or more subsea sources to one or more surface structures, said system comprising:

at least two concentric free-standing risers each comprising inner and outer risers defining an annulus there between, a lower end of each riser coupled to one of the subsea sources through a lower riser assembly (LRA) and one or more subsea flexible conduits, and an upper end of each riser connected to a buoyancy assembly and to one or more of the surface structures through an upper riser assembly (URA) and one or more upper flexible conduit, optionally the risers each being maintained in a near-vertical position by tension applied by its respective buoyancy assembly; and a hydrate inhibition system fluidly connected to the one or more subsea sources.

A fourth aspect of this disclosure is a hydrate inhibition system comprising:

(a) a vessel;

(b) one or more tanks secured to the vessel containing a liquid chemical suitable for inhibiting hydrate formation in subsea components;

(c) one or more primary (in certain embodiments diesel-driven) pumps fluidly connected to one or more of the tanks and to one or more subsea components through one or more umbilicals; and (d) one or more umbilicals fluidly connected to the one or more primary pumps and to one or more subsea components.

Certain hydrate inhibition system embodiments may include one or more booster (in certain embodiments air-driven) pumps fluidly connecting one or more of the tanks to one or more of the primary pumps. Certain other hydrate inhibition system embodiments may comprise a subsea, remotely-operated vehicle (ROV)-controlled umbilical distribution box fluidly connecting the umbilicals to a subsea ROV-controlled hot stab patch panel, the patch panel may in turn be fluidly connected to one or more of the subsea components.

A fifth aspect of this disclosure is a method of installing a subsea marine free-standing riser-based system, the method comprising the steps of (where steps (c)-(g) may be carried out in any order):

(a) constructing one or more concentric free-standing riser systems, each system comprising a concentric free-standing riser, a lower riser assembly (LRA) fluidly connected to one end of the free-standing riser, and an upper riser assembly (URA) fluidly connected to another end of the free-standing riser, the inner and outer risers defining an annulus there between;

(b) installing the concentric free-standing riser system at a subsea location;

(c) connecting an upper flexible conduit to the URA;

(d) installing a suction pile in the seabed and tensioning the free-standing riser system to the suction pile;

(e) connecting a subsea flexible conduit to the LRA and to a subsea source using a subsea installation vessel;

(f) removing seawater from the annulus and replacing the seawater with a flow assurance fluid; and (g) maintaining riser tension by connecting the URA to a near-surface subsea buoyancy assembly.

Certain installation method embodiments include those wherein step (b) may include clamping the upper flexible to a side of the concentric free-standing riser. Certain other installation method embodiments may include those wherein step (b) may be performed using a mobile offshore drilling unit (MODU).

A sixth aspect of this disclosure is a method of producing a fluid from a subsea source, the method comprising the steps of:

(a) deploying a subsea marine system comprising at least one concentric free-standing riser comprising inner and outer risers defining an annulus there between, a lower riser assembly (LRA), and an upper riser assembly (URA);

(b) fluidly connecting the free-standing riser to the subsea source and to a surface structure;

(c) initiating flow from the subsea source though the free-standing riser; and (d) maintaining flow though the free-standing riser by flowing a hydrate inhibitor chemical through one or more components of the subsea marine system (optionally, in certain embodiments one or more functional fluids may be introduced into the fluid from the subsea source, either through a port in the LRA, through a subsea manifold through which the fluid from the subsea source flows, or both).

A seventh aspect of this disclosure is a method of inhibiting hydrate formation in a subsea free-standing riser-based system, the method comprising the steps of:

(a) installing a concentric free-standing riser comprising inner and outer risers defining an annulus there between (optionally comprising wet insulation on an outer surface of the outer riser);

(b) filling the annulus with flow assurance fluid (optionally a gas atmosphere); and (c) flowing a hydrate-inhibitor liquid chemical from a surface structure to one or more subsea components.

An eighth aspect of the disclosure is an apparatus comprising:

(a) a plurality of inner and outer metallic, threadedly connected, cylindrical, substantially coaxial conduits defining an annulus there between, and a flow path internal to the inner conduit, the outer conduit having an outer surface; and (b) a flow assurance sub-system selected from the group consisting of:

(i) at least a major portion of the outer surface having syntactic material insulation thereon sufficient to maintain unobstructed flow through the internal flow path in the inner conduit;

(ii) a flow assurance fluid (such as a gas atmosphere, hot water, or organic chemical) present in the annulus sufficient to maintain unobstructed flow through the internal flow path in the inner conduit; and (iii) combinations of (i) and (ii);

and, optionally, wherein (c) the metallurgy of the conduits, in combination with sufficient structural reinforcement positioned between the inner and outer conduits, is such as to prevent failure of the inner conduit upon exposure of the inner conduit of the apparatus to internal pressure up to 5000 psia (34

MPa), or up to 10,000 psia (70 MPa), or up to 15,000 psia (105 MPa), or up to 20,000 psia (140 MPa), or up to 25,000 psia (175 MPa), or up to 30,000 psia (210 MPa).

A ninth aspect of the disclosure is a free-standing riser system connecting a subsea source to a surface structure, said system comprising:

a concentric free-standing riser comprising inner and outer risers defining an annulus there between, a lower end of the riser coupled to the subsea source through a lower riser assembly (LRA) and one or more subsea flexible conduits, and an upper end of the riser connected to a buoyancy assembly and the surface structure through an upper riser assembly (URA) and one or more upper flexible conduits, the riser being maintained in an erect substantially vertical position by tension applied by the buoyancy assembly;

the LRA selected from the group consisting of:

(i) an operable assembly of previously existing components, one or more of the components modified to accept flow of a hydrocarbon from a source of hydrocarbon and flow into the riser, and one or more of the components modified to accept a functional fluid, and (ii) an operable custom design comprising at least one component specially forged for use in the LRA, and adapted to accept a functional fluid, the URA selected from the group consisting of:

(i) an operable assembly of previously existing components, one or more of the components modified to cause flow of a hydrocarbon out from the riser to a surface vessel, and one or more of the components modified to accept a functional fluid, and (ii) an operable custom design comprising at least one component specially forged for use in the URA, and adapted to accept a functional fluid.

These and other features of the systems, apparatus, and methods of the disclosure will become more apparent upon review of the brief description of the drawings, the detailed description, and the claims that follow.

BRIEF DESCRIPTION OF THE DRAWINGS

The manner in which the objectives of this disclosure and other desirable characteristics may be obtained is explained in the following description and attached drawings in which.

Figure 1:
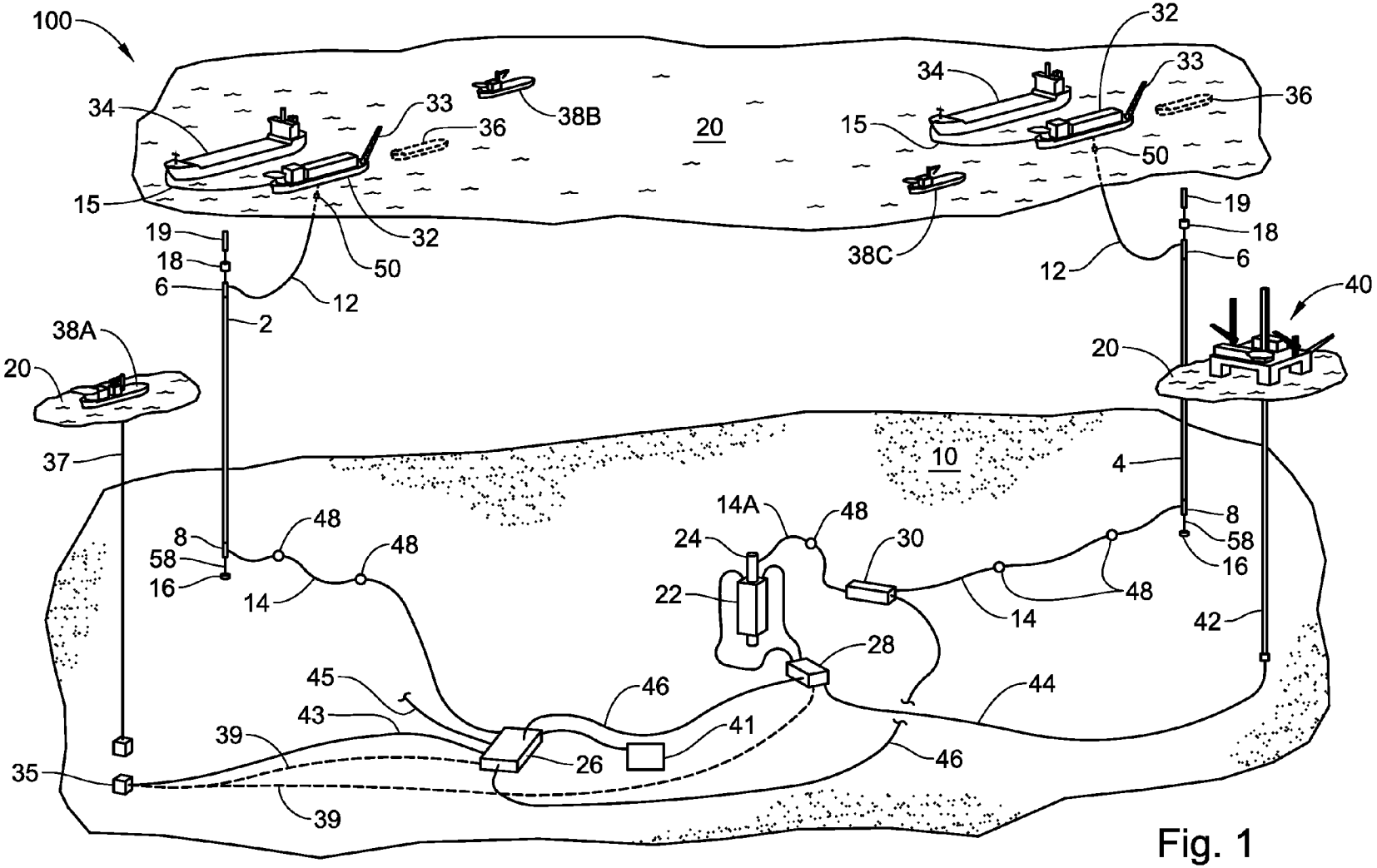
FIG. 1 is a schematic perspective view of one system embodiment within the present disclosure.

It is to be noted, however, that the appended drawings are not to scale and illustrate only typical embodiments of this disclosure, and are therefore not to be considered limiting of its scope, for the disclosure may admit to other equally effective embodiments. Identical reference numerals are used throughout the several views for like or similar elements.

DETAILED DESCRIPTION

In the following description, numerous details are set forth to provide an understanding of the disclosed methods, systems, and apparatus. However, it will be understood by those skilled in the art that the methods, systems, and apparatus may be practiced without these details and that numerous variations or modifications from the described embodiments may be possible. All U.S. published and non-published patent applications and U.S. patents referenced herein are hereby explicitly incorporated herein by reference. In the event definitions of terms in the referenced patents and applications conflict with how those terms are defined in the present application, the definitions for those terms that are provided in the present application shall be deemed controlling.

As noted previously, marine subsea concentric free-standing riser systems and methods of using same are described that fluidly connect one or more subsea sources to one or more surface structures which may reduce or overcome many of the faults of previously known systems and methods. As used herein the term "surface structure" means a surface vessel or other structure that may function to receive one or more fluids from one or more free-standing risers. In certain embodiments, the surface structure may also include facilities to enable the surface structure to perform one or more functions selected from the group consisting of storing, processing, and offloading of one or more fluids. As used herein the term "offloading" includes, but is not limited to, flaring (burning) of gaseous hydrocarbons. Suitable surface structures include, but are not limited to, one or more vessels; structures that may be partially submerged, such as semi-submersible structures; floating production and storage (FPS) structures; floating storage and offloading (FSO) structures; floating production, storage, and offloading (FPSO) structures; mobile offshore drilling structures such as those known as mobile offshore drilling units (MODUs); spars; tension leg platforms (TLPs), and the like.

As used herein the phrase "subsea source" includes, but is not limited to: 1) production sources such as subsea wellheads, subsea BOPs, other subsea risers, subsea manifolds, subsea piping and pipelines, subsea storage facilities, and the like, whether producing, transporting and/or storing gas, liquids, or combination thereof, including both organic and inorganic materials; 2) subsea containment sources of all types, including leaking or damaged subsea BOPs, risers, manifolds, tanks, and the like; and 3) natural sources. Certain system embodiments include those wherein the containment source is a failed subsea blowout preventer.

The terms "flow assurance" and "flow assurance fluid" includes assurance of flow in light of hydrates, waxes, asphaltenes, and/or scale already present, and/or prevention of their formation, and are considered broader than the term "hydrate inhibition", which is used exclusively herein for prevention of hydrate formation. The term "hydrate remediation" means removing or reducing the amount of hydrates that have already formed in a given vessel, pipeline or other equipment. The term "functional fluid" includes flow assurance fluids, as well as fluids which may provide additional or separate functions, for example, corrosion resistance, hydrogen ion concentration (pH) adjustment, pressure adjustment, density adjustment, and the like, such as kill fluids.

As used herein the term "substantially vertical" means having an angle to vertical ranging from about 0 to about 45 degrees, or from about 0 to about 20 degrees, or from about 0 to about 5 degrees. As such the term "substantially vertical" includes and is broader than the term "near-vertical", as that term is used in describing the angle a riser may make with vertical.

In the containment and disposal context, embodiments of systems and methods described herein may be used in any marine environment. Certain system embodiments may be fully or partially deployed before, during, and/or after a subsea component has been compromised (for example, but not limited to, subsea well blowouts, damaged subsea BOPs, damaged subsea risers or other subsea conduits, damaged subsea manifolds), and may be used in any marine environment, but may be particularly useful in deep and ultra-deep subsea marine environments.

Certain embodiments of the systems may be fully or partially deployed before, during, and/or after production of fluids from one or more subsea wells. Embodiments of apparatus, systems, and methods described herein may also be used before, during, and/or after exploration, drilling, completion, and intervention.

In certain embodiments, the LRA may comprise a subsea wellhead housing having a lower end and an upper end, the lower end fluidly connected to a transition joint, the transition joint capped on its lower end with a first pad eye end forging serving as an anchor point for the free-standing riser. In certain embodiments the transition joint may comprise one or more intake ports, at least one of the intake ports fluidly connected to an LRA production wing valve assembly. In certain embodiments the LRA production wing valve assembly may be fluidly connected to the subsea source or sources through one or more of the subsea flexible conduits, and the upper end of the subsea wellhead housing may be fluidly connected to an LRA external tieback connector fluidly connecting the subsea wellhead housing to a riser stress joint. In certain embodiments the riser stress joint may in turn be fluidly connected to the outer riser.

Certain system embodiments include those wherein the LRA further comprises a hub assembly fluidly connecting the LRA production wing valve assembly with one of the subsea flexible conduits.

Certain system embodiments include those wherein the transition joint in the LRA further comprises one or more hot stab ports for subsea vehicle intervention and/or maintenance, wherein the subsea vehicle may be selected from the group consisting of an ROV, an autonomous underwater vehicle (AUV), and the like.

Yet other system embodiments include those wherein the LRA transition joint further comprises one or more ports allowing pressure and/or temperature monitoring.

In certain embodiments the URA may comprise a drilling spool adapter fluidly connected at a first end to the concentric riser and a second end fluidly connected to a tubing head comprising one or more outtake ports, the tubing head connected to a casing head, and the casing head connected to a shackle flange adapter capped on its top with a second pad eye end forging serving as an attachment point of the concentric riser to the buoyancy assembly, the URA further comprising one or more URA production wing valve assemblies, the URA wing valve assemblies fluidly connected to the collection vessel through one of the upper flexible conduits.

Still other system embodiments include those wherein the free-standing riser may comprise an annulus vent sub that allows the annulus between the inner and outer risers to either be open to the environment, or to facilitate circulation of a flow assurance fluid, or closed to the environment after displacing seawater therefrom with a hydrate-preventing fluid, for example a gas phase to contain either a low or high pressure gas cushion, or heated seawater or other water, or methanol or other organic fluid, or combination of these. Certain system embodiments include those wherein the annulus vent sub may comprise one or more valves controllable by a subsea vehicle.

In certain embodiments the annulus may be filled with a gas atmosphere consisting essentially of nitrogen, where the phrase "consisting essentially of nitrogen" means that the gas atmosphere may be mostly nitrogen plus any allowable impurities that would not affect the ability of the nitrogen to prevent hydrate formation.

Certain system embodiments include those wherein one or more of the subsea flow lines may be flexible conduits.

Certain system embodiments include those wherein at least some portions of the inner and outer risers may comprise sections of pipe joined by threaded joints. In certain embodiments, one or both of the inner and outer risers may be constructed using high strength steel tubulars using threaded coupled connectors.

Certain system embodiments include those wherein the URA wing valve assembly may comprise at least one emergency shutdown (ESD) valve. In certain embodiments the ESD valve may comprise one hydraulically-operated and one electrically-operated ESD valve, one or both controlled using an umbilical connected to a collection vessel at the surface.

Certain system embodiments include those wherein the URA production wing valve assembly may comprise first and second flow control valves for controlling flow in the inner riser and in the annulus. For example, flow of a flow assurance or other functional fluid might be circulated in the annulus.

Certain system embodiments include those wherein the subsea flexible conduits each may comprise a lazy wave flexible jumper with distributed buoyancy modules connected to the subsea flexible conduit randomly or non-randomly from a point of connection of the subsea flexible conduit to the base of the free-standing riser to a subsea manifold on the seafloor, the manifold fluidly connected to the subsea source or sources.

Certain system embodiments include those further comprising an internal tieback connector fluidly and mechanically connecting the inner riser to the LRA, the internal tieback connector comprising a nose seal, in some embodiments an Inconel nose seal, which seals into a subsea wellhead profile of the subsea wellhead housing, the connector also latching with dogs both to the subsea wellhead housing and to the stress joint in order to create a preloaded structural connection between the subsea wellhead and the internal and external tieback connectors. Certain embodiments also may comprise an additional external connector latch that latches the internal tie-back connector to the subsea wellhead housing. The nose seal provides pressure integrity between the internal flow path in the inner riser and the annulus between the inner and outer risers.

Certain system embodiments include those comprising a suction pile foundation in the seabed, the suction pile foundation comprising a plunger and a chain tether connecting the plunger to the LRA.

Certain system embodiments include those comprising external wet insulation on the outer riser for flow assurance. In certain embodiments the wet insulation may comprise a syntactic foam material. In certain embodiments the syntactic foam material may comprise a plurality of layers of syntactic polypropylene.

Certain system embodiments include those comprising a gas atmosphere (in some embodiments low pressure nitrogen) in the annulus between the inner and outer riser for flow assurance.

Certain system embodiments include those further comprising external wet insulation on some or all of the outer surface of the outer riser, and a gas atmosphere (in some embodiments nitrogen) in the annulus between the inner and outer riser for flow assurance.

Certain system embodiments include those comprising an inner riser adjustable hanger fluidly connecting an upper end of the inner riser to the upper riser assembly.

Certain system embodiments include those wherein the buoyancy assembly may comprise one or more air cans. In certain system embodiments one or more of the air cans may comprise a non-integral air can system comprising a primary and one or more auxiliary air cans to provide failed chamber redundancy.

Certain system embodiments include those wherein the URA production wing valve assembly comprises both hydraulically- and ROV-operated emergency shutdown valves.

Certain system embodiments include those wherein the URA production wing valve assembly comprises one or more subsea vessel hot-stab ports allowing a functional fluid, such as a flow assurance fluid, to be injected into either one or both of the inner riser and the annulus. Examples of suitable functional fluids include nitrogen or other gas phase, heated seawater or other water, or organic chemicals such as methanol, and the like.

Certain system embodiments include those wherein the one or more upper flexible conduits comprises one or more flexible surface jumpers comprising a quick disconnect coupling ("QDC") allowing it to be disconnected quickly from the floating production and storage vessel either in an emergency or during a planned event (i.e. vessel drive/drift off or hurricane evacuation).

Yet other system embodiments include those wherein the outer riser may comprise one or more clamps for immobilizing the upper flexible conduit(s) adjacent the outer riser.

Still other system embodiments include those wherein the system may comprise two or more same or different concentric free-standing risers positioned laterally apart in the sea, each separately attached to its own (or to the same) ship-based floating production and storage facility, and to the same or different subsea source or sources.

Certain system embodiments include those wherein the system may comprise a hydrate inhibition system fluidly connected to the subsea source. Certain system embodiments include those wherein the hydrate inhibition system may be based on a surface vessel, and the fluid connection comprises a plurality of umbilicals.

Certain system embodiments may include a subsea automatic or semi-automatic chemical dispersant injection system (SADI) operably connected to the subsea source.

Certain system embodiments include those comprising an annulus vent sub fluidly connected to one or more of the outer risers allowing the annulus between the inner and outer risers to either be open to the environment to facilitate circulation of a flow assurance fluid, or seawater to be displaced with a hydrate-preventing gas phase and closed to the environment to contain either a low or high pressure gas cushion.

Certain system embodiments include those wherein at least one outer riser may comprise two or more annulus vent subs fluidly connected thereto. Certain system embodiments include those wherein the annulus vent sub may comprise one or more valves controllable by an ROV.

Still other system embodiments include those wherein one of the subsea sources is a malfunctioning subsea BOP, and one of the umbilicals is fluidly connected to a kill line of the subsea BOP. Certain system embodiments include those wherein one of the subsea sources is a malfunctioning subsea BOP, and one of the umbilicals is fluidly connected to a subsea BOP stack manifold. Yet other system embodiments include those wherein one of the umbilicals is fluidly connected to a subsea manifold.

Certain system embodiments include those wherein at least one of the LRAs may comprise a first generally cylindrical member having a longitudinal bore, a lower end, an upper end, and an external generally cylindrical surface, the first member comprising sufficient intake ports extending from the external surface to the bore to accommodate flow of hydrocarbons from the hydrocarbon fluid source as well as inflow of a functional fluid (flow assurance fluid or other fluid, for example a corrosion or scale inhibitor, kill fluid, and the like), at least one of the intake ports fluidly connected to a production wing valve assembly, the upper end of the first member comprising a profile suitable for fluidly connecting to a subsea riser, the lower end of the first member comprising a connector suitable for connecting to a seabed mooring.

In certain embodiments the LRA may comprise a subsea wellhead housing having a lower end and an upper end, the lower end fluidly connected to a transition joint, the transition joint capped with a first pad eye end forging serving as an anchor point for the free-standing riser, the transition joint comprising one or more intake ports, at least one of the intake ports fluidly connected to an LRA production wing valve assembly, the wing valve assembly fluidly connected to the subsea source or sources through the one or more subsea flexible conduits, and the upper end of the subsea wellhead housing fluidly connected to an LRA external tieback connector fluidly connecting the subsea wellhead housing to a riser stress joint.

Certain system embodiments include those wherein at least one of the URAs may comprise a second generally cylindrical member having a longitudinal bore, a lower end, an upper end, and an external generally cylindrical surface, the second member comprising sufficient outtake ports extending from the bore to the external surface to accommodate flow of hydrocarbons from the riser as well as inflow of a functional fluid, at least one of the outtake ports fluidly connected to a production wing valve assembly for fluidly connecting the second member with a subsea flexible conduit, the upper end of the second member comprising a connector suitable for connecting to a subsea buoyancy device, and the lower end of the second member comprising a profile suitable for fluidly connecting to a subsea riser.

In certain embodiments the URA may comprise a drilling spool adapter fluidly connected at a first end to the concentric riser and a second end fluidly connected to a tubing head comprising one or more outtake ports, the tubing head connected to a casing head, and the casing head connected to a shackle flange adapter capped on its top with a second pad eye end forging serving as an attachment point of the concentric riser to the buoyancy assembly, the URA further comprising a URA production wing valve assembly, the URA wing valve assembly fluidly connected to the collection vessel through one of the upper flexible conduits.

Certain installation method embodiments include those wherein riser tension may be maintained using a non-integral aircan system chain tethered above the riser to the buoyancy assembly. In certain installation method embodiments, the aircans may provide at least 100 kips (445 kilonewtons) effective tension at the base of the riser under loading conditions, including failure of one or more aircan chambers. Certain systems of the present disclosure may also be used with risers tensioned by hydro-pneumatic tensioners, or combinations of these with one or more aircans. Certain systems and methods of the present disclosure may be used with wet tree developments, including those employing a floating production, storage, and offloading (FPSO) vessel or other floating production systems (FPS), including, but not limited to, semi-submersible platforms. Certain systems and methods of the present disclosure may also be used with dry tree developments, including those employing compliant towers, tension leg platforms (TLPs), spars or other FPSs. Certain systems and methods of the present disclosure may also be used with so-called hybrid developments (such as TLP or spar with an FPSO or FPS).

Certain installation method embodiments may comprise disconnecting the upper flexible conduit using a quick disconnect coupling (QDC).

Certain installation method embodiments may comprise attaching a disconnectable buoy to the upper flexible near the vessel.

Yet other installation method embodiments may comprise, in the event of an unplanned or planned disconnect, disconnecting the upper flexible conduit from the vessel in a controlled manner and lowering the conduit using a support vessel to hang the conduit along a side of the free-standing riser. Still other installation method embodiments include clamping the conduit in place substantially adjacent the free-standing riser using an ROV other subsea vessel.

Certain installation method embodiments include using existing dry tree riser components and subsea wellhead inventory.

Certain method embodiments include those comprising shutting down flow of the subsea source by closing at least one emergency shutdown valve in the URA.

Still other method embodiments include those wherein the URA may comprise a production wing valve assembly, the method comprising controlling flow in the inner riser and in the annulus using first and second flow control valves in the URA production wing valve assembly.

Certain method embodiments include fluidly connecting the free-standing riser to the subsea source using one of the subsea flexible conduits comprising a lazy wave flexible jumpers having randomly or non-randomly distributed buoyancy modules connected to the conduit along at least a portion of a length of the subsea flexible conduit from a point near the base of the free-standing riser to a point between the base of the free-standing riser and a subsea manifold on the seafloor, the manifold fluidly connected to the subsea source or sources.

Certain subsea method embodiments comprise fluidly connecting the inner riser to the LRA employing an internal tieback connector.

Certain subsea method embodiments include those comprising assuring flow of fluid through the riser using external wet insulation on at least a portion of the outer riser for flow assurance. Certain subsea method embodiments include those comprising assuring flow of fluid through the riser using a flow assurance fluid, for example a gas atmosphere in the annulus between the inner and outer riser, or hot seawater or other water pumped down the riser, or methanol. Certain subsea method embodiments include those comprising assuring flow of fluid through the riser using external wet insulation on at least a portion of the outer riser and a flow assurance fluid in the annulus between the inner and outer riser for flow assurance. The flow assurance fluid may be selected from the group consisting of a gas atmosphere selected from nitrogen, nitrogen-enriched air, a noble gas such as argon, xenon and the like, carbon dioxide, and combinations thereof; hot seawater or other water pumped in the annulus and out the annulus vent sub, and methanol pumped in the annulus and out the vent sub.

Certain subsea method embodiments include those comprising wherein the URA production wing valve assembly may comprise one or more ROV hot-stab ports allowing a flow assurance fluid in the annulus between the inner and outer riser and in the inner riser for flow assurance. The flow assurance fluid may be selected from the group consisting of a gas atmosphere selected from nitrogen, nitrogen-enriched air, a noble gas such as argon, xenon and the like, carbon dioxide, and combinations thereof; hot seawater or other water pumped in the annulus and out the annulus vent sub, and methanol pumped in the annulus and out the vent sub.

Certain apparatus embodiments include those wherein the combination of conduit metallurgy and structural reinforcement is such as to prevent failure of the inner conduit upon exposure of the inner conduit of the apparatus to internal pressure up to 10,000 psia (70 MPa).

The primary features of the systems, methods, and apparatus of the present disclosure will now be described with reference to the drawing figures, after which some of the construction and operational details will be further explained. The same reference numerals are used throughout to denote the same items in the figures.

In accordance with the present disclosure, illustrated in FIG. 1 is an embodiment 100 of a deepwater subsea containment, disposal and production system. While many of the apparatus, systems, and methods described herein were developed and used in the context of containment and disposal, it is explicitly noted that the apparatus, systems, and methods described herein, many features of which have never before been used or even contemplated heretofore, are not restricted to containment and disposal operations, but may be used in conjunction with any "subsea source", as that term is defined herein.

System embodiment 100 of FIG. 1 comprises twin free-standing risers (FSR's) 2 and 4 each fluidly connected in this particular embodiment to a subsea blowout preventer 22 on seabed 10 through a series of manifolds and flexible jumpers, and back through an upper flexible jumper 12 to separate ship-based floating production and storage systems on sea surface 20, as further explained herein. FSR1 (2) is connected to a processing vessel 32, which in turn is connected to a collection vessel 34 via a floating offloading hose 15. FSR2 (4) is connected in a similar configuration to its own processing vessel 32 and collection vessel 34. The processing vessels may be the same or different. Other vessels, denoted 38A, B, and C in the various drawing figures, may be provided for subsea installation, operational and ROV assistance to system 100, and hydrate prevention and remediation, if needed. Other system 100 components may include a stack cap 24 (which may be utilized in efforts to stop flow of oil out of BOP 22); a choke/kill manifold ("CKM") designated as 28; a flare 33 or other optional gas disposal/containment apparatus 36, such as a natural gas handling and storage system and method as described in assignee's U.S. Pat. No. 6,298,671; and various subsea connector conduits, 46.

Still referring to FIG. 1, a surface structure 40 may service a polished bore receptacle (PBR) and riser assembly 42 that is fluidly connected via a subsea flexible jumper 44 to CKM 28. The riser may include a seal stem on its distal end that slidlingly seals in a polished bore within the PBR. These features are more fully described in assignee's pending application Ser. No. 61/479,695, filed Apr. 27, 2011.

Umbilicals from chemical dispersant and hydrate inhibition systems, designed in FIG. 1 collectively as 43, may be included, as well as one or more burst discs 45 on CDM 26. A hydrate inhibition system service vessel 38A may be provided, which may supply hydrate inhibition chemical, power and/or hydraulic assistance through one or more umbilicals 37, a subsea umbilical distribution box 35, and electrical power and/or hydraulic umbilical lines 39. A further important feature of this embodiment is a quick connect/disconnect coupling feature, 50, allowing flexibles 12 to be quickly disconnected from their respective surface vessels 32, either as a result of random or non-random (planned) events. Embodiments of quick connect/disconnect coupling feature, 50, are described in assignee's U.S. provisional application Ser. No. 61/480,368, filed Apr. 28, 2011.

Figure 1A:
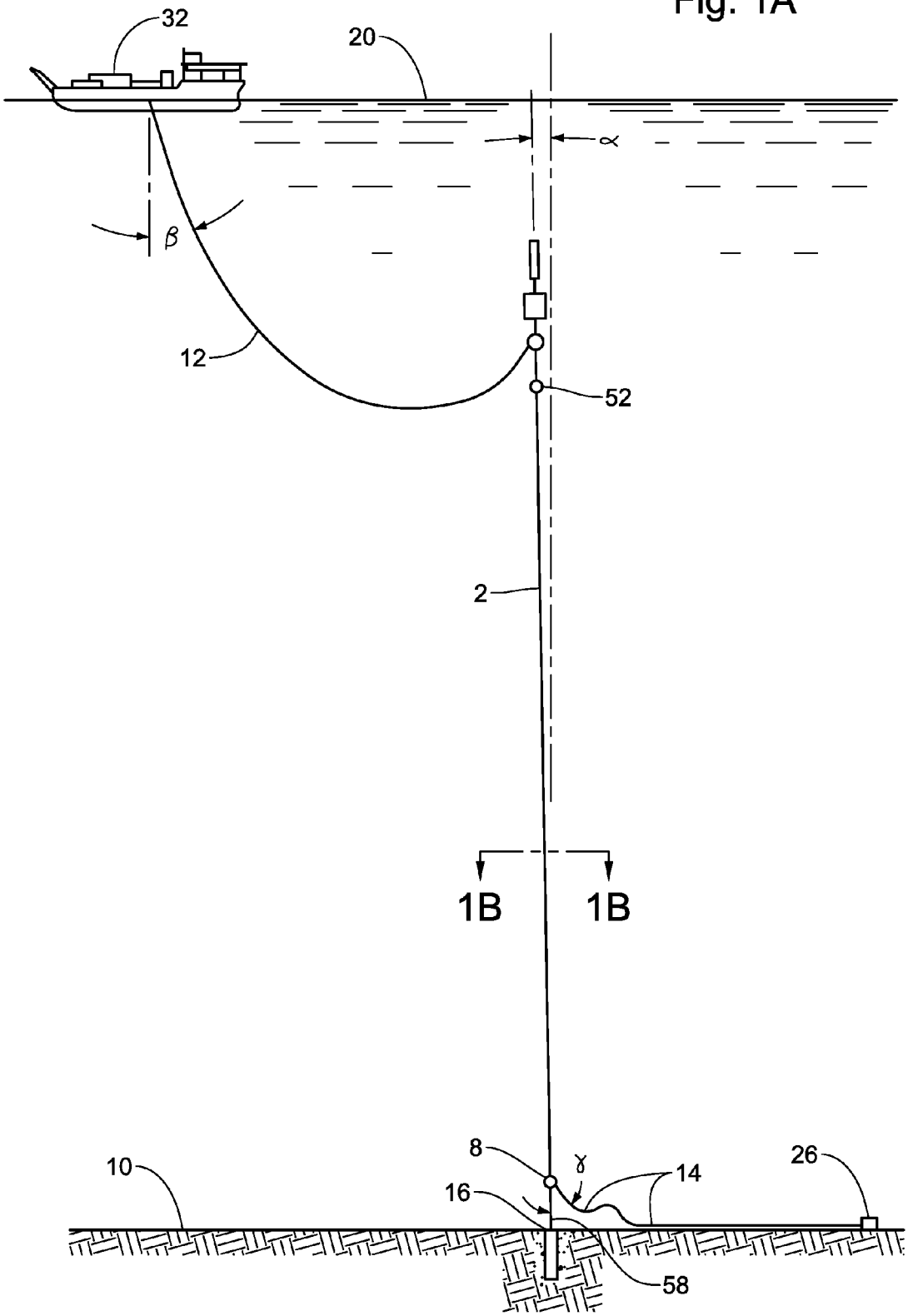
FIGS. 1A, 1B, 1C, and 1D illustrate schematically, FIG. 1B in detailed cross-section, one embodiment of a system in accordance with the present disclosure.
Figure 1B:
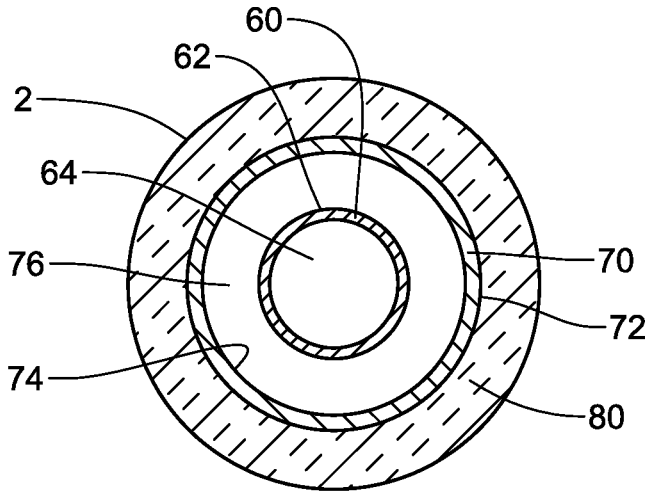
Figure 6A:
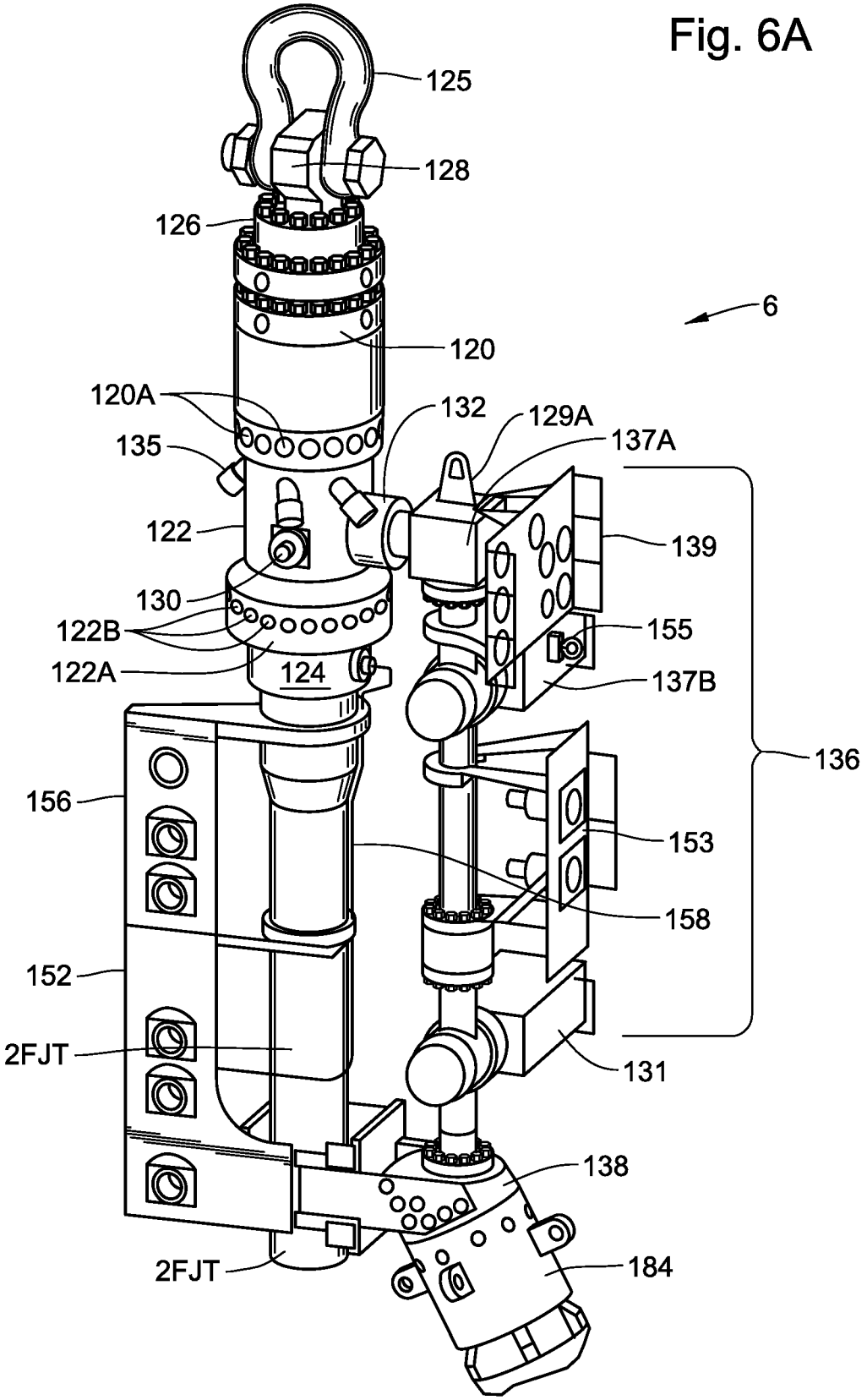
FIGS. 6A-6G include various views, with FIG. 6E in cross-section, of another embodiment of an upper riser assembly in accordance with the present disclosure.
Figure 6B:
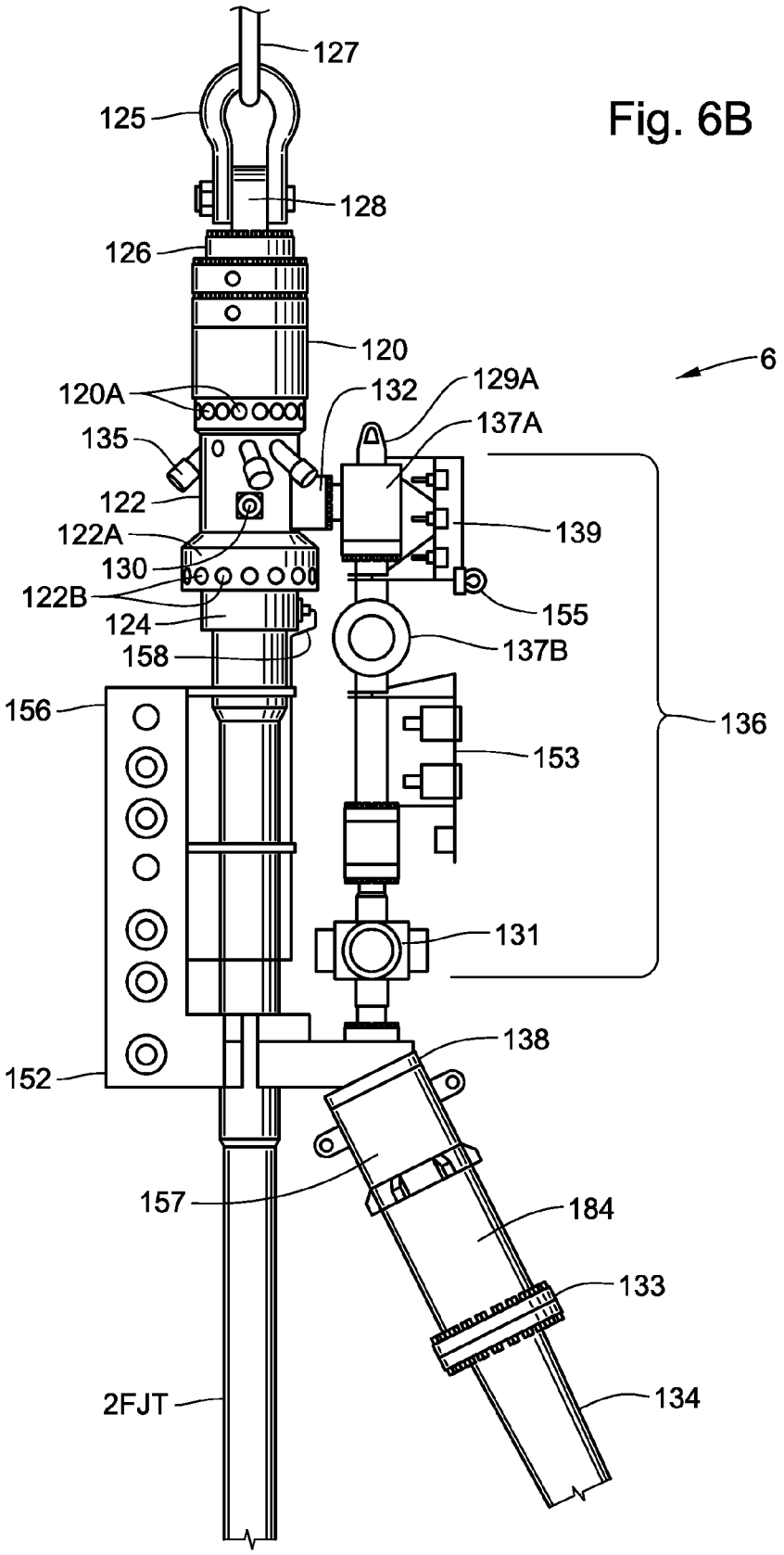
Figure 6C:
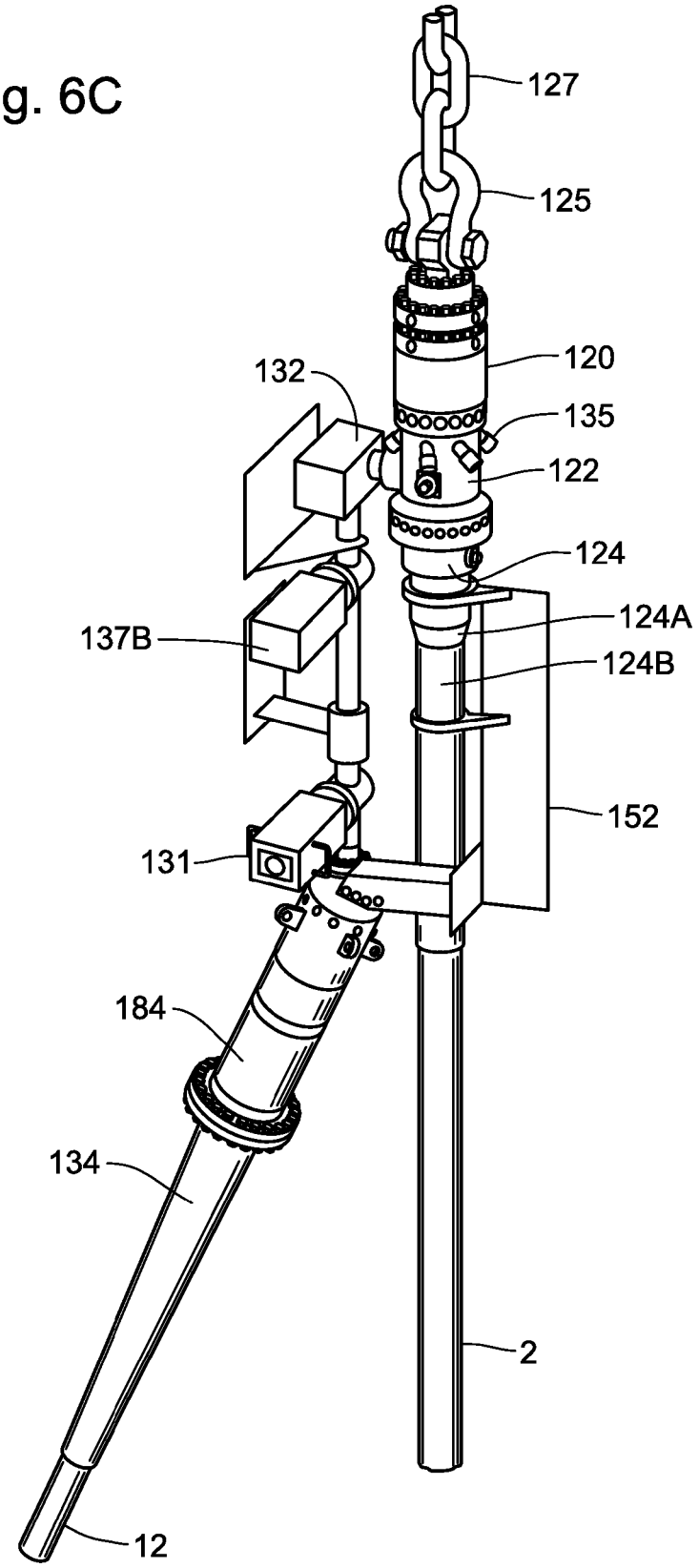

Free-standing risers 2 and 4 in embodiment 100 may be wet-insulated pipe-in-pipe designs based in part on "dry tree" riser designs with provision to fill the annulus with a flow assurance fluid (for example, low pressure nitrogen) to improve flow assurance. Although the details are further explained herein, the main components of system 100 may be:

Lazy wave 6-inch (15 cm) ID flexible jumpers 14 with distributed buoyancy modules 48 connected from the base of each FSR to a subsea manifold on the seafloor (in the case of FSR1 (2) it may be connected to a containment disposal manifold (CDM) designed as 26, and FSR2 (4) may be connected to a stack manifold 30, which is fluidly connected to BOP cap stack 24 via flexible jumper 14A, and to CDM 26 via a flexible 46);

A suction pile foundation 16 and chain tether 58 may be connected to the base of each FSR 2 and 4;

A lower riser assembly (LRA), designed 8, may comprise in this embodiment a modified subsea wellhead 104, transition joint 105, lower forging 106, external tieback connector 102 and stress joint (variously referred to in the industry as a "flex joint, bottom" or (FJB)) with two production wing valve assemblies 114A and B fluidly connected to corresponding LRA intake ports 108A and B (see FIG. 3A), one of which may be connected to the seafloor flexible jumper 14;

An internal tieback connector (92, FIG. 3F) to connect inner riser 60 to the LRA 8;

Two pipe-in-pipe riser strings 2 and 4 with external wet insulation 80 on the outer riser 70 and low pressure nitrogen in the annulus 76 between the inner and outer risers (60, 70) for hydrate flow assurance (see FIG. 1B);

An inner riser adjustable hanger (159, FIG. 6E) to connect the inner riser 60 to an upper riser assembly (URA), designated as 6 throughout the drawings;

An upper riser assembly that may comprise in this embodiment a casing head 124, tubing head 122, and drilling spool adapter 120 (see FIG. 6E) connected with a chain tether 127 to an "air can" buoyancy assembly (18, 19 in FIG. 1) to maintain adequate buoyancy during operations. The URAs 6 of embodiment 100 may each comprise a single production wing valve assembly 136 (FIG. 6B) having both hydraulic and manually operated emergency shutdown valves, along with nitrogen injection via ROV hot-stab ports to both the inner riser flow path 64 and annulus 76 between inner and outer risers (60, 70);

A non-integral aircan system (18, 19) comprising a primary (18) and auxiliary (19) air cans to provide the failed chamber redundancy philosophy; and One 6-inch (15 cm) ID flexible surface jumper 12 fluidly connected from each URA 6 to its respective processing and collection vessels 32, 34. Flexible surface jumper 12 may be designed so that it may be disconnected from the surface vessel in an either an emergency or planned event (i.e. vessel drive/drift off or weather evacuation). Certain embodiments may include an hydraulic control umbilical connected along with the flexible surface jumper 12 to control an emergency shutdown valve near the top of the riser inner riser from the containment vessel.

Figure 2:
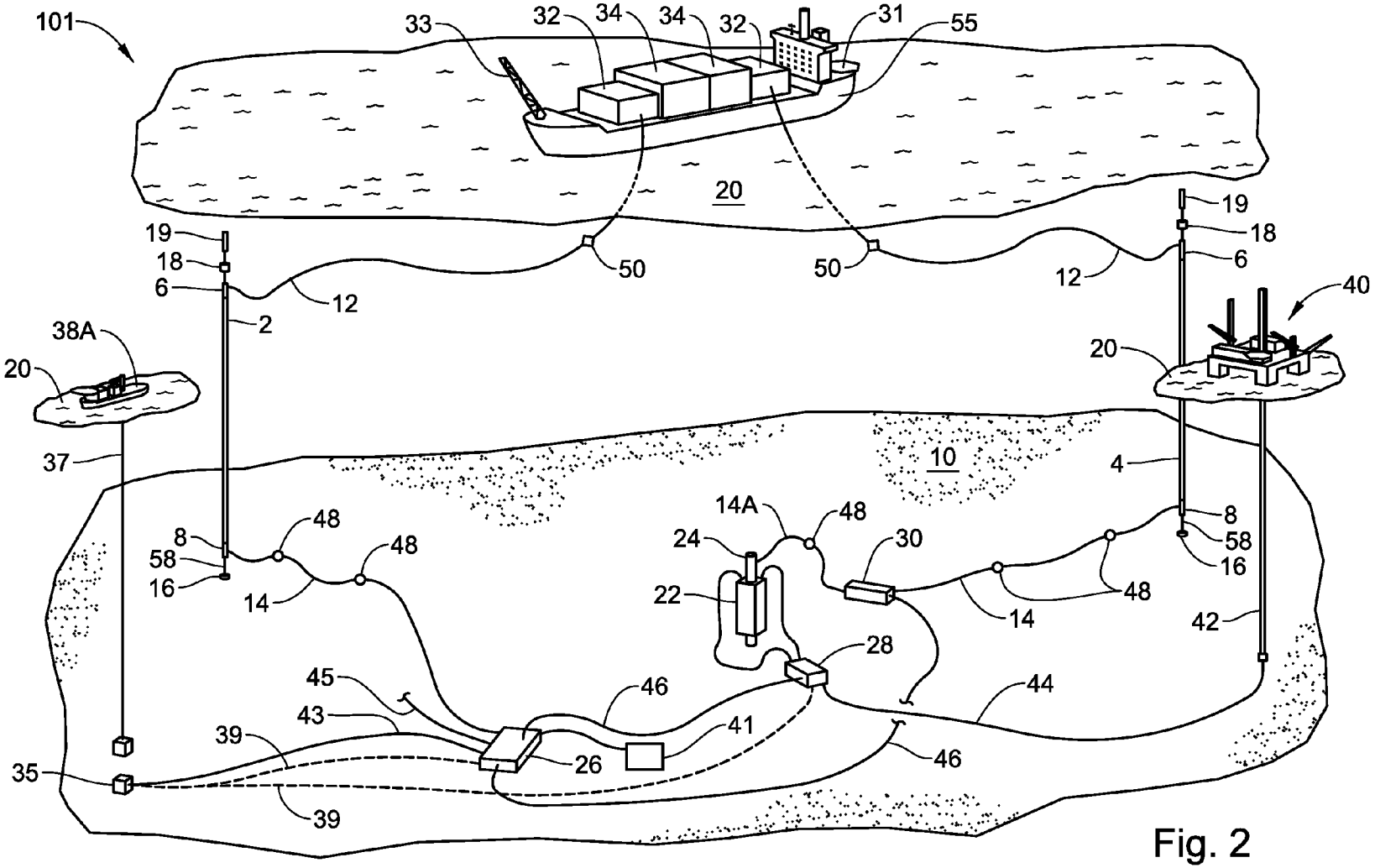
FIG. 2 is a schematic perspective view of another system embodiment within the present disclosure.

FIG. 2 illustrates another system and method embodiment 101 that may be useful in certain situations. Embodiment 101 includes a single multipurpose surface vessel 55 combining many of the functions and features of vessels 32, 34, 36, 38A-C, 40, and other vessels not illustrated in FIG. 1, including separating function previously provided by vessel 32, collection function previously provided by vessel 34, flare function at 33, quick disconnection ability at 50, and helicopter pad 31. In certain embodiments vessel 55 may be a dynamically positioned vessel, although this is not a requirement. A portion of one or all of one of collection areas 34 may function as storage and/or offloading areas. A portion of vessel 55 may comprise riser storage, for flexible risers and/or rigid riser sections, and may comprise equipment suitable for making up connections of risers, for example, threaded sections, including cradles, and the like, positioned on, in, alongside, and/or underneath vessel 55.

Vessel 55 (as well as vessels 32, and 34 in embodiment 100) may include a fluid transfer system, such as described more fully in assignee's U.S. provisional patent application Ser. No. 61/480,368, incorporated herein by reference. Vessel 55 may also comprise subsea installation equipment, cranes, modules, or other equipment for deploying and/or installing one or more subsea manifolds for example, or for connecting flexibles from risers to vessel 55, or from an LRA to a subsea manifold. Vessel 55 may include the vessel-bound portions of a hydrate inhibition system, as further described herein. Vessel 55 may comprise ROV controllers, and storage and remediation facilities for one or more ROVs. In certain embodiments, vessel 55 comprises all necessary components, materials, and manpower for a complete containment, disposal and/or production effort, without need of other vessels.

Figure 1C:
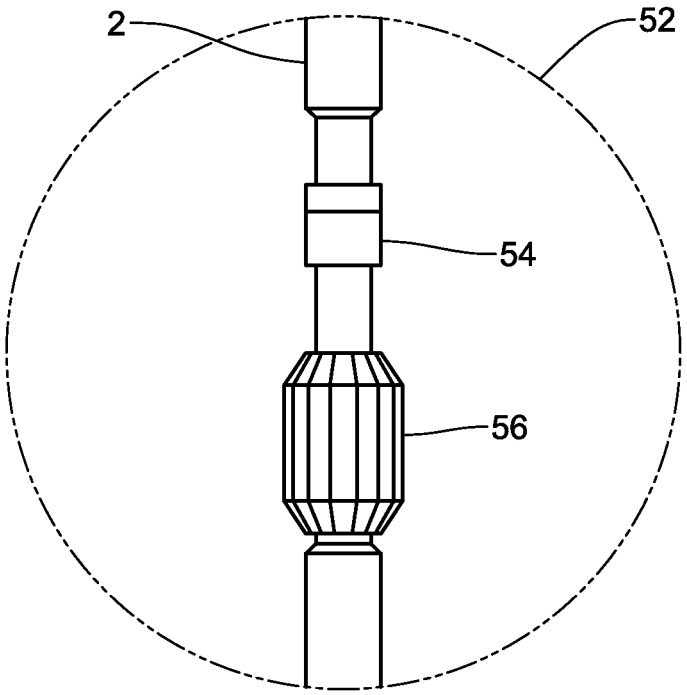

FIGS. 1A-1C illustrate schematically (FIG. 1B in detailed cross-section) one embodiment of a system in accordance with the present disclosure. FSR 2 is illustrated at an angle $\alpha$ with respect to vertical. Angle $\alpha$ may range from 0 to 20 degrees, which is considered "near-vertical." Another angle, $\beta$, is defined as the angle between vertical and a tangent line to flexible conduit 12 near the water surface 20. Angle $\beta$ may range from 0 to about 60 degrees. A third angle $\gamma$, defined as the angle between vertical and flexible conduit 14 near the base of a free-standing riser, may range from about 5 to about 60 degrees, or from about 5 to about 30 degrees.

FIG. 1A also depicts the location of a tension monitoring system 52 on FSR 2, although the location may be anywhere along FSR 2, and may comprises a plurality of such monitoring systems randomly or non-randomly spaced along FSR 2. FIG. 1C depicts details of the tension monitoring system, illustrating a connector 54 and a tension monitoring module 56.

FIG. 1B illustrates the relative locations of inner riser 60, outer riser 70, outer surface 62 of inner riser 60, outer surface 72 of outer riser 70, inner surface 74 of outer riser 70, annulus 76, and flow path 64 in inner riser 60. Centralizers (not illustrated) may be positioned between inner riser 60 and outer riser 70 along the length of FSR 2 as required in known fashion. Solid insulation 80 is in this embodiment placed adjacent at least a major portion of outer surface 72 of outer riser 70, and in certain embodiments, this solid insulation is adjacent the entire outer surface 72 of outer riser 70.

Electrically heated risers may be an option in certain embodiments, although for operational reasons associated with the emergency disconnect (QDC) or weather evacuation scenarios, this option may not be very attractive. Electrical heating may significantly complicate the QDC design.

Circulation of a functional fluid, such as hot water, in the annulus, and insulation on the subsea manifolds, flowlines (including flexible subsea conduits 12 and 14, and flexible jumpers and goosenecks mentioned herein), and connectors, in addition to the free-standing riser, are preferred. The ability to pump a functional fluid, such as methanol or heated water, into the ROV hot stab receptacles is another option, as is the ability to pump a functional fluid such as nitrogen or other gas phase into the bottom of the inner riser or at the subsea manifold CDM into the flexible subsea conduits as a way to get the fluid underneath an actual or potential, complete or partial hydrate plug or other flow restriction. In certain embodiments such as embodiment 100 illustrated in FIG. 1, the system and method may be set up to pump methanol into the bottom of the inner riser 60, in the bottom of annulus 76, into the bottom (subsea) flexible 14, at the top of inner riser 60 and annulus 76 and into upper flexible conduit 12.

Figure 1D:
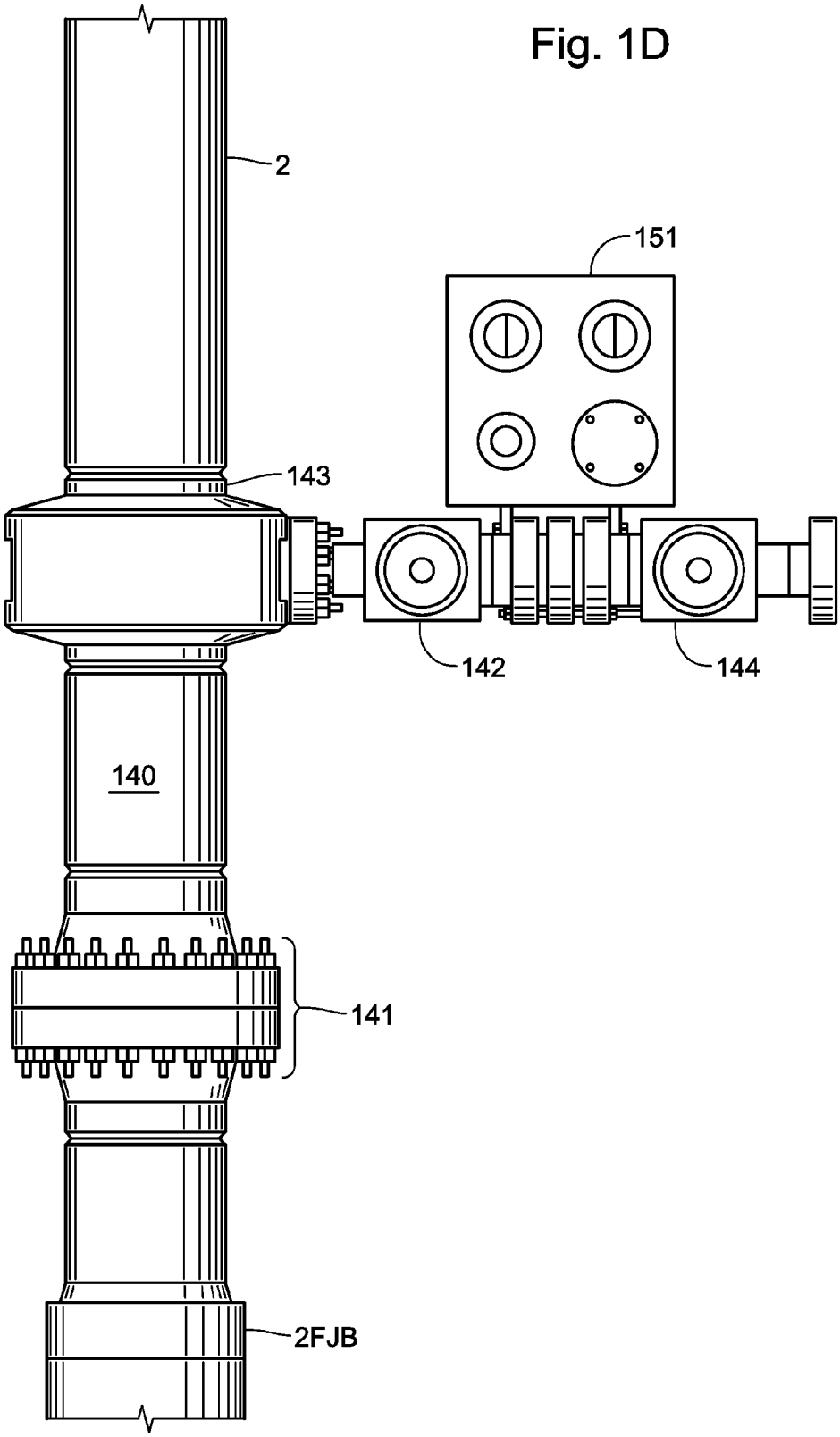

FIG. 1D illustrates schematically an annulus vent sub adapter 140 flanged into FSR 2 via a flange connection 141 and threaded connection 143. Adapter 140 provides annulus vent sub valves 142, 144, and an ROV hot stab panel 151 for temperature and pressure monitoring. In certain embodiments, the FSR may be designed with the capability to circulate hot water down the annulus between the outer and inner risers using an arrangement such as illustrated schematically in FIG. 8A at 919, exiting at valves 142, 144 on the annulus vent sub. Although this is considered within the present disclosure, this may be a slightly more complex arrangement, requiring two jumpers at the top of the riser, one to handle the contained hydrocarbons and the other to provide a conduit for heated sea water to be circulated down the annulus.

Flow assurance calculations may indicate that an FSR could be designed with a 5 layer, 3-inch (7.6 cm) thick polypropylene thermal insulation coating applied to the outer riser, while the annulus between the inner and outer riser may be displaced with low pressure nitrogen. During operation, this scheme may substantially maintain the temperature of the hydrocarbons from subsea BOP 22 to arrival on the containment vessel 32. Further details of this embodiment of an LRA are explained in relation to FIGS. 3A-3J.

Lower Riser Assembly (LRA)

Figure 2B:
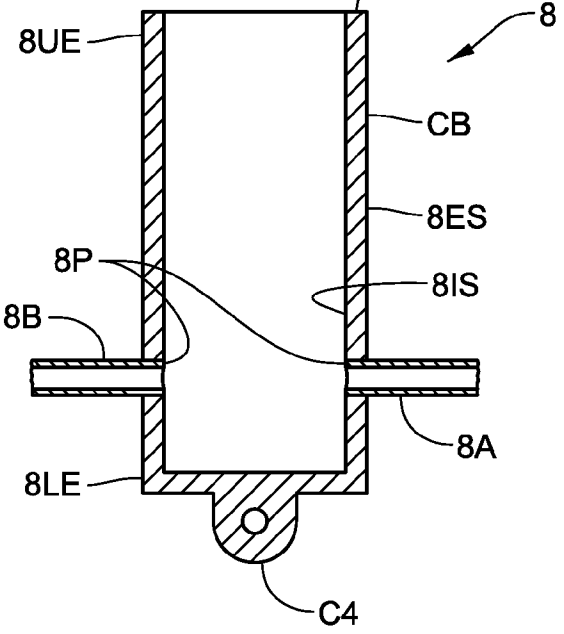
FIGS. 2A and 2B are schematic illustrations, with FIG. 2B in cross-section, of one embodiment of a lower riser assembly in accordance with the present disclosure.
Figure 2A:
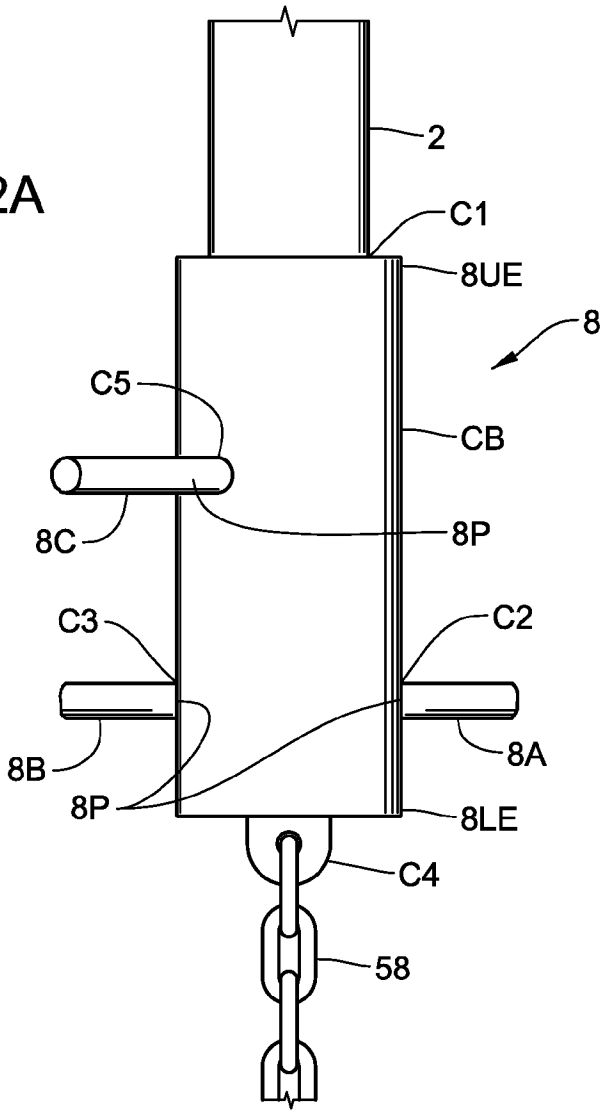

FIGS. 2A and 2B are schematic side-elevation and cross-sectional views, respectively, of a general embodiment of a lower riser assembly (LRA) in accordance with the present disclosure. LRA 8 includes a generally cylindrical body CB, an upper end 8UE and a lower end 8LE, and five connections C1, C2, C3, C4, and C5 in this embodiment. Connection C1 is a mechanical and fluid connection of cylindrical body CB to riser 2. Connection C4 is a mechanical connection of cylindrical body CB to a subsea mooring (not illustrated) through a chain or other functional tether 58. Connections C2, C3, and C5 are mechanical and fluid connections of conduits 8A, 8B, and 8C to cylindrical body CB though ports 8P in cylindrical body CB. Ports 8P extend from an inner surface 81S to an external surface 8ES of cylindrical body CB.

Conduits 8A, 8B, and 8C may be, for example, wing valve assemblies connecting to subsea hydrocarbon sources, connections to sources of functional fluids such as flow assurance fluids, or connections to other subsea or surface equipment. Connections C2, C3, and C5 between ports 8P and conduits 8A, 8B, and 8C may be threaded connections, flange connections, welded connections, or other connections, and they may be the same or different with respect to type of connection, diameter and shape, depending on diameter and shape of ports 8P; for example, ports 8P could have a shape selected from the group consisting of slot, slit, oval, rectangular, triangular, circular, and the like. Connection C1 may be a threaded, flanged, welded, or other connection, and may include one or more dogs, collet, split ring, or other features. In certain embodiments, the LRA may have the ability to connect to manifolds and other equipment, such as flexibles, within 270 degrees radius angle of approach.

Figure 3A:
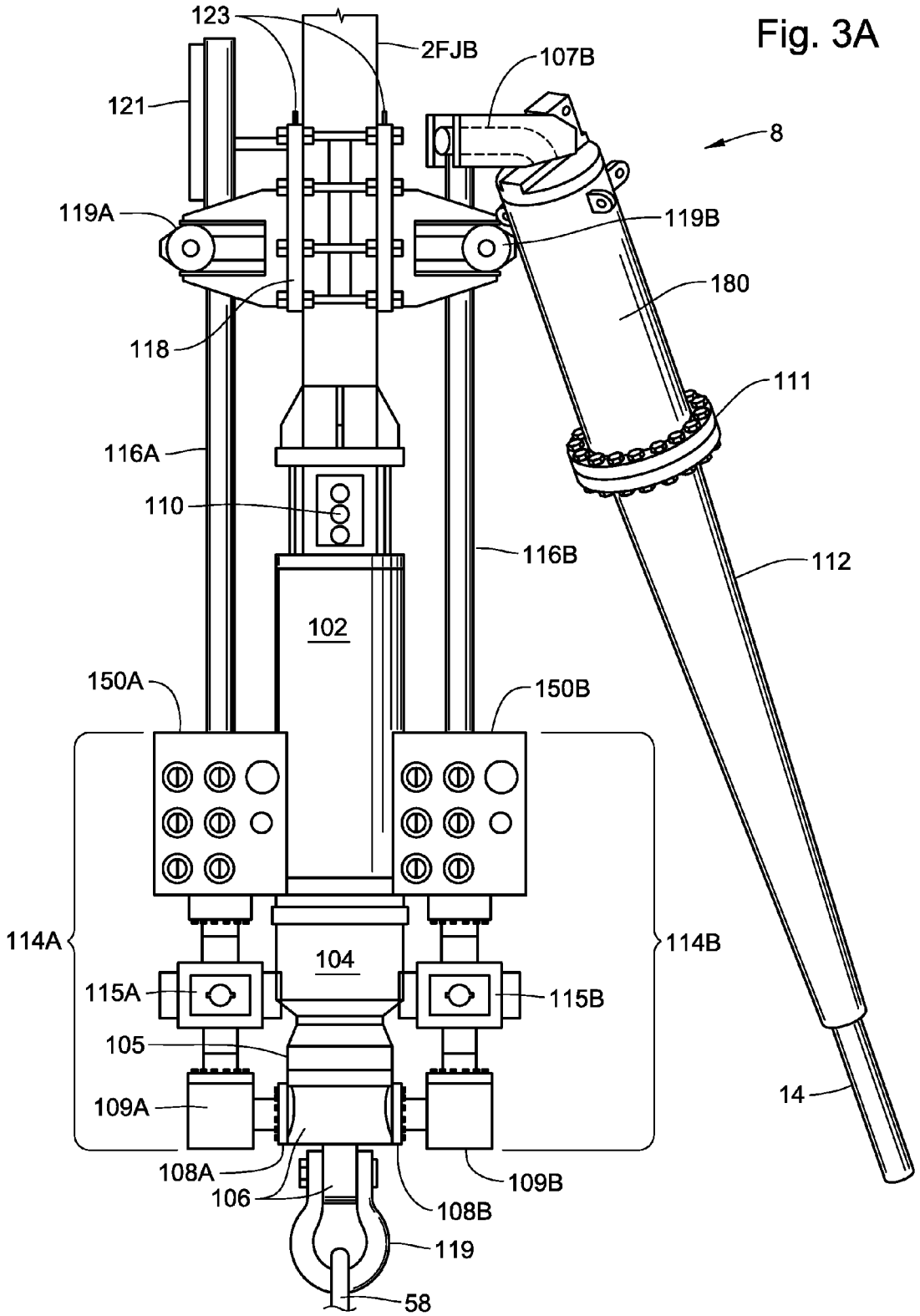
FIGS. 3A-3G include various views, FIG. 3F in cross-section, of another embodiment of a lower riser assembly in accordance with the present disclosure.
Figure 3B:
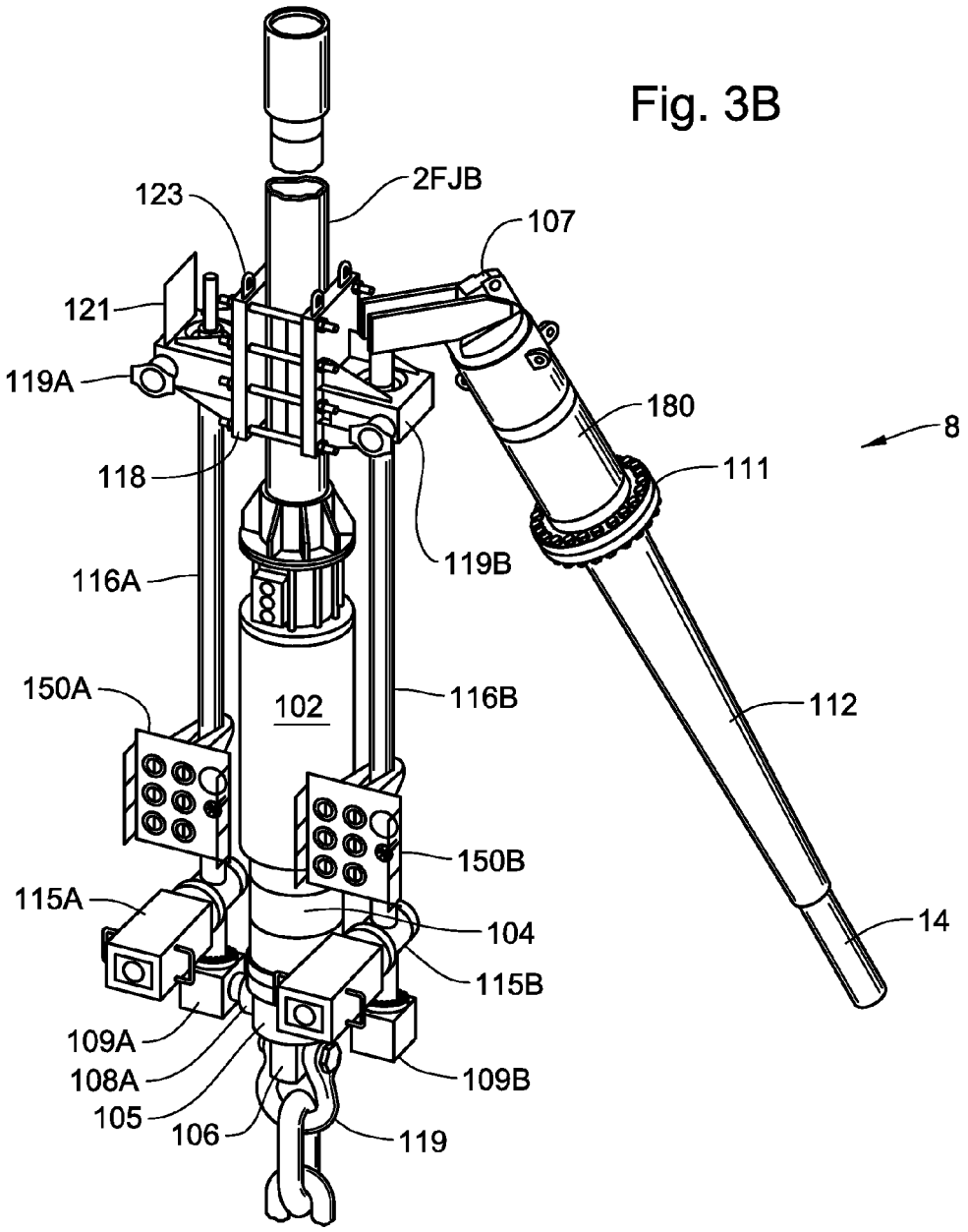

Another embodiment of an LRA is illustrated in various views in FIGS. 3A-3J. FIG. 3A is a front elevation view of LRA 8, which in this embodiment comprises an external tie-back connector 102 connected to a subsea wellhead 104 (as more further explained in relation to FIGS. 3H-3J) and transition joint 105. Transition joint 105 is welded on its top end in this embodiment to the bottom of subsea wellhead 104, and to a bottom forging 106 including two machined flange connections 108A and 108B, and a padeye. The two machined flanged connections 108A and 108B are substantially perpendicular to a longitudinal axis common to wellhead 104, transition joint 105 and forging 106, and the two machined flanged connections 108A and 108B define LRA intake ports. Bottom forging and padeye are one piece 106 in this embodiment, and transition joint 105 is a separate piece that welds bottom forging 106 to subsea wellhead 104.

When in use, the padeye of end forging 106 engages a U-connector 119 and tether chain 58, leading to suction pile assembly 16 (not illustrated in FIG. 3).

LRA 8 further comprises an ROV hot stab panel 110 for operating external tie-back connector 102 when making connection with subsea wellhead 104. External tieback connector 102 may be a slimline or ultra-slimline tieback connector such as available commercially from GE Oil and Gas, Houston, Tex. (formerly Vetco); FMC Technologies, Inc, Houston, Tex.; and possibly other suppliers. One such tieback connector is described in U.S. Pat. No. 7,537,057. Those skilled in the art will understand that known external tieback connectors are engineered with the understanding that as the design tension on the connector increases, the allowable bending moment decreases in an inverse relationship. Specific curves for these capacity relationships are available from the manufacturers.

A flange 111 may connect a bend restrictor 112 and subsea flexible conduit 14 to a high-pressure subsea bend stiffener 180, the latter having an internal profile 81 (see FIG. 3F) allowing subsea flexible conduit 14 to fluidly connect with LRA gooseneck assembly 107. As illustrated schematically in FIG. 3F, bend stiffener 180 may encase a flange connection 81 connecting subsea flexible conduit 14 to a high-pressure subsea connector 181, the latter may be used to mechanically and fluidly connect to conduit 107B of LRA 8. Bend stiffener 180 may take the moment off of flange connection 81 so that it may be transferred directly from bend restrictor 112 to high-pressure subsea connector 181, which is coming out of the upper end of bend stiffener 180. Containment or production fluids flow upward through subsea flexible conduit 14 and flange connection 81 into a hub assembly 116B (two hub assemblies 116A and B are indicated in this embodiment), and further through an LRA production wing valve assembly 114B (two production wing valve assemblies 114A and B are indicated in this embodiment, FIG. 3A).

Figure 3C:
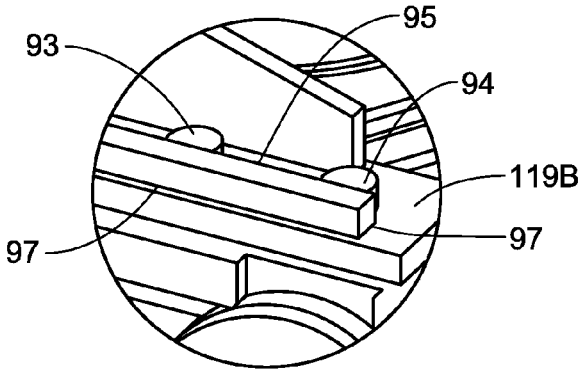
Figure 3D:
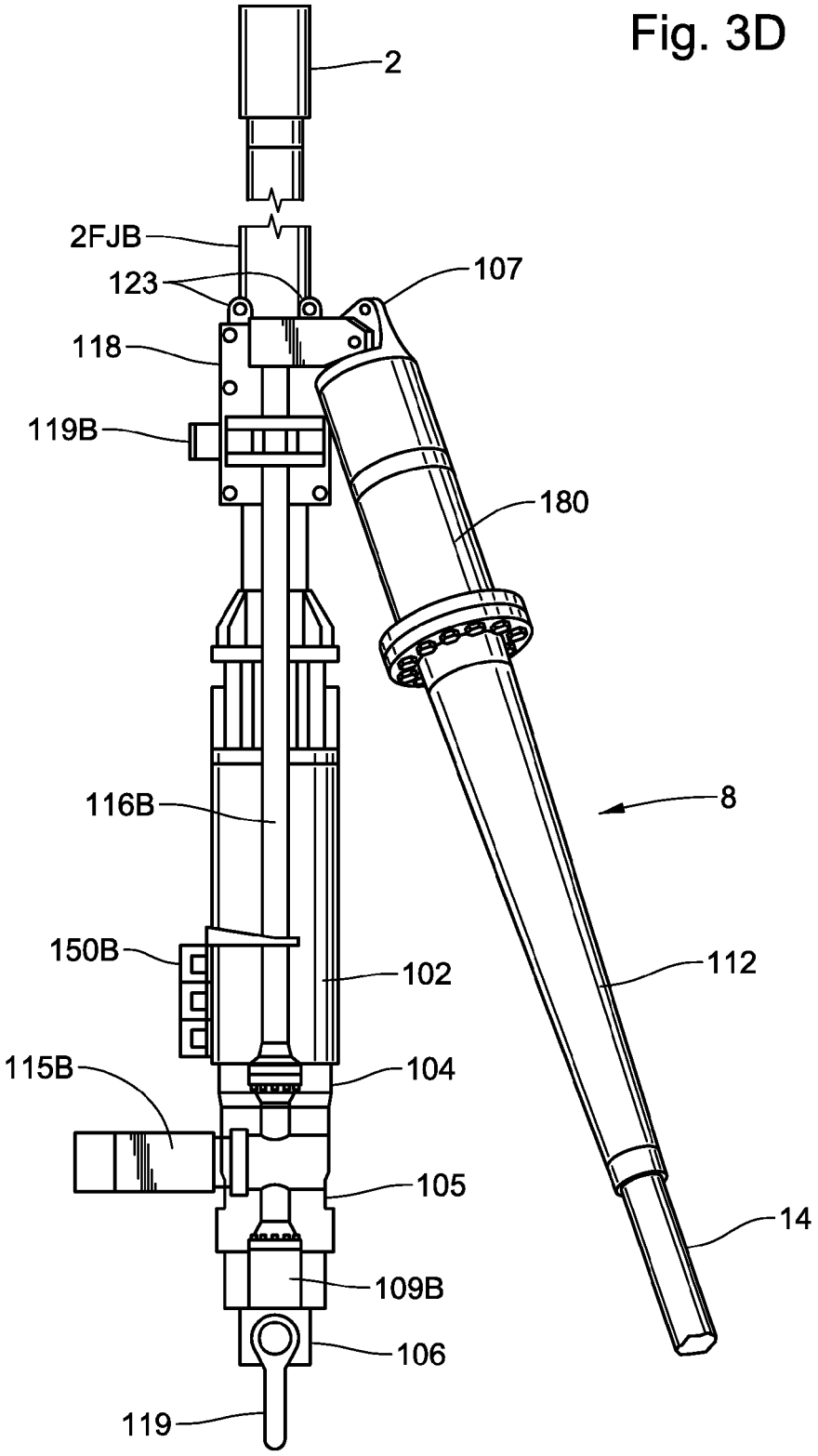
Figure 3E:
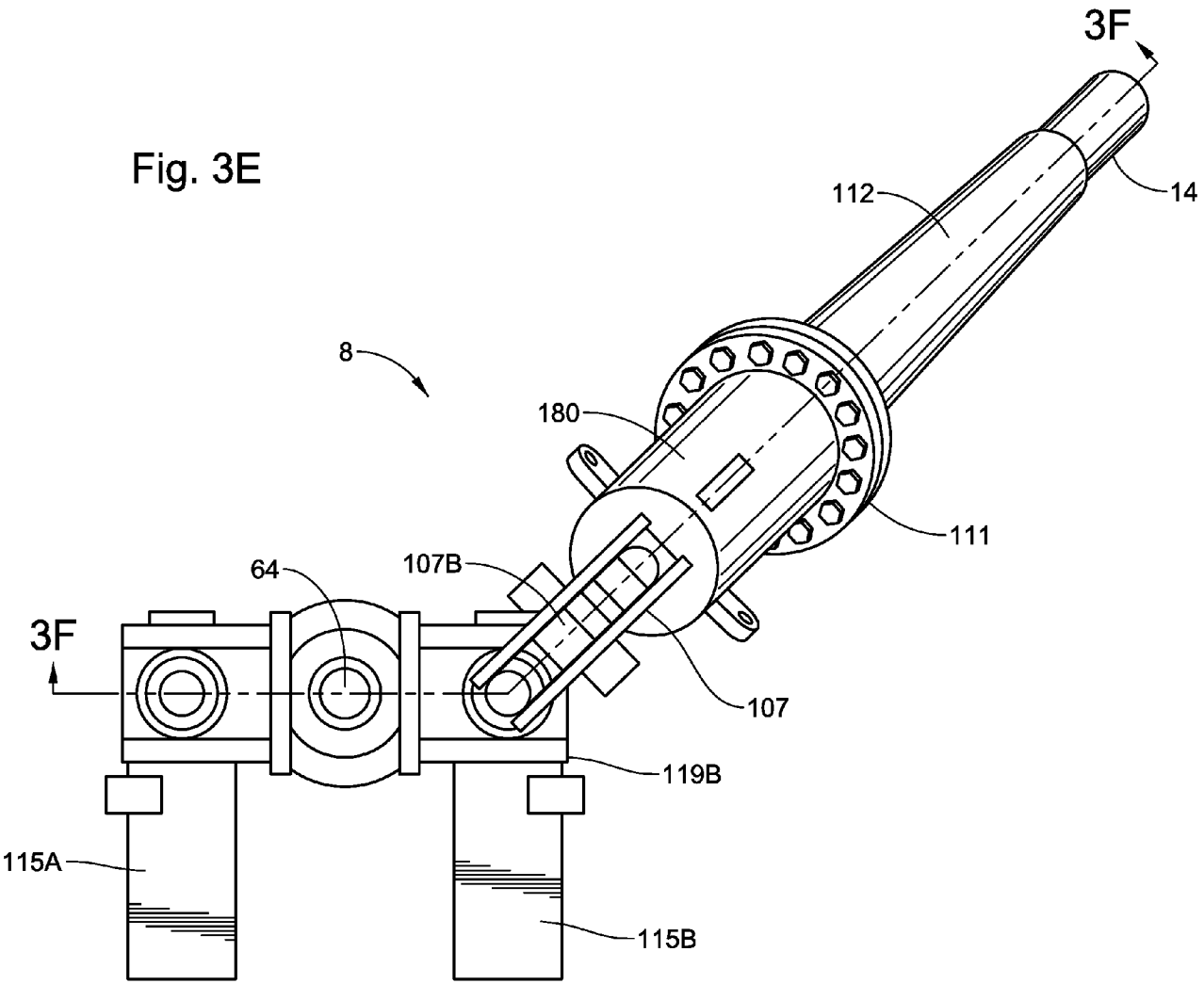
Figure 3F:
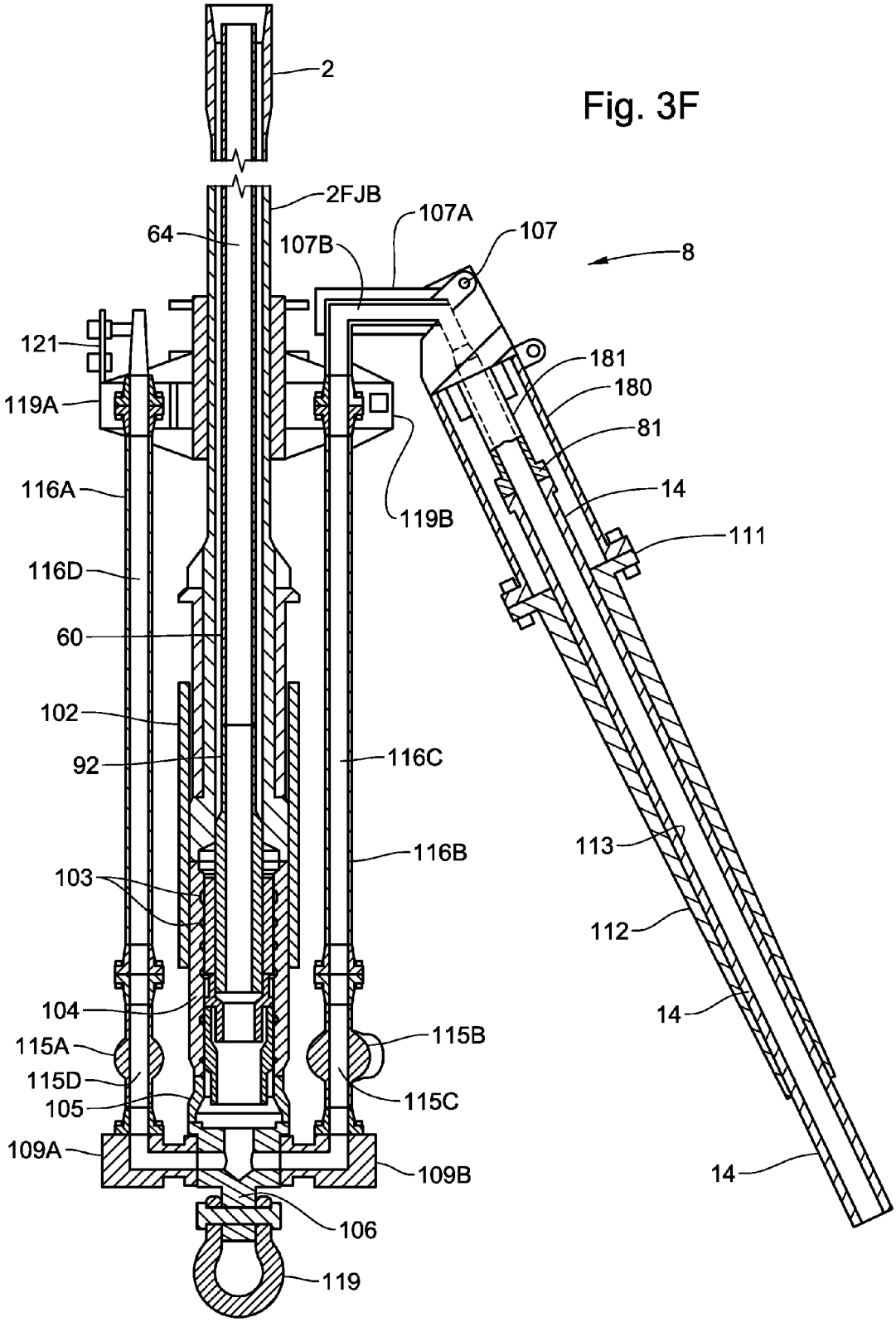

LRA production wing valve assemblies 114A and B may each comprise respective block elbows 109A and 109B, and ROV-operated manual gate valves 115A and 115B, as well as respective flow paths 115C and 115D (FIG. 3F). ROV hot stab panels 150A and 150B, respectively, may be provided for temperature and pressure monitoring. A subsea clamp structural support 118 may provide support for subsea connectors 119A and 119B (such as available from Vector Subsea, Inc. under the trade designation OPTIMA). An ROV hot stab panel 121 with a mount to blind hub assembly 116A may be provided, which may accommodate pressure and/or temperature monitoring sensors. Four swivel hoist rings 123 may also be provided on structural support 118 in this embodiment.

FIG. 3C is a detailed schematic view illustrating hex bolts 94 welded at 93 to a clamp bolt retaining block 95. Block 95 may also be welded at locations 97 to the body of subsea connector 119B. A similar arrangement may be included on subsea connector 119A, but is not illustrated.

FIG. 3D is a side elevation view, and FIG. 3E is a plan view of LRA 8. Gooseneck 107 may swivel through a wide angle as may be required during connection of flexible conduit 14, as viewed from the plan view, but once secured by connector 119B this motion may be restricted.

Figure 3G:
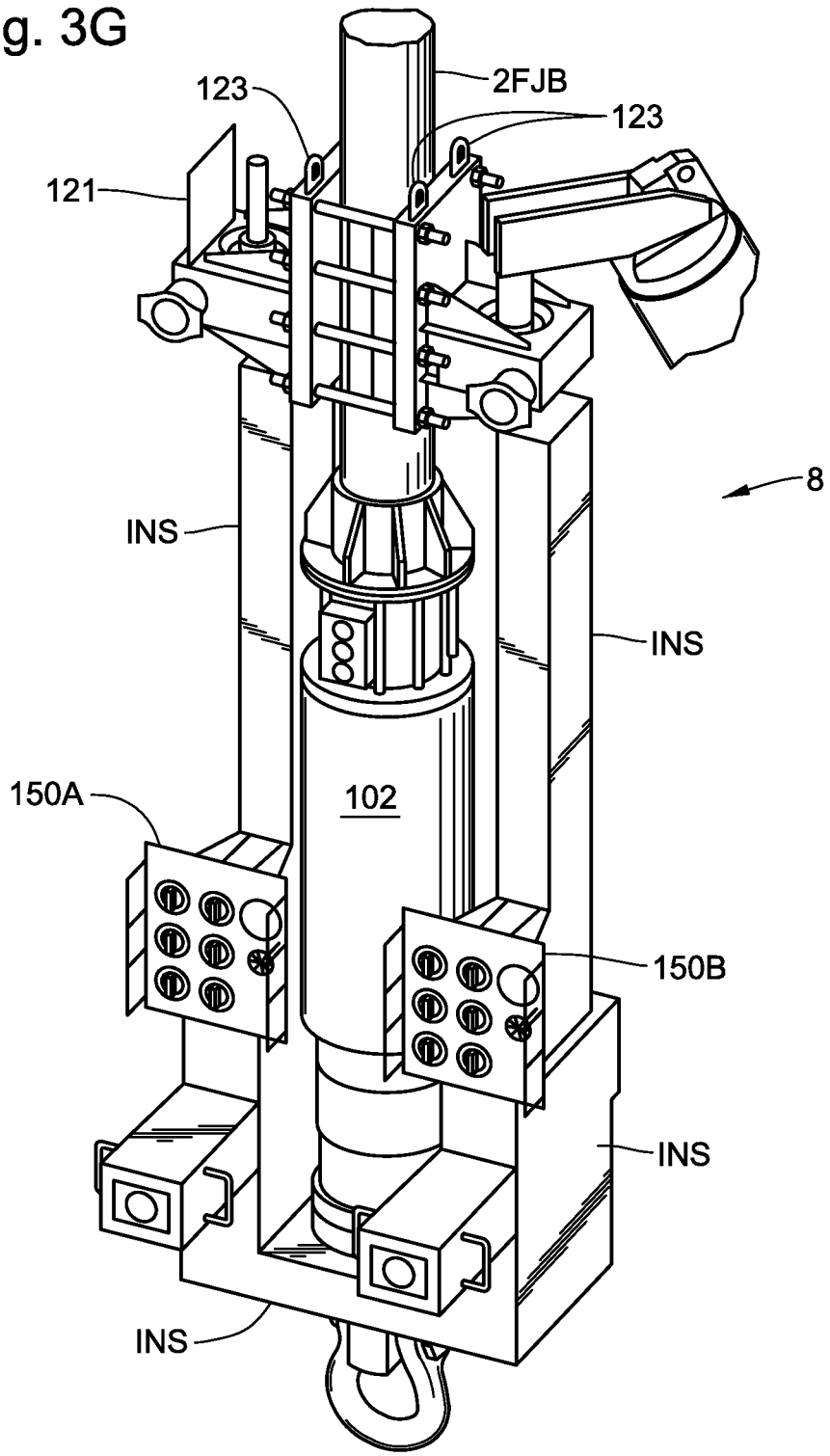

FIG. 3F is a cross-sectional view taken along the dotted line of FIG. 3E, and illustrates certain internal features of LRA 8, most particularly the containment fluid flow path, as indicated by reference numerals 113, gooseneck conduit 107B (through connector 107A), 116C, 115C (through valve 115B and block elbow 109B), and finally flow path 64 through internal tieback connector 92 and inner riser 62. FIG. 3F also illustrates five casing (sometimes referred to in the art as lockdown) hangers 103 pre-installed into subsea wellhead 104, the upper most hanger latching internal tieback connector 92 into subsea wellhead 104, as explained further in reference to FIGS. 3H-J. In certain embodiments there may be one, two, three, or more hangers 103. FIG. 3G indicates position of thermal insulation, designated INS, on portions of LRA 8.

Figure 3H:
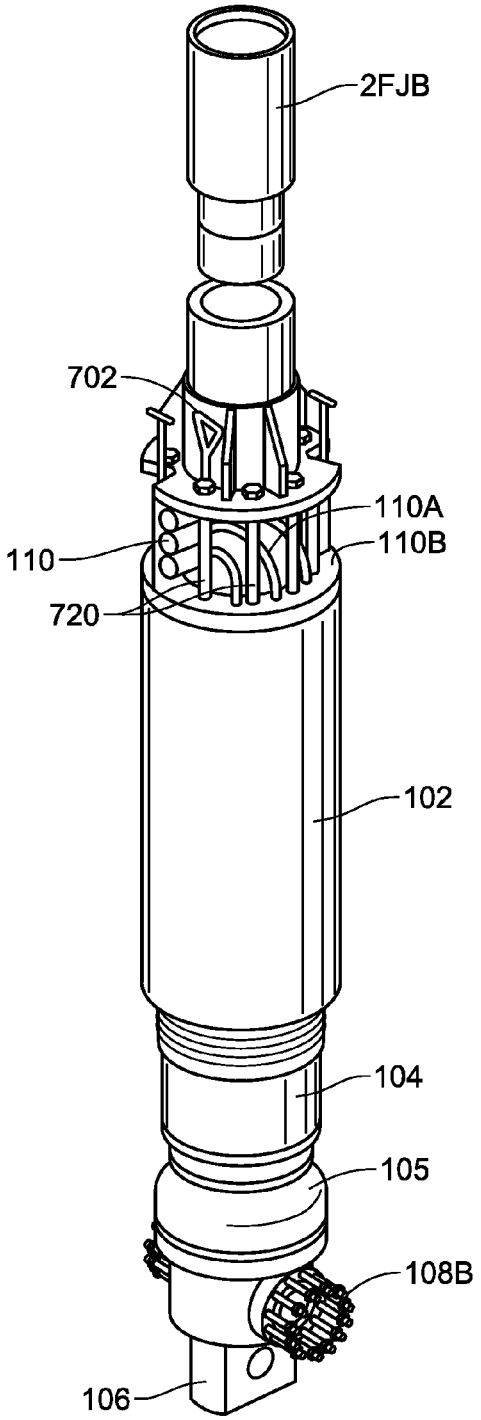
FIG. 3H is a perspective view, FIG. 3I a cross-sectional view, and FIG. 3J a more detailed cross-sectional view of a portion of the lower riser assembly embodiment of FIGS. 3A-3G.
Figure 3I:
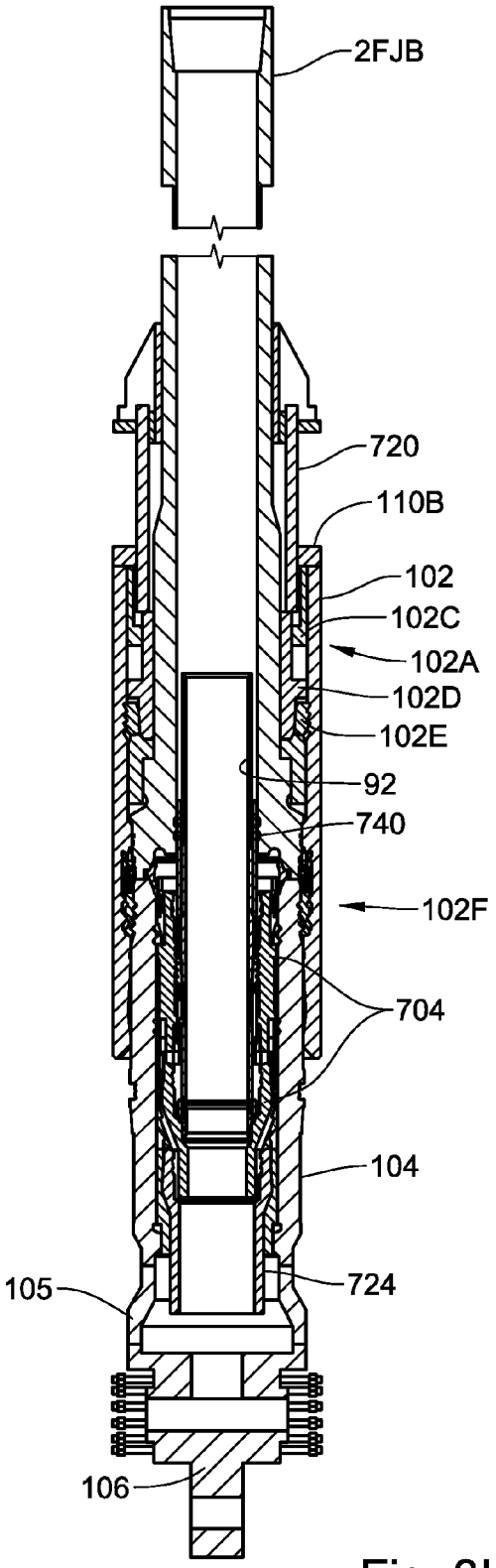
Figure 3J:
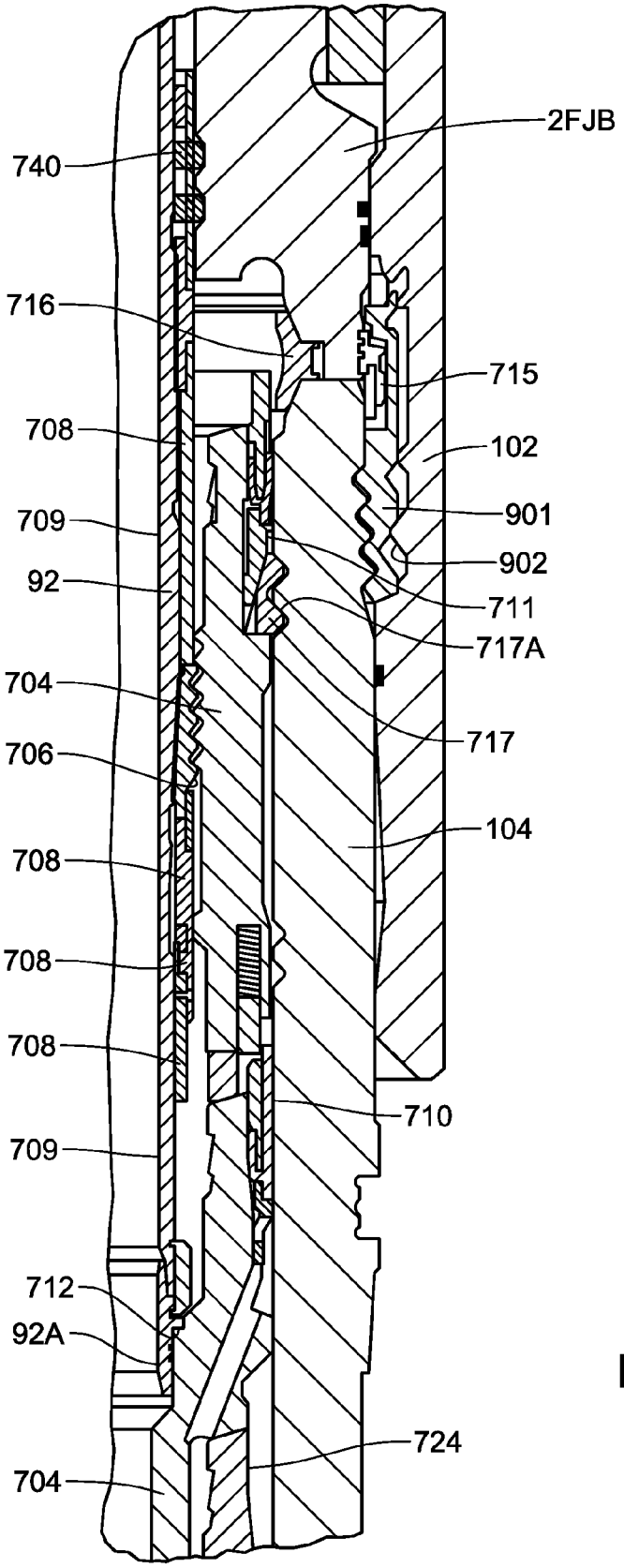

Further details of this embodiment of an LRA are illustrated in FIGS. 3I and 3J, which illustrate use of two locking hangers 704, 724. In addition to previously detailed features, FIGS. 3H and 3I illustrate a plurality of connector lock indicator rods 720 that may travel up and down and show whether external tieback connector 102 is open or fully locked. Also illustrated is one of two secondary mechanical lockdown plates 702 (the other being hidden in FIG. 3H), as well as tubing 110A for flow of hydraulic fluid via hot stabs 110. Hot stabs and tubing 110A, which passes through end cap 110B (or through other exterior ports in connector 102) are parts of an upper active locking system 102A for external tieback connector 102. A lower passive locking system 102F may also be included in this embodiment. An example of mechanical details and operation of upper active locking system 102A and lower passive locking system 102F are provided in U.S. Pat. No. 6,540,024. Briefly, upper active locking system 102A comprises an inner sleeve 102C, a hydraulically, axially movable piston 102D, and an upper locking element 102E, which may be a split ring, collet, or plurality of dogs circumferentially disposed within a chamber formed between an inner surface of outer tieback connector 102 and a lower portion of piston 102D.

Some details of a lower passive locking system 102F of external tieback connector 102, as well as some details of inner tieback connector 92, are illustrated schematically in cross-section in FIG. 3J. Lockdown hangers 704 and 724 are provided, hanger 704 providing about 2 million $lb_f$ (about 0.9 million $Kg_f$) of lockdown capacity in this embodiment.

FIG. 3J further illustrates an internal tieback connector outer body or sleeve 708, and an inner body or mandrel 709. A set of lock down dogs 717 is provided to lock lockdown casing hanger 704 to subsea wellhead housing 104. Another set of locking dogs 901 may be provided for locking external tieback connector 102 to subsea wellhead housing 104. A lower set of locking dogs 706 lock sleeve 708 of internal tieback connector 92 to lockdown casing hanger 704, and thus also locking to subsea wellhead housing 104. A similar set of upper locking dogs 740 lock internal tieback connector 92 to stress joint 2FJB and thus to external tieback connector 102. The lower and upper sets of dogs may provide a secondary lock of the riser to subsea wellhead 104 and may maintain pressure integrity with the nose seal 92A fully engaged should external tieback connector 102 become unlocked from subsea wellhead 104 for whatever reason.

Also illustrated are packoff assemblies 710, 711, and 715, and a landing surface 712 on an internal portion of casing hanger 704 for landing internal tieback connector nose seal 92A. Packoff 711 may include a wedge 711A which may force dogs 717 into a set of internal mating grooves 717A of wellhead housing 104. Dogs 901 may be positioned within a grooved window 902 in external tieback connector 102. FIG. 3J further illustrates a wellhead gasket 716. As will be understood by those of skill in the art, one or more of the dogs described herein maybe replaced by a split ring, collet or other functional equivalent.

Internal tieback connector 92 may have a nose seal 92A, which may be Inconel, and which may seal into landing surface 712 of casing hanger 103. Internal tieback connector 92 may latch with dogs 706 both to lockdown hanger 704 and to stress joint 2FJB in order to create a preloaded structural connection between subsea wellhead 104 and internal and external tieback connectors 102 and 92 (in addition to the external active connector latch to the wellhead—so there may be multiple redundancy). Nose seal 92A may provide pressure integrity between the internal flow path 64 and annulus 76 between the inner and outer risers 60, 70. Hence, as illustrated in FIG. 3F, oil and gas to be contained coming up through subsea flexible jumper 14 through a passage defined by inner surface 113 of flexible 14, enters the wing valve assembly through passages 107B and 116C, and flows through elbow block 109B and forging 106. With nose seal 92A engaged, the produced fluids flow up through inner riser 60 through passage 64 and to the URA, and ultimately through flexible conduit 12 to containment vessel 32.

Another embodiment of a lower riser assembly is provided schematically in FIGS. 4A-4G. In this embodiment, a substantially cylindrical member 220 may be provided, which may be a forged high-strength steel member. Member 220 may be fluidly connected to a production riser pup joint 221 via a lower cross-over joint 222 and threaded connector 242. A pad eye flange 223 may allow connection of member 220 to a pile assembly on the seabed. Dual clamp supports 224A and 224B may support subsea connectors 225A and 225B, respectively. Two production wing valves assemblies 226A and 226B may be provided, and each may be fluidly connected to member 220 through respective block elbows 230A and 230B. Each assembly 226A and 226B may include an ROV-operable valve 227A and 227B, respectively.

An additional assembly or sub 228 may be provided, fluidly connecting to member 220 through a block elbow 229. Assembly or sub 228 may provide a fluid connection to a source of a functional fluid, such as a flow assurance fluid or other fluid. In this embodiment, block elbow 229 may be smaller than block elbows 230A and 230B, but this is not necessarily so. A hot stab assembly 231 may be provided for injection of a functional fluid. In this embodiment, hot stab assembly 231 may provide for a smaller flow rate of functional fluid than is possible through assembly 228, but once again this is not necessarily so in all embodiments. A small diameter conduit 241 (FIG. 4G) may allow delivery of the functional fluid.

Figure 4A:
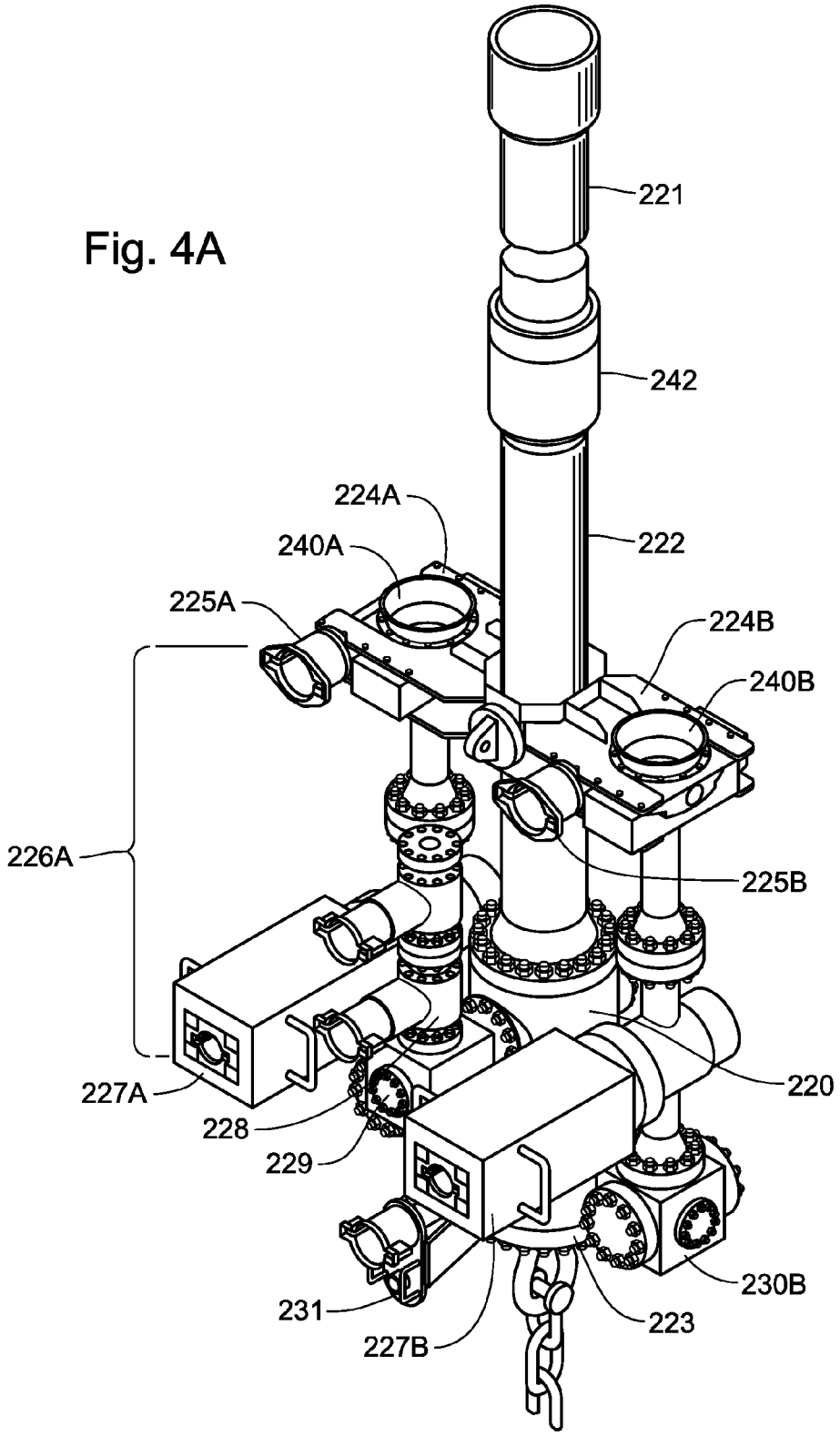
FIGS. 4A and 4B illustrate schematic perspective views of another lower riser assembly in accordance with the present disclosure.
Figure 4B:
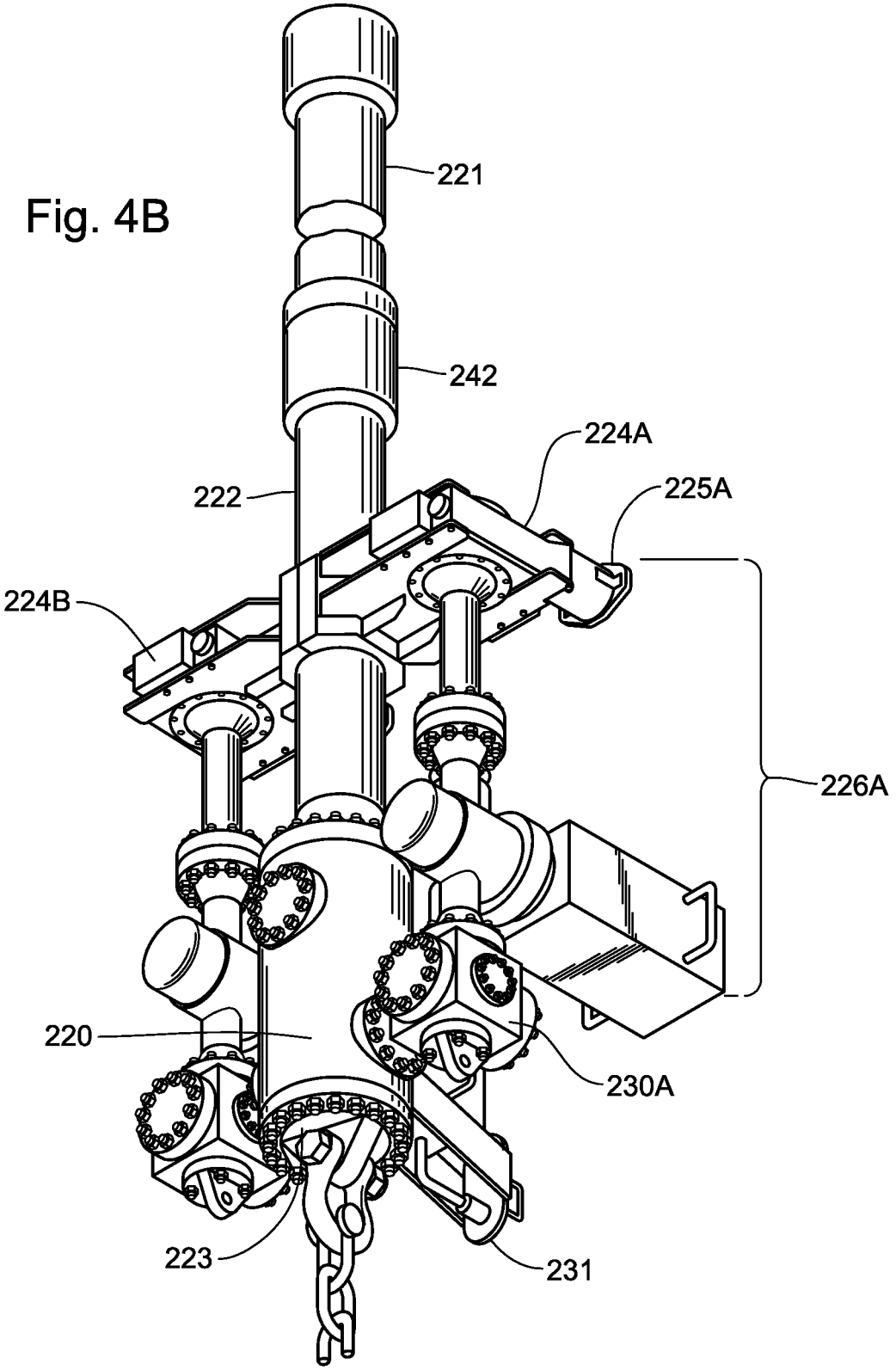
Figure 4C:
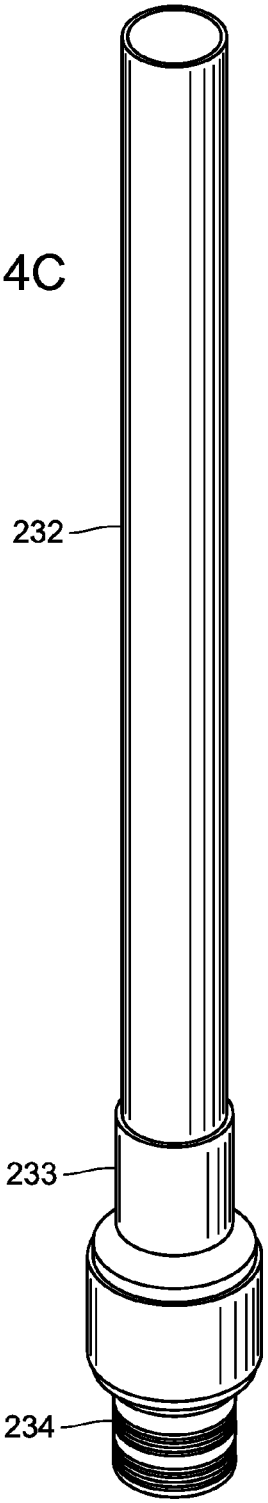
FIG. 4C is a schematic perspective view of an internal component useful with the lower riser assembly illustrated in FIGS. 4A and 4B.

FIG. 4C illustrates a perspective view of a production tubing or casing 232 that connects to an internal surface of member 220. Production tubing 232 may include a tieback ring 233 and a seal element 234, which may be an S-type seal element. Seal element 234 may be comprised of Inconel or other corrosion-resistant metal. As further illustrated schematically in FIGS. 4D and 4E, tieback ring 233 may include at least one set of internal threads 235 which mate with a set of threads on production tubing 232. Tieback ring 233 may also include at least one set of external threads 236 that mate with threads on an internal surface of member 220.

Figure 4E:
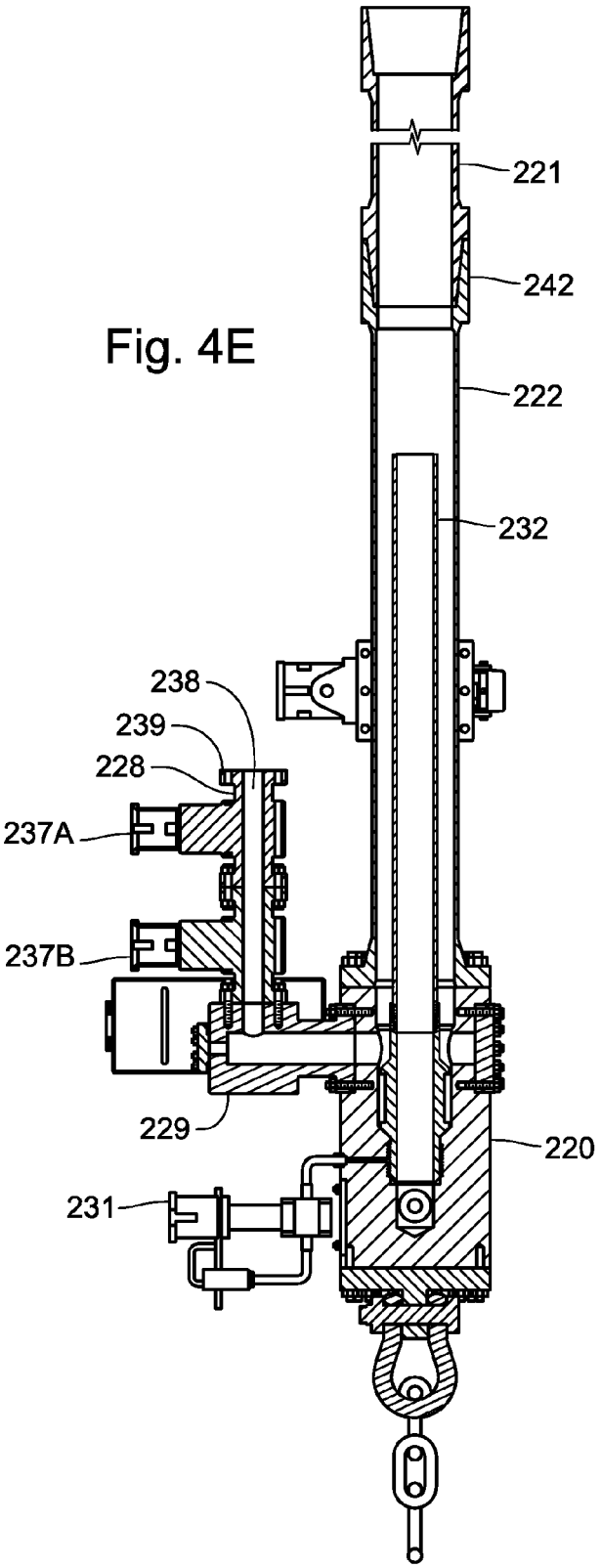
FIGS. 4D and 4E are cross-sectional views.
Figure 4D:
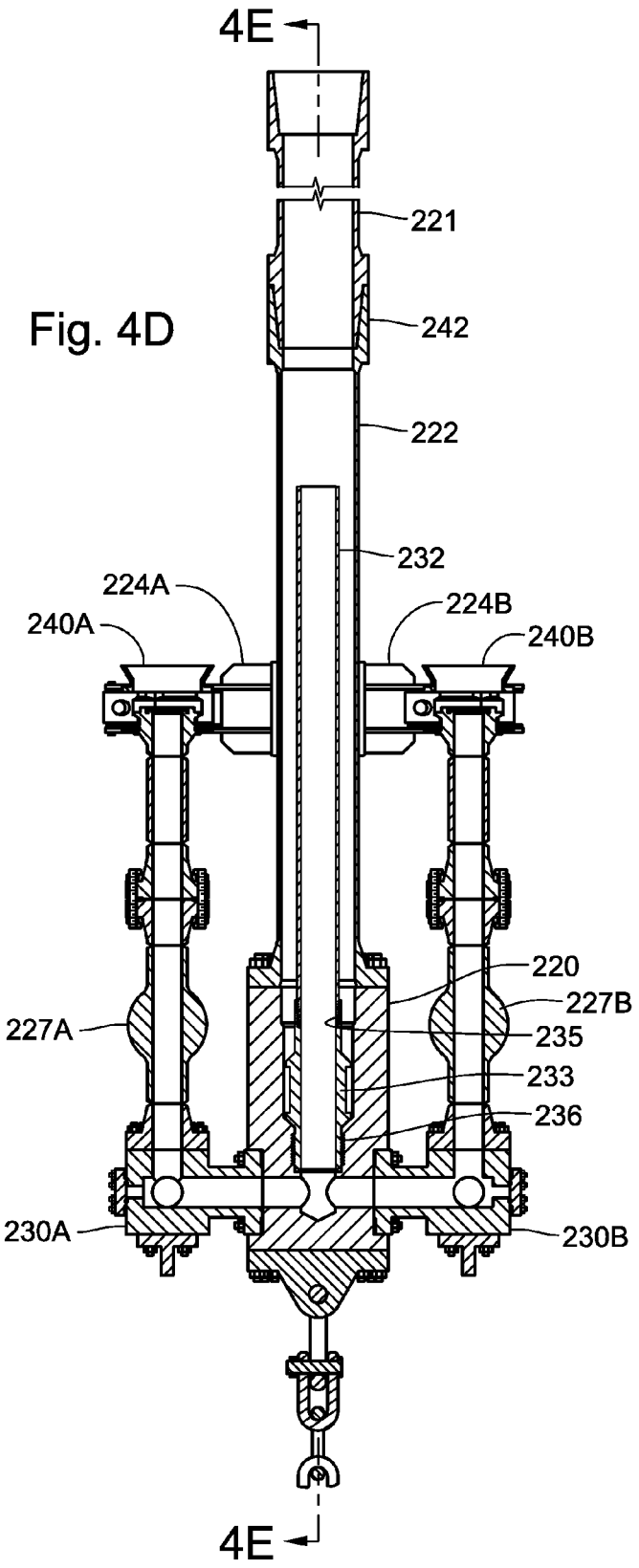
Figure 4F:
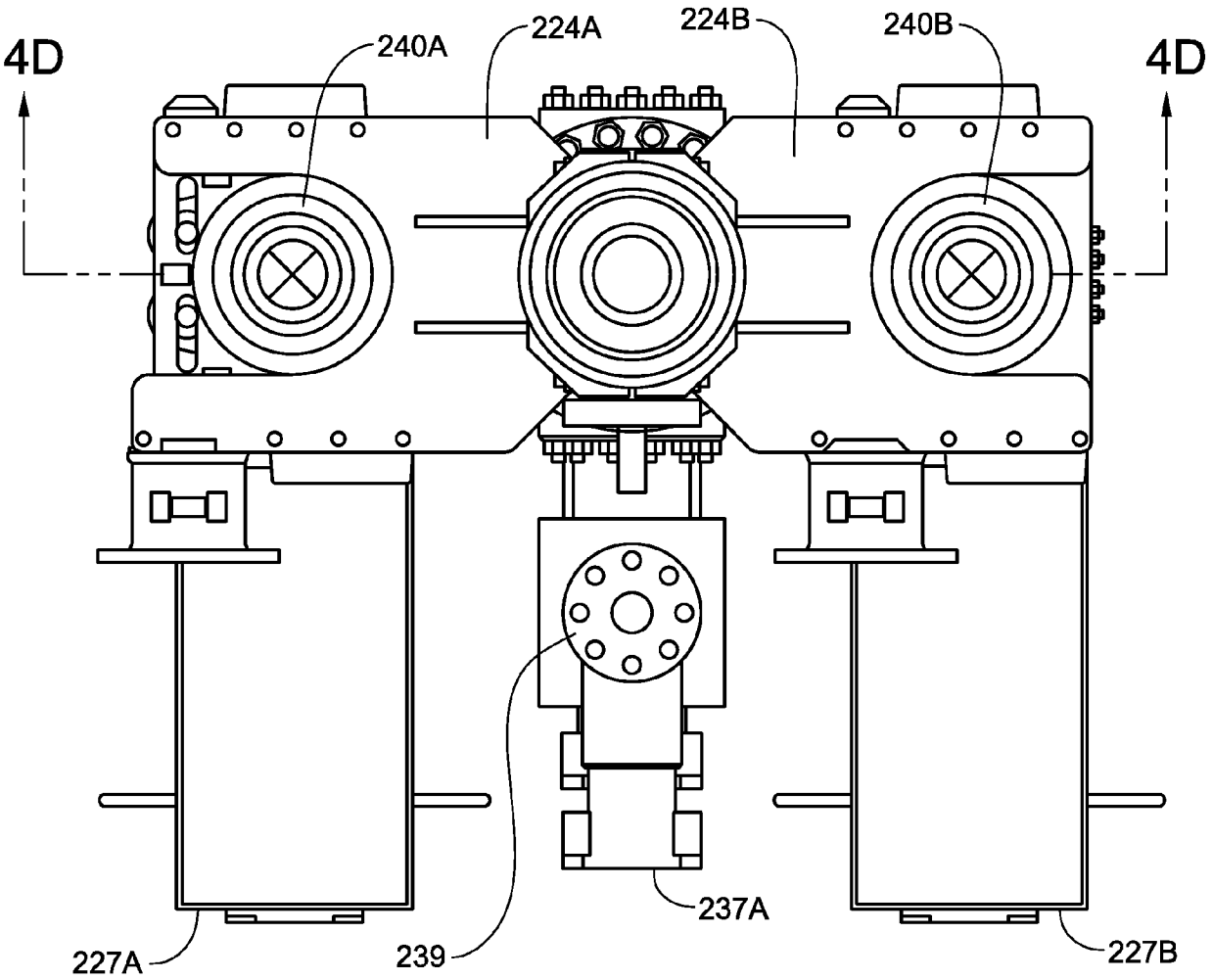
FIG. 4F is a plan view of the lower riser assembly illustrated in FIGS. 4A and 4B.
Figure 4G:
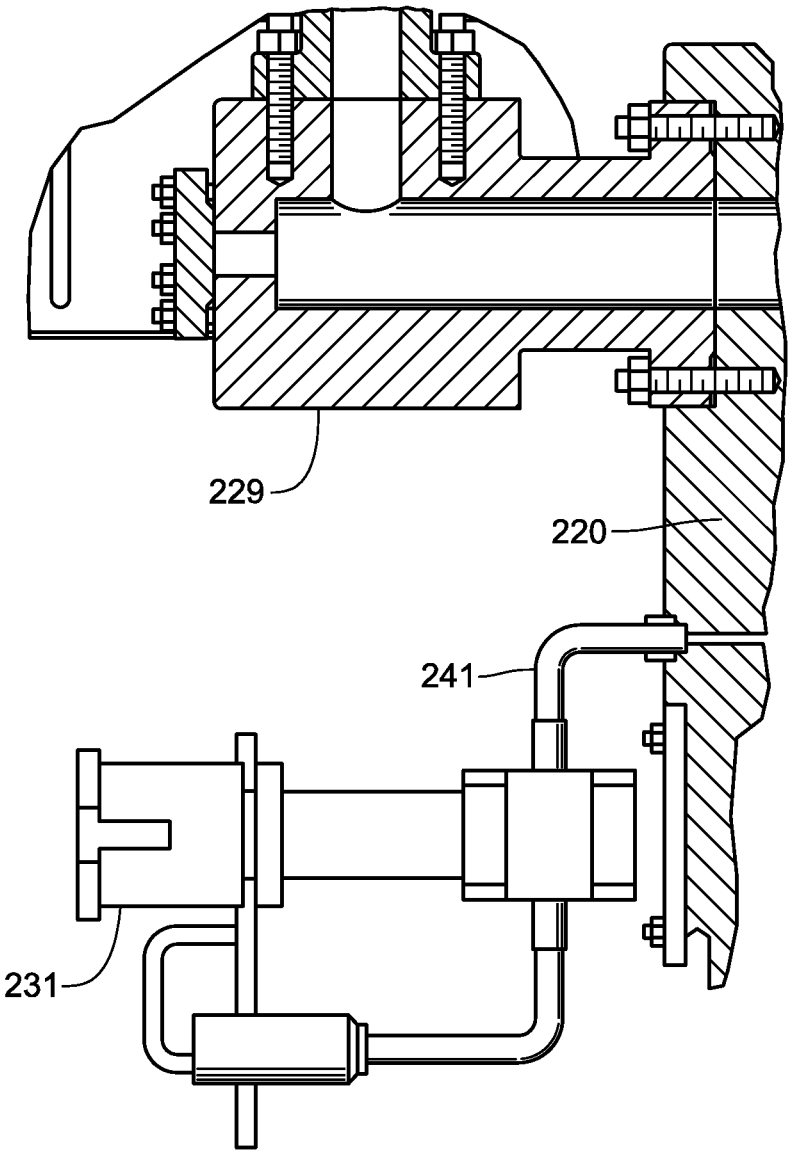
FIG. 4G is a detailed schematic view of a portion of the lower riser assembly illustrated in FIG. 4E.

FIG. 4E illustrates dual inline ROV-operable valves 237A and 237B for functional fluid injection (or circulation out) included in annulus vent sub 228, which may include a bore 238 providing access to an annulus between production tubing 232 and member 220 and lower cross-over joint 222. A flange connection 239 or other connection may be provided for this purpose. Each production wing valve assembly 226 may include a connector 240 (240A and B) which may allow connection to subsea flexible conduits, as illustrated in the plan view of FIG. 4G. Connectors 240A and 240B may be connectors known under the trade designation OPTIMA, available from Vector Subsea, Inc.

Figure 8A:
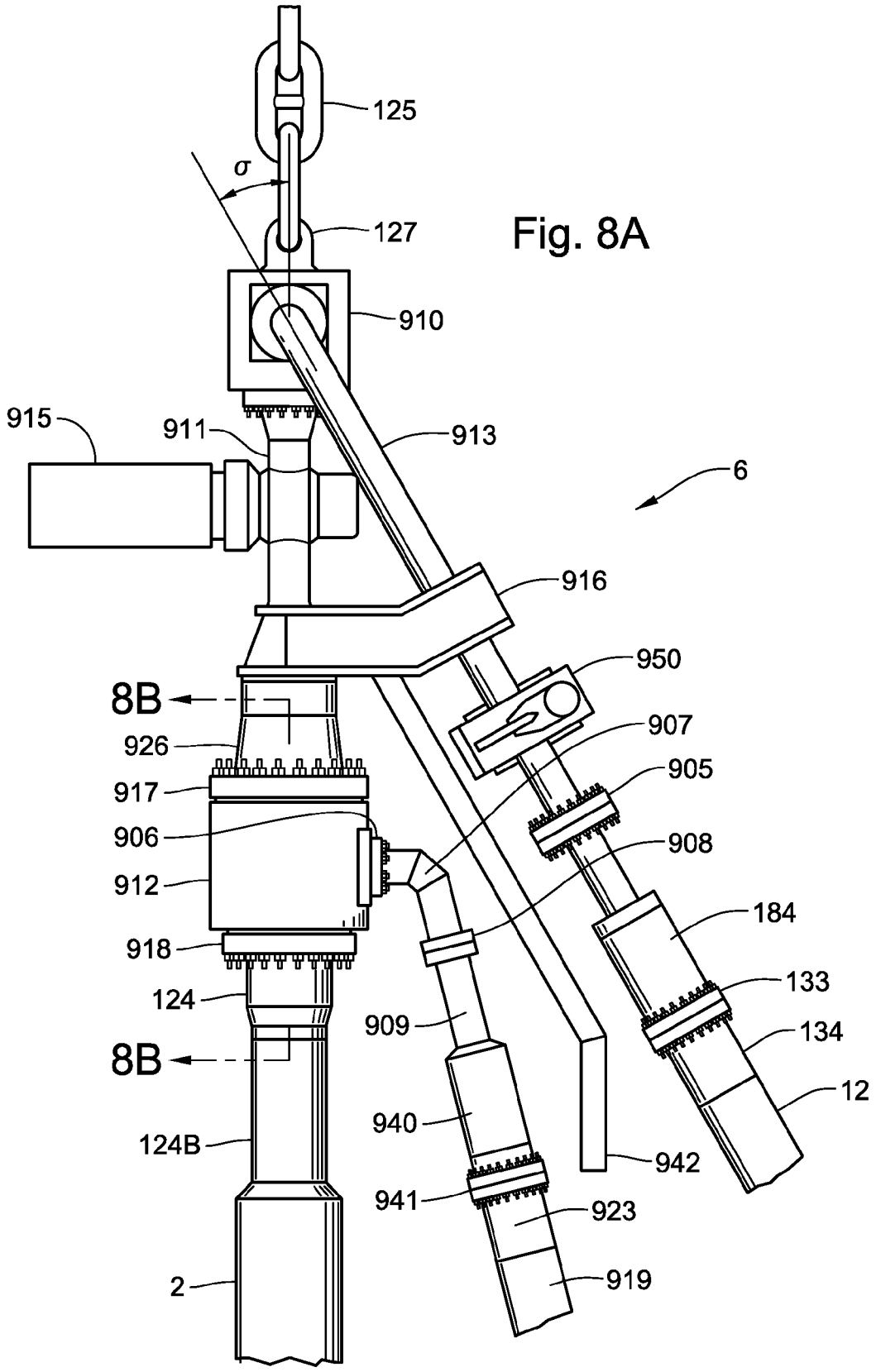
FIG. 8A is a schematic side elevation view of another URA embodiment, with FIG. 8B a schematic detailed cross-sectional view of a portion of this embodiment.
Figure 8D:
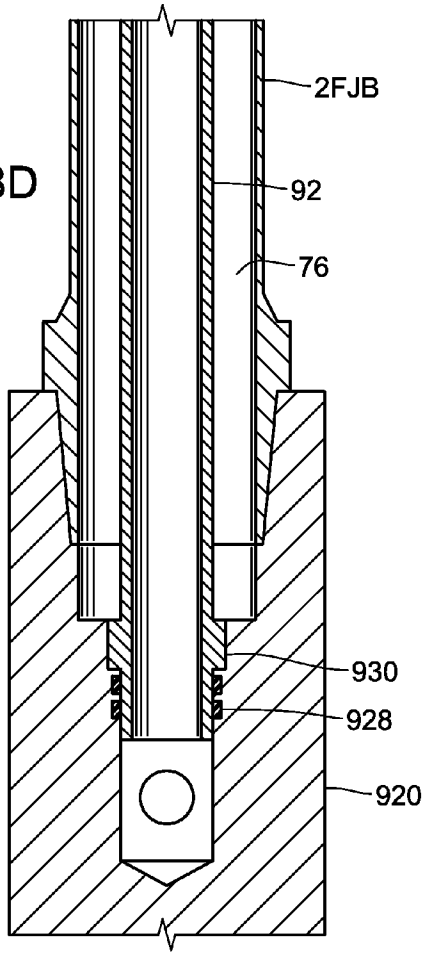
FIG. 8D is a cross-sectional view of a portion of this embodiment.
Figure 8B:
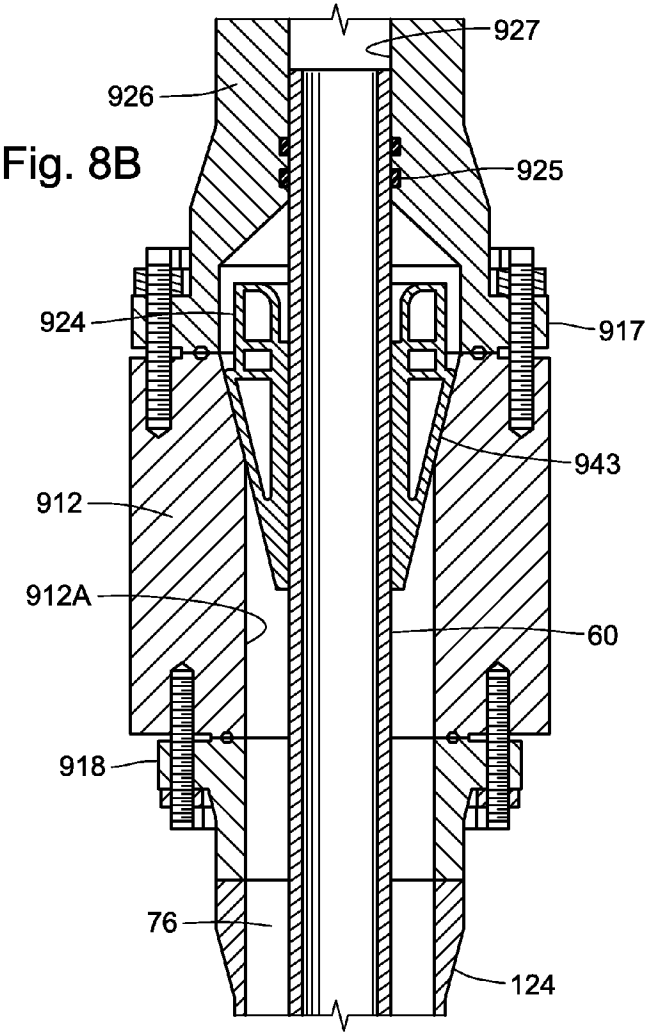
FIG. 8C is a schematic side elevation view of another LRA embodiment in accordance with the present disclosure.
Figure 8C:
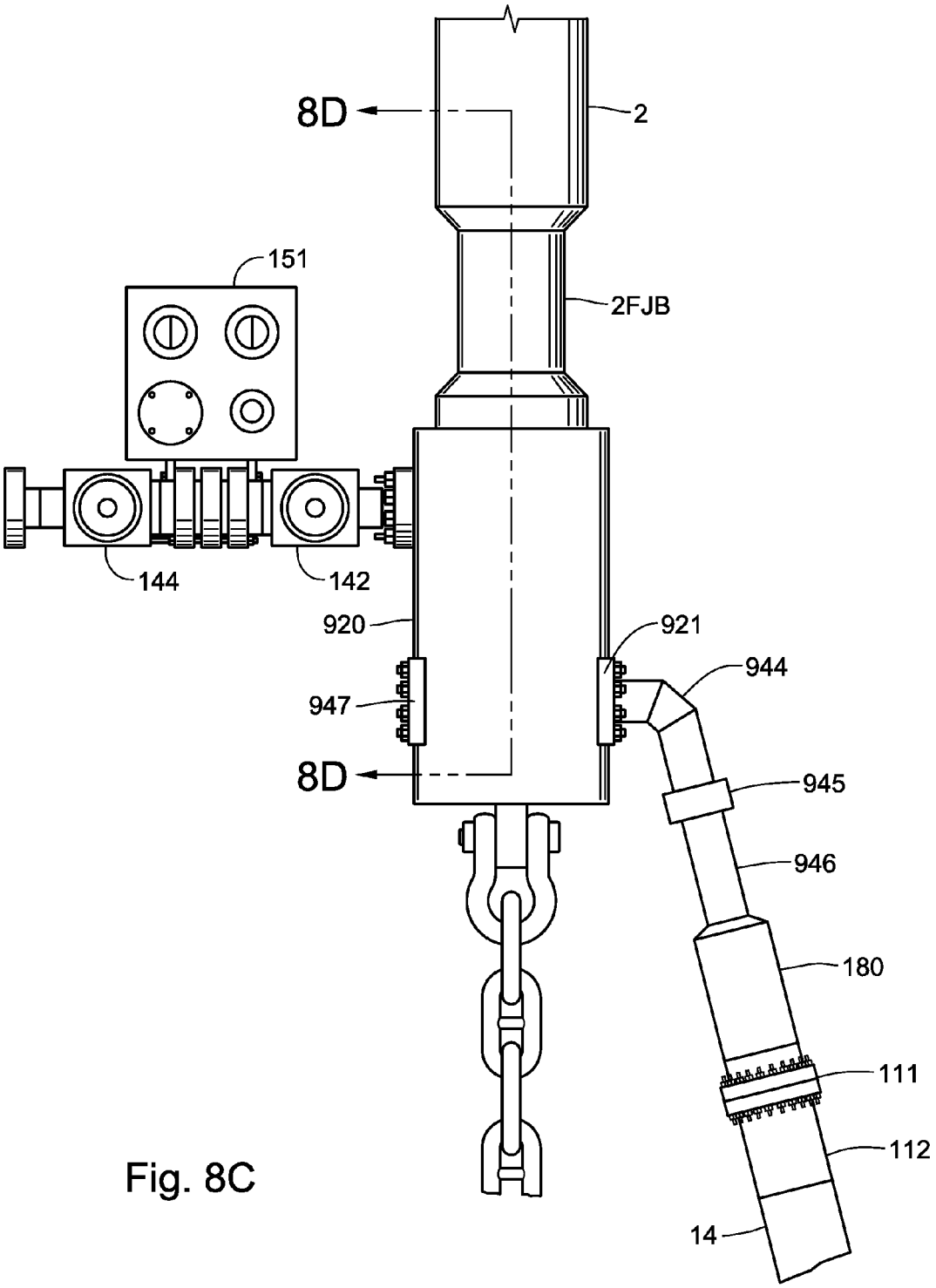

FIG. 8C is a side elevation view of another LRA assembly in accordance with the present disclosure. This LRA embodiment may include a forged, high-strength steel intake spool 920, a connector 921 and gooseneck 944, subsea API flange 945, tubing spool 946, high-pressure subsea connector 180, another subsea API flange 111, bend restrictor 112, and subsea flexible conduit 14 which may connect to a subsea source of hydrocarbons (not illustrated). Another connector 947 on intake spool 920 may allow connection to a source of functional fluid.

FIG. 8D illustrates, in cross-section denoted 8D-8D in FIG. 8C, details of this embodiment of LRA, illustrating an internal tieback connector 92 landed in an internal surface of intake spool 920. A latching mechanism 930 allows internal tieback connector 92 to releasably connect to intake spool, while an O-ring seal 928 may provide a fluid-tight seal between the bore of internal tieback connector 92 and annulus 76. Flex joint 2FJB may be connected to intake spool in known fashion, for example by split rings, collets, or dogs as described herein for other embodiments.

Upper Riser Assembly (URA)

Figure 5:
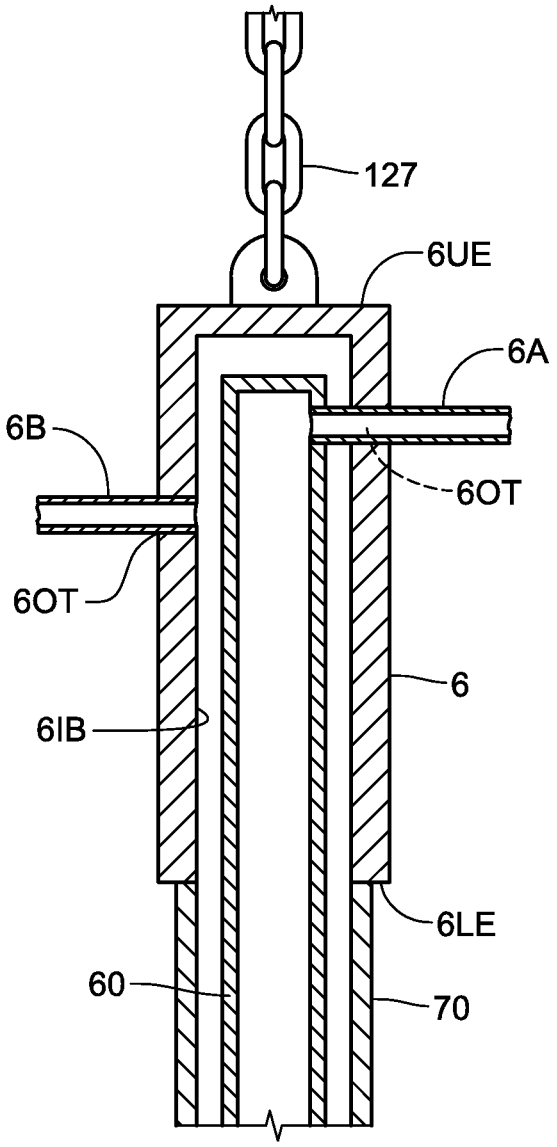
FIG. 5 is a schematic side-elevation view, with portions cut away, of a general embodiment of an upper riser assembly in accordance with the present disclosure.

FIG. 5 is a schematic side-elevation view, with portions cut away, of a general embodiment of an upper riser assembly 6 in accordance with the present disclosure. Upper riser assembly (URA) 6 may be a generally cylindrical member including an upper end 6UE and a lower end 6LE, and may define an inner bore indicated generally at 61B. URA 6 may share a common bore with riser 70 and may share more than one common bore therewith. Conduits 6A and 6B may fluidly connect to URA through offtake ports 60T, conduit 6A being fluidly connected to the bore of inner riser 60 while conduit 6B fluidly connects with an annular space created by inner bore 61B and inner riser 60 which connects to an internal surface of URA 6 in a manner not illustrated. URA upper end 6UE may be connectable to a near-surface buoyancy device (not illustrated) through a chain tether or other connector 127.

FIGS. 6A-6G include various views, some in cross-section, of another embodiment of an upper riser assembly in accordance with the present disclosure. FIG. 6H is a schematic perspective view, and FIGS. 6I and 6J are cross-sectional views, of a portion of the upper riser assembly embodiment of FIGS. 6A-6G; FIG. 6K is a perspective view of a seal test port. URA 6 in this embodiment includes a tubing head 122, which may serve as a fluid and mechanical connection between a casing head and stem joint 124 (such as available form GE Oil & Gas, Houston, Tex.) and a drilling adapter spool 120. Drilling adapter spool 120 and tubing head 122 may be mechanically connected together using a plurality of lockdown assemblies 120A, while tubing head 122 and casing head 124 may also be mechanically connected using a second plurality of lockdown assemblies 122B.

Lockdown assemblies 120A and 122B may be the same or different, and may be lockdown screw assemblies or other locking assemblies known in the art. One non-limiting example of a lockdown screw assembly is provided in U.S. Pat. No. 4,606,557.

Also included in embodiment may be a shackle adapter flange 126, pad eye end forging 128, and U-link 125 that may provide a connection for tether chain 127. All of these individual items (except the shackle flange) are available from GE Oil & Gas. For the purposes of the present disclosure, tubing head 122 may be machined with a 5-⅛" (13 cm) 10K American Petroleum Institute (API) flange connection, and production wing valve assembly 136 may be attached with one hydraulically actuated 5-inch (13 cm) 10,000 psi (70 MPa) emergency shutdown valve, 137B, and one ROV-operated 10,000 psi (70 MPa) emergency shutdown valve, 131. A pressure and temperature monitoring ROV hot stab port panel 139 may be provided, as well as a nitrogen (or other fluid) injection port and ROV panel 152 for the riser annulus, and tubing 158 for nitrogen or other gas atmosphere injection into the annulus, as well as pressure, temperature and bleed ports (through ROV access panel 153) between the valves on the production flow path, as well as a burst disc ROV panel 156.

One or more ROV hot stab ports and pressure gauges in between the two ESD valves on the URA may be provided in order to circulate functional fluid back through flexible conduit 12 to the surface structure and to bleed pressure from the line if necessary (while keeping the first valve closed). An umbilical mounting bracket 155 may be supplied. A series of outtake ports 130 may be provided in tubing head 122 (see FIG. 6C), as well as a plurality of intervention ports 135. A flange connection 133 may connect a high pressure subsea connector 184 to a bend restrictor 134. In certain embodiments a kick-off spool 138 and bend restrictor adapter 157 may be provided. A lifting eye 129A may be provided for lifting the production wing valve assembly 136, but not when subsea flexible conduit 12 is attached.

Figure 6D:
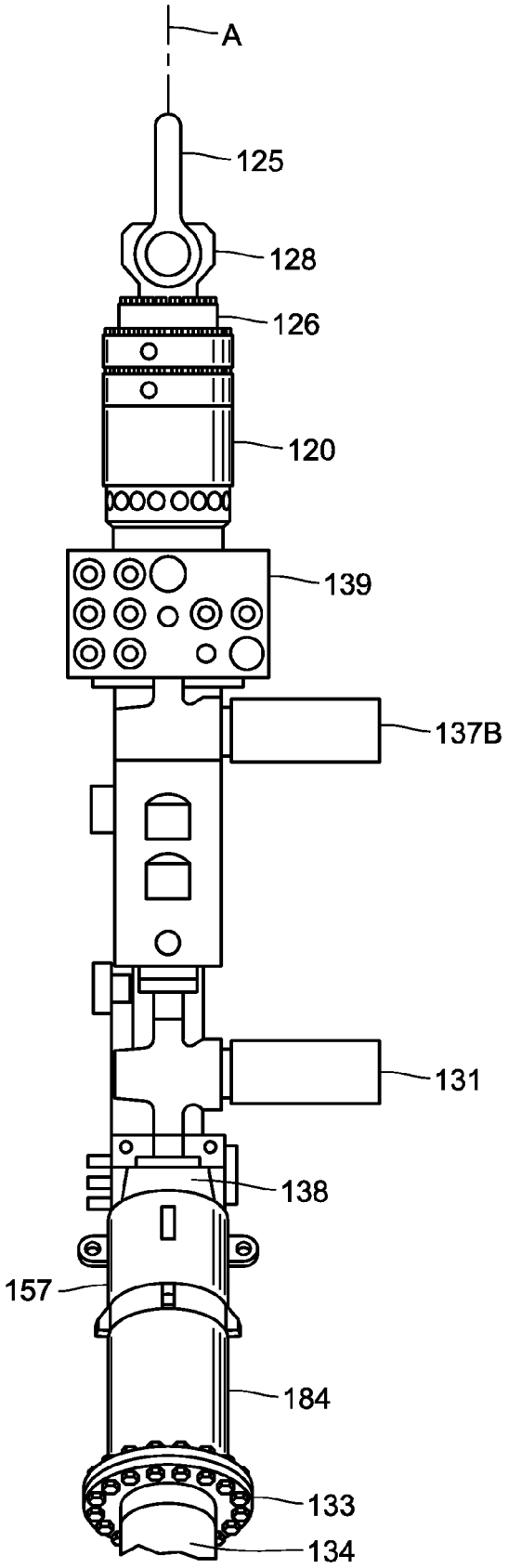
Figure 6E:
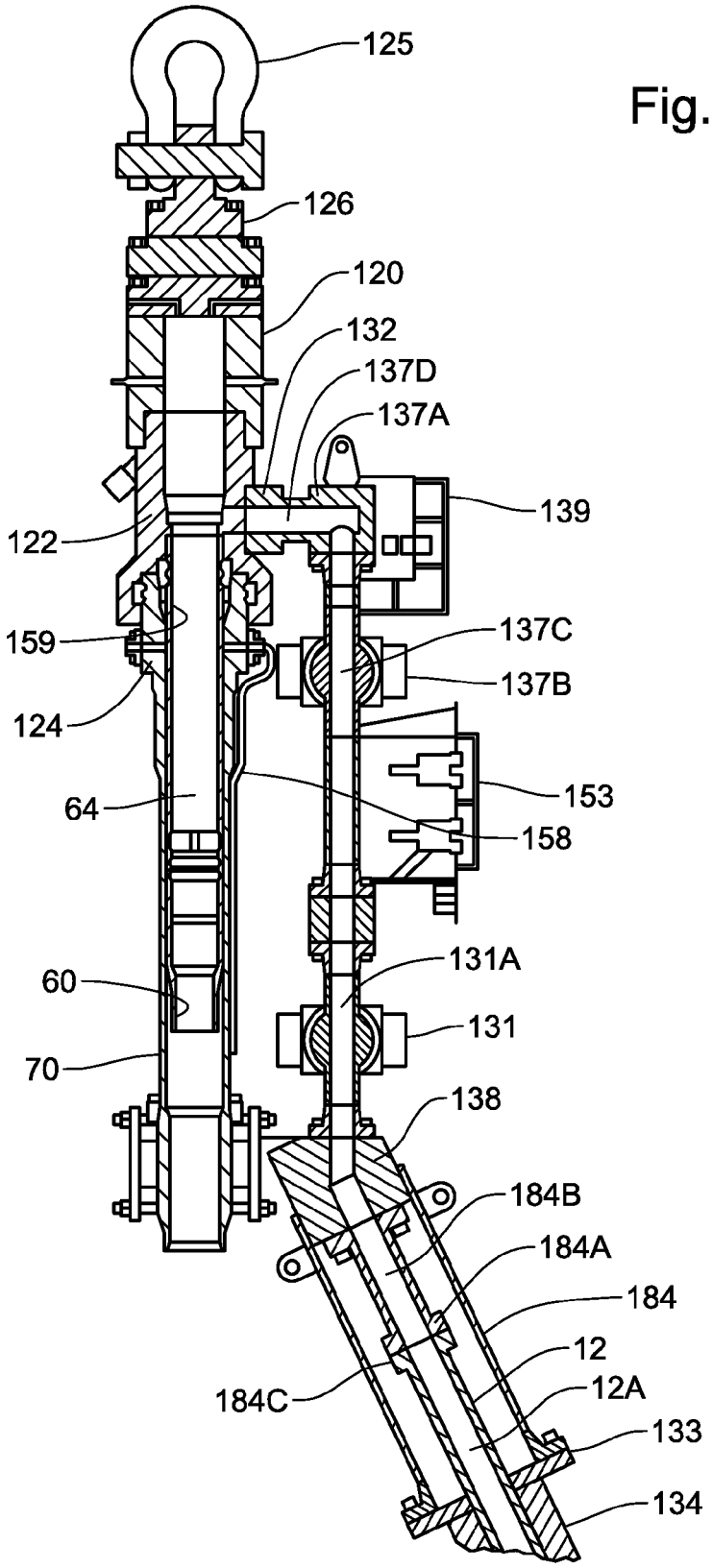

FIG. 6D is a side elevation view of URA 6, and FIG. 6E is a cross-sectional view through section A-A of FIG. 6D. As illustrated in FIG. 6E, a URA adjustable hanger 159 is provided in this embodiment. Also indicated is the containment fluid flow path, first upward through bore 64, then laterally through passage 137D in block elbow 137A and connection 132, then downward through a passage 137C in valve 137B and passage 131A in valve 131, and finally out URA through flow path 184B in subsea connector 184A, which may be connected to flexible conduit 12 through flange 184C, and flow path 12A through flexible conduit 12 to containment vessel 32 at the sea surface.

Figure 6F:
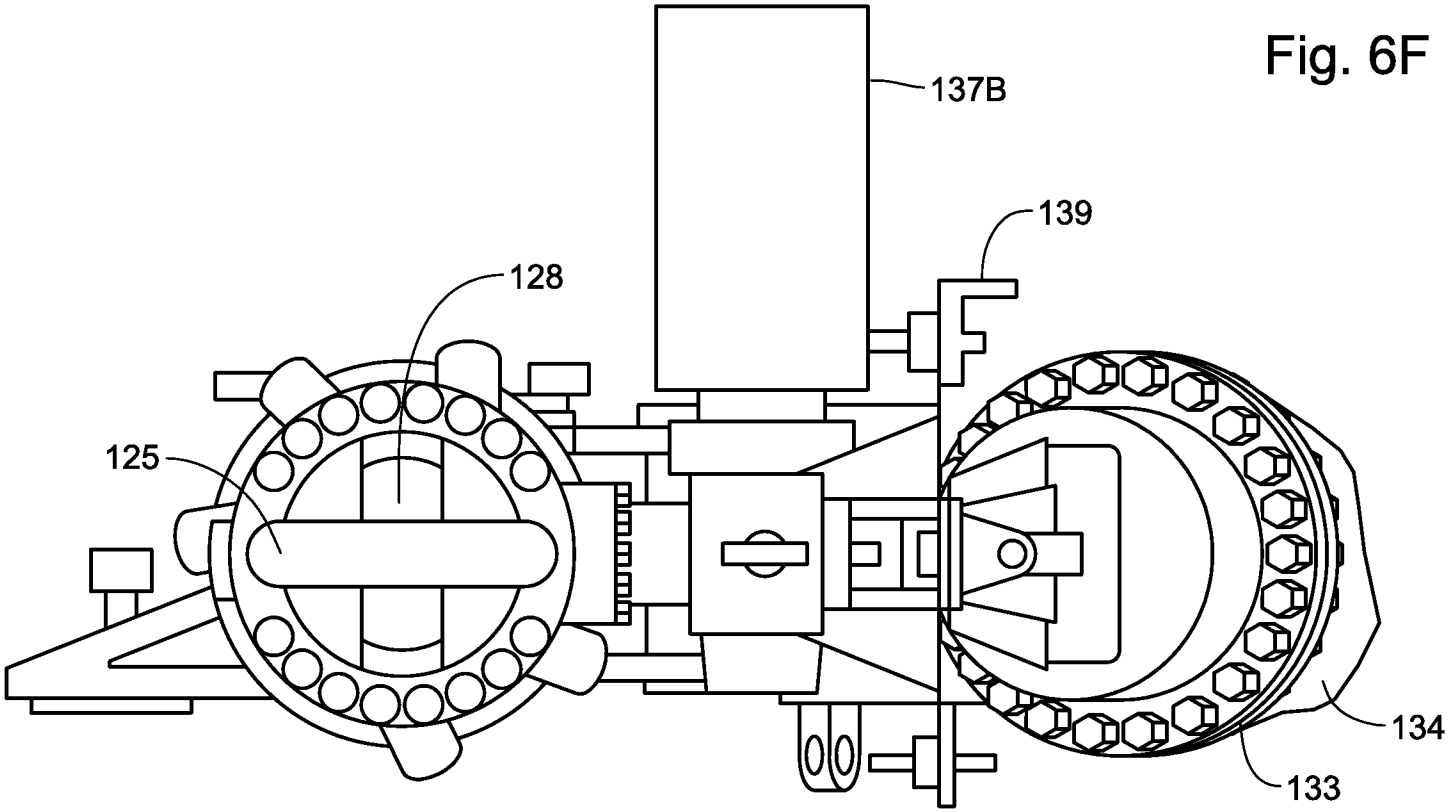

FIG. 6F is a plan view of URA 6, illustrating in more detail some of the previously mentioned features.

Figure 6G:
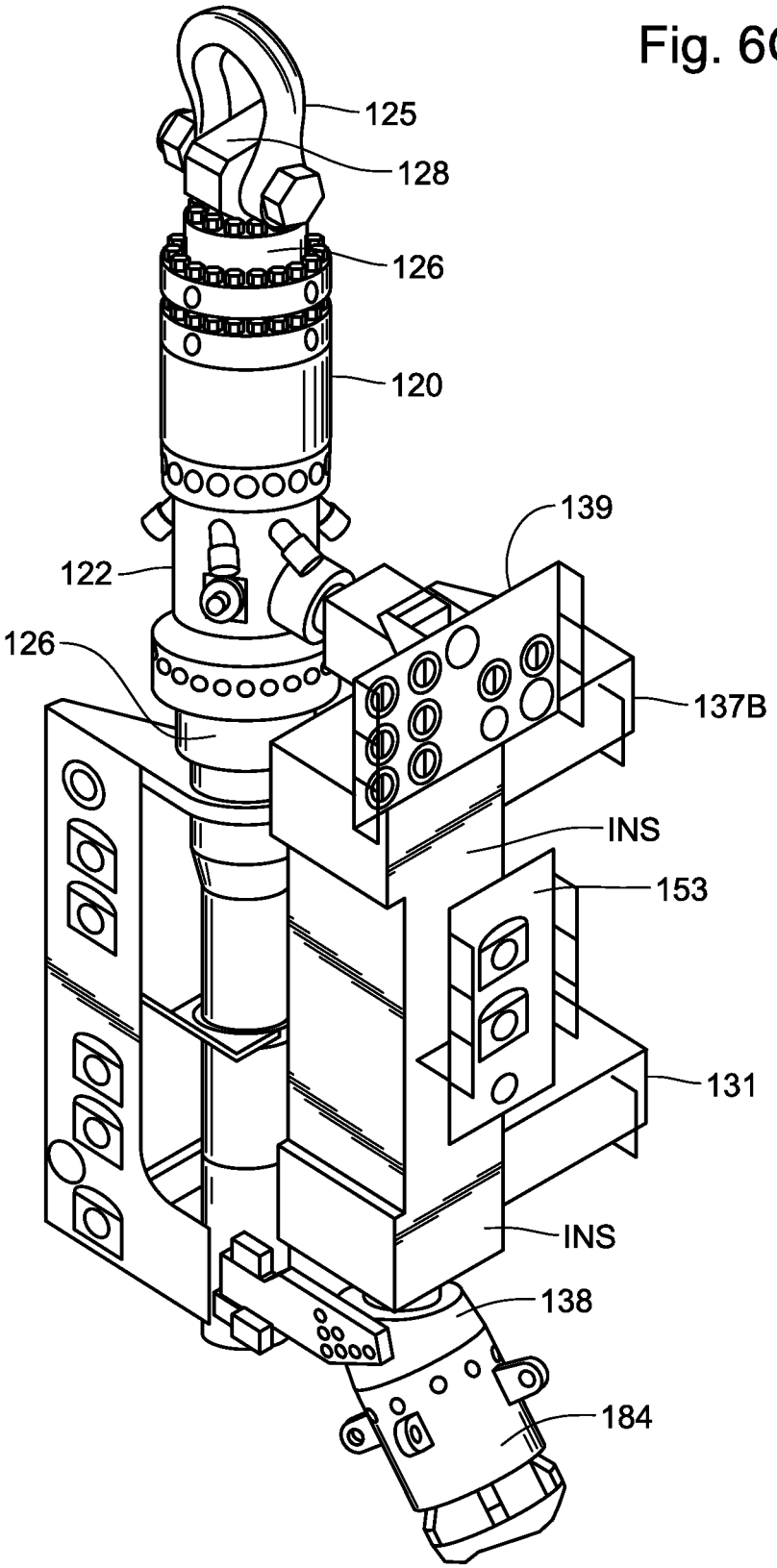
Figure 6H:
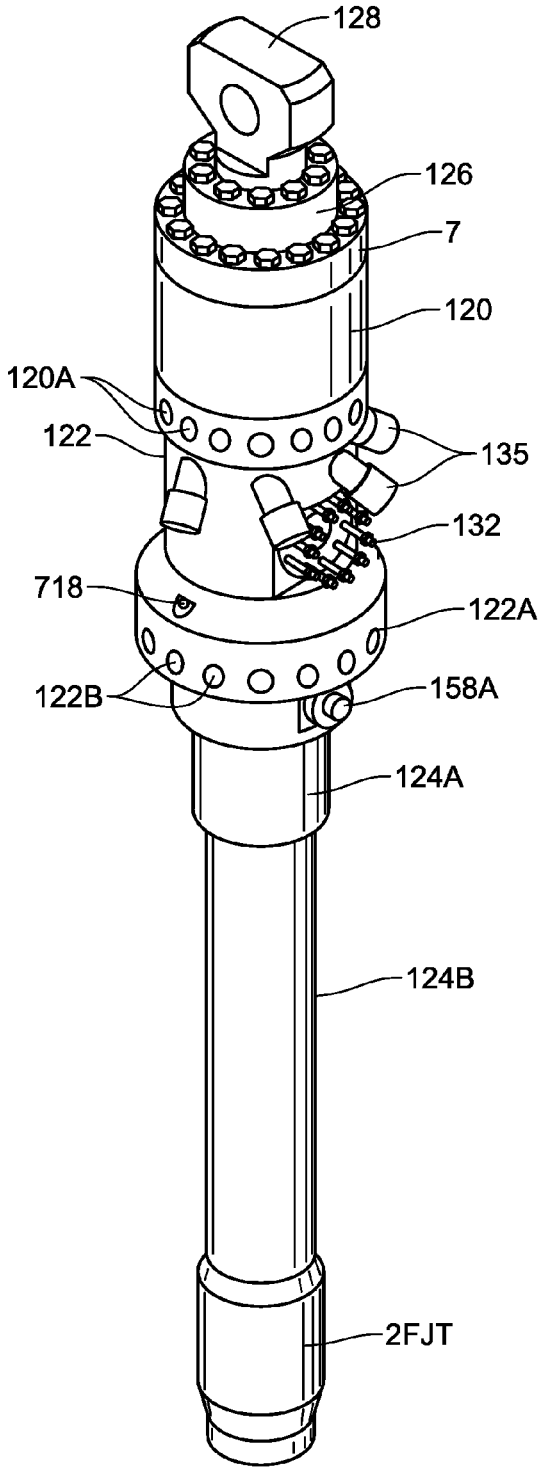
FIG. 6H is a schematic perspective view.
Figure 6I:
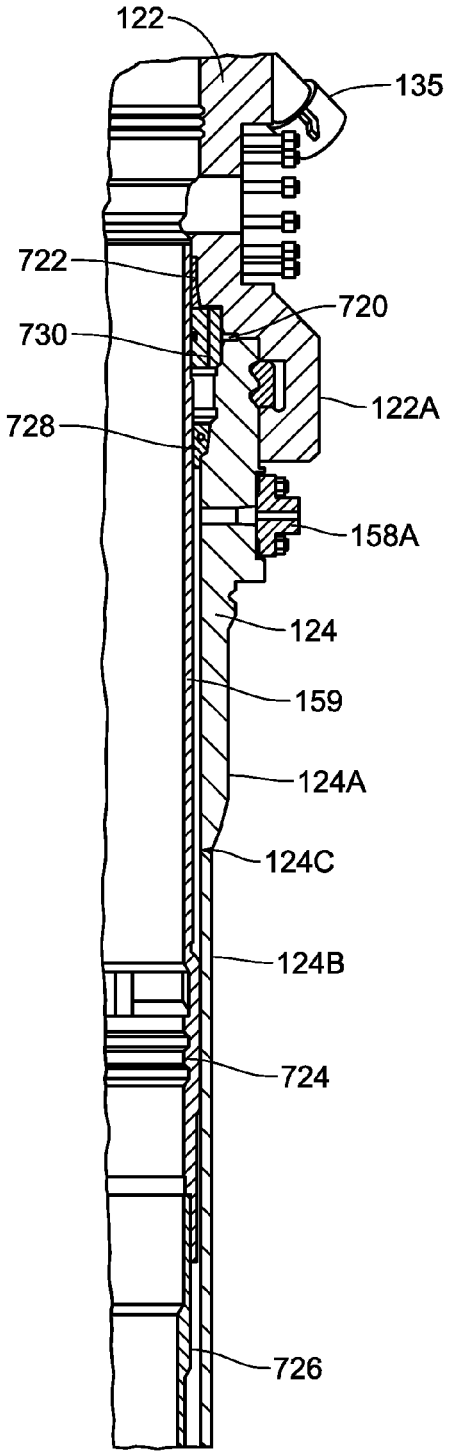
FIGS. 6I and 6J are cross-sectional views, of a portion a of the upper riser assembly embodiment of FIG. 6.
Figure 6J:
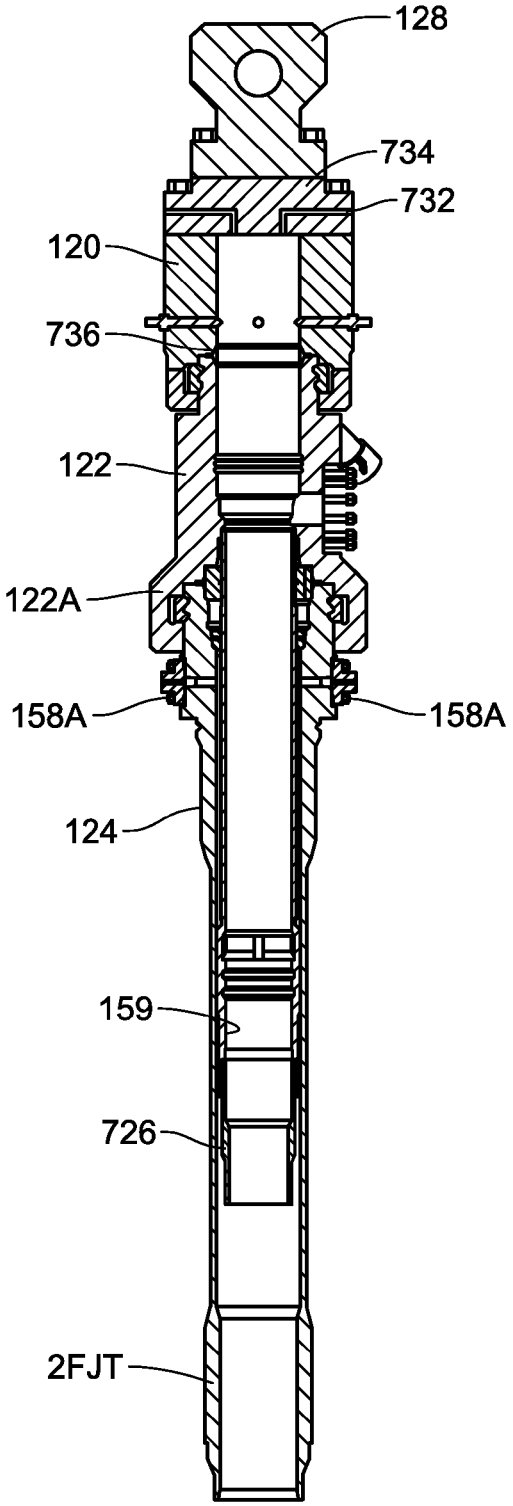
Figure 6K:
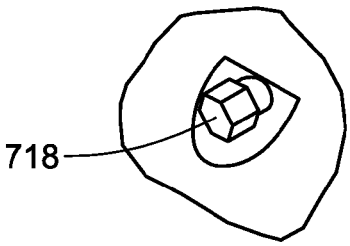
FIG. 6K is a perspective view of a seal test port.

FIG. 6G is a schematic perspective view of the URA 6, illustrating the optional placement of insulation material, INS, around valves 137B and 131, as well as associated piping. Insulation INS may be the same or different from that used as wet insulation 80 illustrated in FIG. 1B.

Further details of this embodiment of an URA are illustrated in FIGS. 6H-6K. A nitrogen injection port 158A is illustrated, as well as a lower portion 122A of tubing head 122, the lower portion including a seal test port 718. Further illustrated is a seal ring 720 between tubing head 122 and casing head 124; a metal-to-metal seal 722; a torque tool profile 724, a crossover connection 726, and a hanger support load ring 728, as well as a packoff 730. FIG. 6J further illustrates a URA forging 734 having ports 732 therein suitable for pressure and temperature gauges. Finally, a seal ring 736 is illustrated positioned between drilling adapter spool 120 and tubing head 122. FIGS. 6H and 6I illustrate casing head and stem joint 124 comprise a casing head lower portion 124A and a stem joint 124B welded at 124C to casing head lower portion 124A.

Figure 7A:
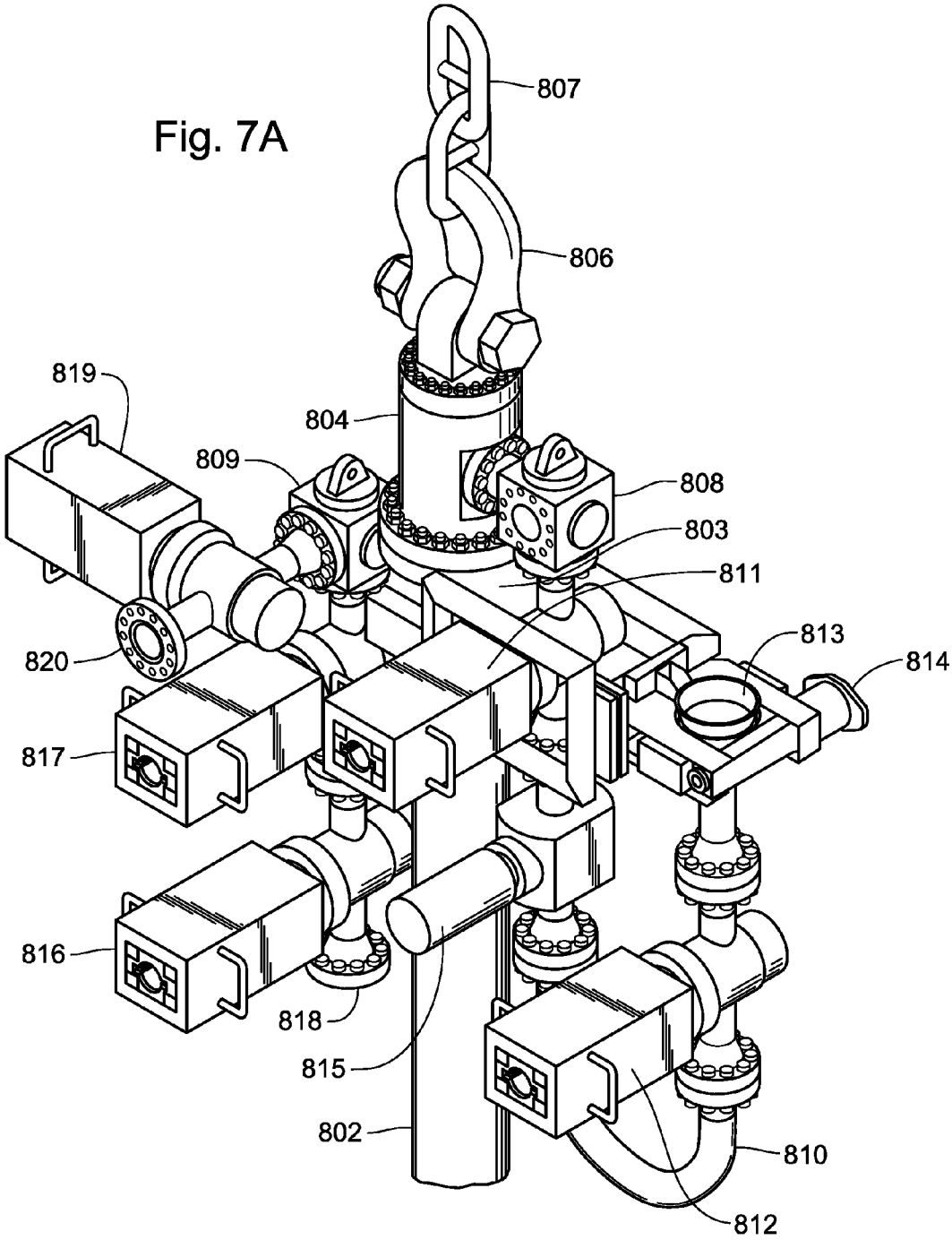
FIGS. 7A and 7B are front and rear schematic perspective views of another upper riser assembly embodiment in accordance with the present disclosure.
Figure 7B:
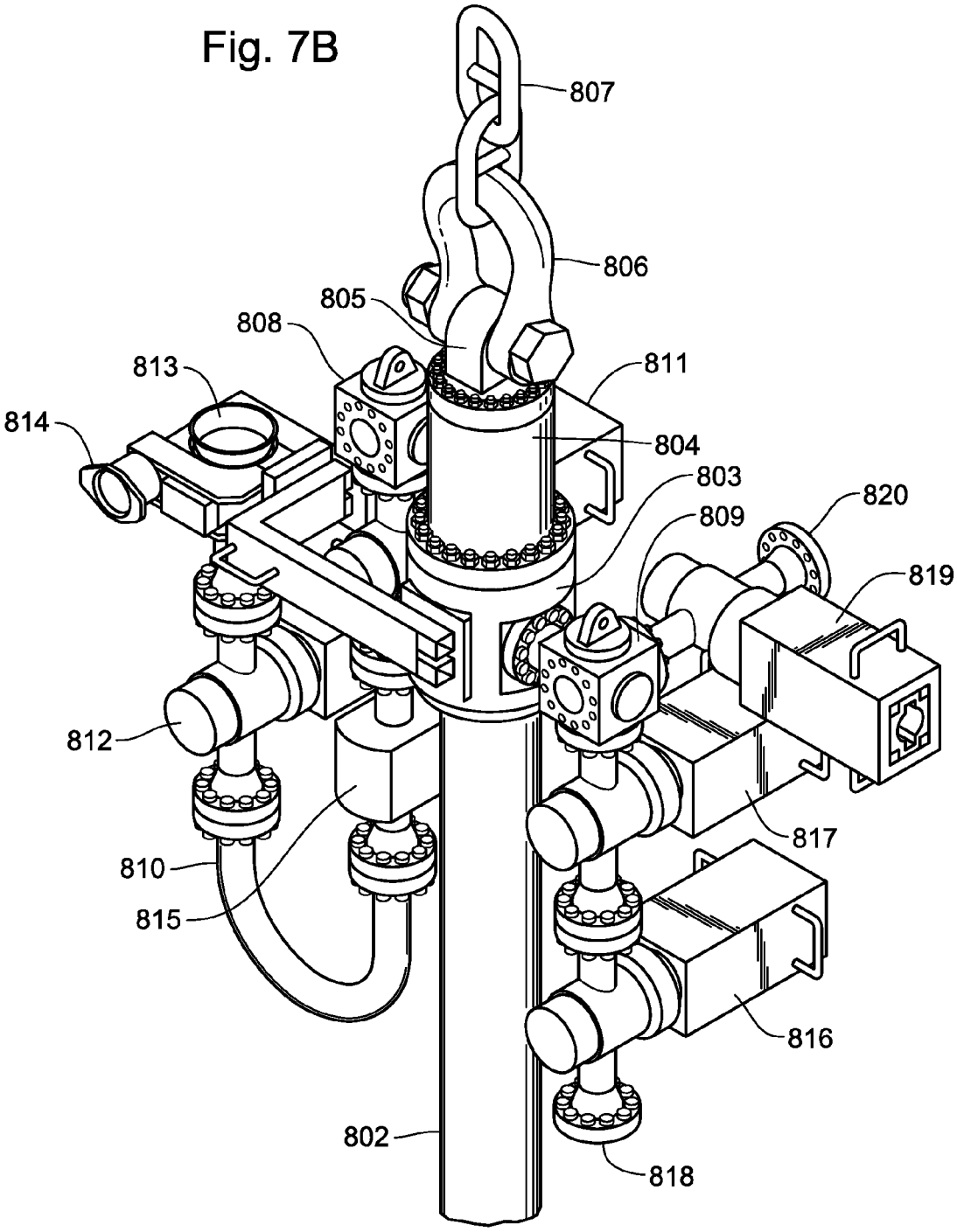
Figure 7C:
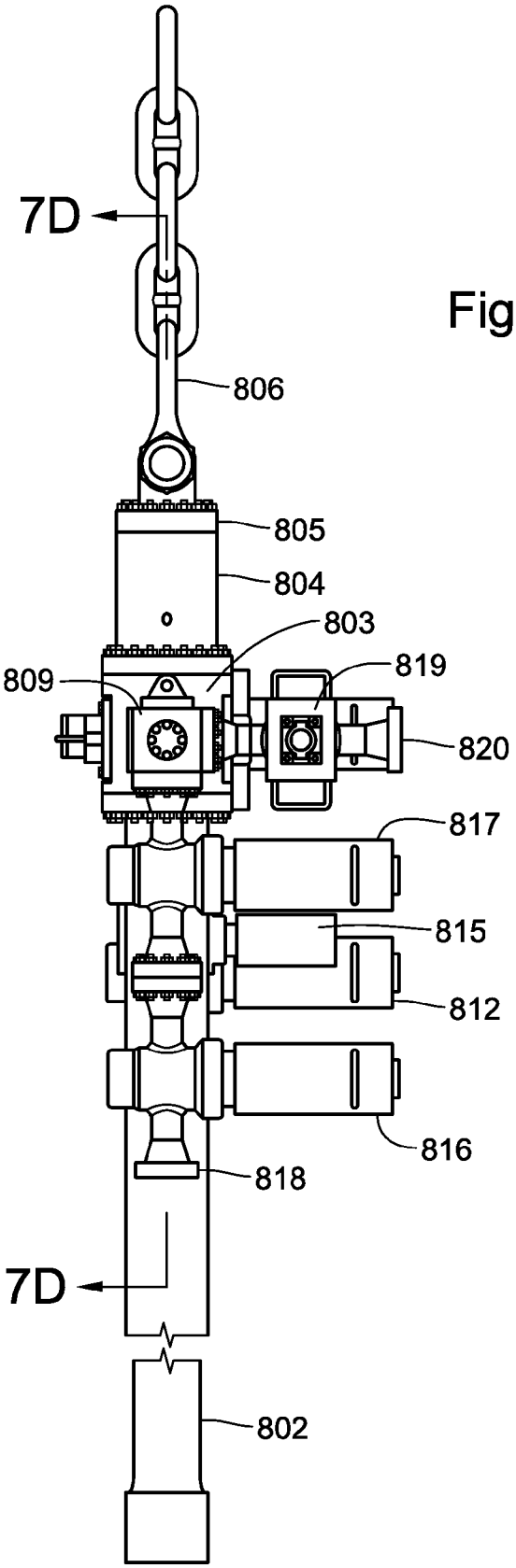
FIG. 7C is a side elevation view, and FIG. 7D a cross-sectional view of the embodiment of FIGS. 7A and B.
Figure 7D:
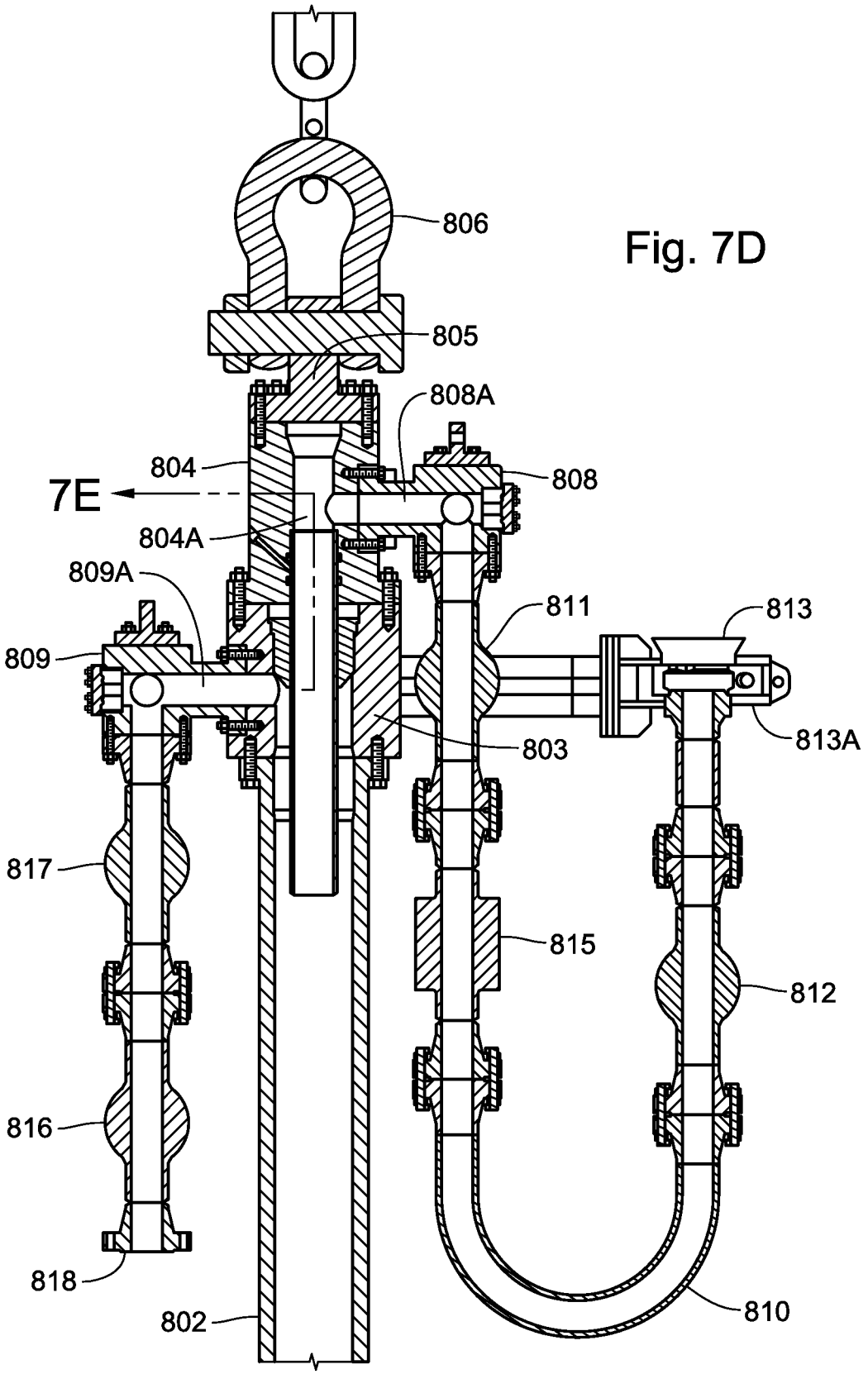
FIG. 7E is a detailed cross-sectional view of a portion of that embodiment.
Figure 7E:
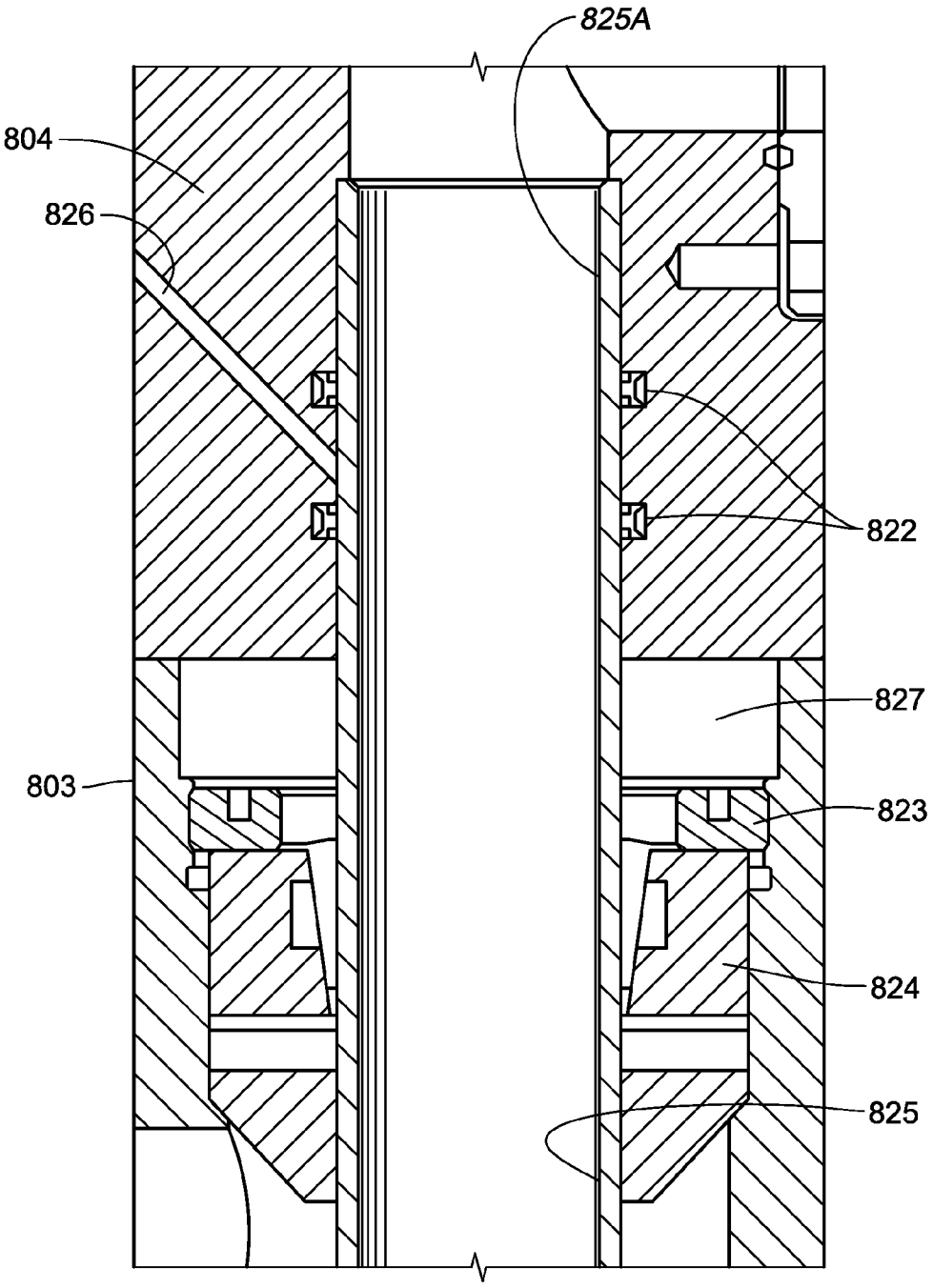

FIGS. 7A and 7B are schematic front and rear perspective views of another upper riser assembly (URA) embodiment in accordance with the present disclosure, FIG. 7C is a side elevation view of this embodiment; FIG. 7D is a cross-sectional view of the embodiment of FIGS. 7A and 7B; and FIG. 7E is a detailed cross-sectional view of a portion of the cross-sectional view of FIG. 7D. This URA embodiment differs from the previous URA embodiments primarily as this embodiment allows circulating a functional fluid, such as heated water, through the annulus. In the previous URA embodiments, two of the large wing valves and the large diameter passages were replaced with ROV stab functionality to inject a functional fluid such as nitrogen.

In the embodiment illustrated in FIGS. 7A-7E, another flexible conduit (not illustrated for clarity) may be connected to the URA via subsea connector 818 and extend to a surface vessel if continuous or semi-continuous circulation in the annulus were desired. An offtake spool 804 may be fluidly connected to a hanger spool 803. Hanger spool in turn may be connected to a tapered stress joint 802, which is not a part of the URA per se but is illustrated for completeness and to show how the URA connects to a riser system. A shackle 806 and chain tether 807 may allow the URA to be mechanically connected to a near-surface buoyancy device (not illustrated).

As best illustrated in FIG. 7D, block elbow 808 may include an inner bore 808A which intersects with and is substantially perpendicular to a bore 804A in offtake spool 804. Also included in this embodiment is a block elbow 809 and inner bore 809A which is also substantially perpendicular to bore 804A but which does not intersect bore 804A. A gooseneck conduit 810 may provide a flow path for hydrocarbons in combination with elbow bore 808A, first emergency shutdown valve 811 and second emergency shutdown valve 812. An outlet 813 in connector 813A would connect to a subsea flexible conduit 12 for production or containment operations. Connector 813A may be a connector known under the trade designation OPTIMA, or other connector suitable for subsea use. An ROV connection 814 is provided for operation of connector 813A. A bleed valve 815 may also be provided, serving to allow shutting in the URA, bleeding off contents of the gooseneck assembly 810, and retrieving the subsea flexible, for example for repair or replacement.

Valves 816 and 817 may be provided for annulus circulation and/or production and/or functional fluid injection through connector 818. A functional fluid may be delivered into the annulus via connector 818 and valves 816 and 817, and exit through an annulus vent sub, such as illustrated in FIG. 1D. Valves 816 and 817 may be ROV-operable. A functional fluid may also be injected into the annulus via another ROV-operable valve 819 and connector 820, which may be a flange connector.

FIG. 7E is a detailed cross-sectional view of an area where offtake spool 804 and hanger spool 803 connect. Two ring seal and wire retainer arrangements 822 may provide dual seals between fluid flowing in bore 825A in production tubing 825 and chamber 827 holding slips 824. A lockdown ring 823 locks holding slips 824 into position. Further included is a passage 826 that may allow access to ring seal and wire retainer arrangements 822.

Another embodiment of an upper riser assembly in accordance with the present disclosure is illustrated schematically in side elevation in FIG. 8A. URA 6 includes a production bore offtake spool 910 fluidly and mechanically connected to a conduit 911 and to a production tubing 913. Production tubing 913 may be fluidly connected to a bend restrictor 134 through a subsea API flange 905, a high pressure subsea connector 184, another subsea API flange connection 133, and optionally a QDC subsea connector 950 (for example, such as available from Vector Subsea, Inc. under the trade designation OPTIMA). Bend restrictor 134 may connect to a subsea flexible conduit 12, which may extend in a catenary loop to a surface vessel in known fashion. An ESD 915 may be provided in tubing section 911, which is ROV-operable. A support bracket 916 may be provided, which in addition to supporting tubing 913 at an angle σ, may also support a bend shield 942 that provides a mechanical barrier between wing assemblies. Angle σ may range from 0 to about 180 degrees, or from about 30 degrees to about 90 degrees, or from about 30 to about 45 degrees. Tubing 911 fluidly connects to an adapter 926, which in turn fluidly connects to a hanger spool 912 via an API flange 917, casing head 124 via another API flange 918, stem joint 124B welded to casing head 124, and riser 2 threaded into stem joint 124B. Offtake spool 910 may include a shackle flange 127 allowing connection to a chain tether 125 and near-surface buoyancy device (not illustrated).

Another feature of this embodiment, illustrated in FIG. 8A, is provision of a connection 906 in hanger spool 912 for connecting a gooseneck 907, API flange 908, tubing 909, high pressure subsea connection 940, another subsea API connector 940 and API flange 941, and bend restrictor 923 for a subsea flexible 919 for delivering heated water into hanger spool 912 from a surface structure, and thus into annulus 76 (FIG. 8B). The heated water would exit via an annulus vent sub, as illustrated in FIG. 1D.

FIG. 8B illustrates, in cross-section denoted 8B-8B in FIG. 8A, details of this embodiment of URA. An inner riser 60 is illustrated positioned inside of adapter 926, hanger spool 912, and casing head 124, creating an annular space 76 between an inner surface 912A of hanger spool 912 and inner riser 60. A pair of O-ring seals 925 seal inner riser 60 into adapter 926. One or more slips 924 wedge between an inner slanted surface 943 of hanger spool 912 and inner riser 60, firmly securing inner riser 60 in hanger spool 912.

Figure 9:
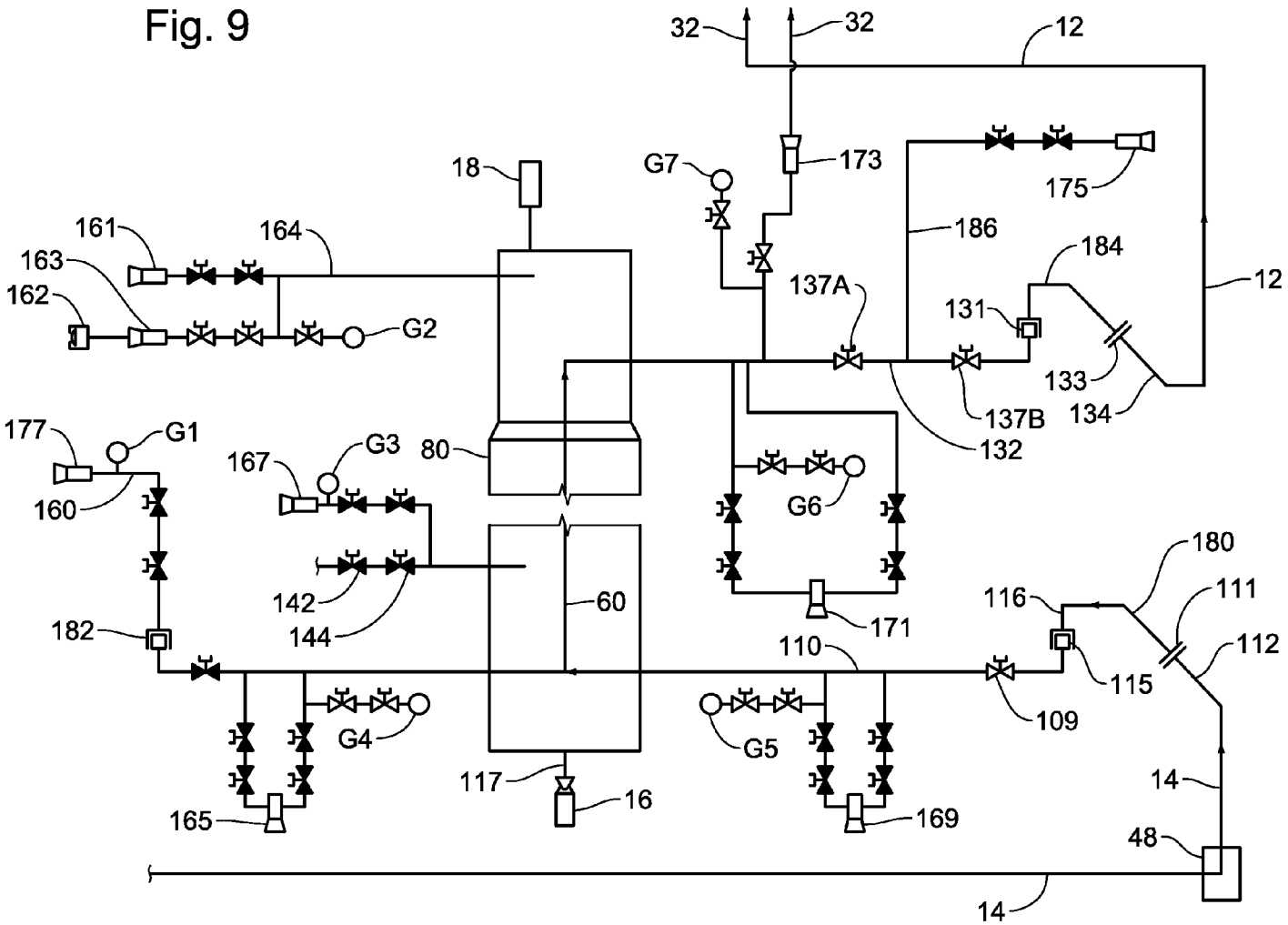
FIG. 9 is a partial schematic piping and instrumentation diagram (P&ID) diagram of a concentric free-standing riser system within the present disclosure.

FIG. 9 is a P&ID of one concentric free-standing riser system embodiment within the present disclosure. Valves indicated as black, solid coloring indicate that the valve is normally closed. A nitrogen access line 160 may be provided for hydrate remediation of inner riser 60. Line 160 connects through a subsea connector 182. A burst disc 162 may be provided, set at a pressure appropriate for the conditions, but in one embodiment may be set at 4740 psia (32 MPa). Burst disc 162 may be part of a pressure safety valve system 164 for annulus 70. Various pressure gauges G1, G2, G3, G4, G5, G6, and G7 may be provided, as well as ROV hot stab ports 161, 163, 165, 167, 169, 171, 173, 175, and 177 as indicated. Hot stab ports may be single-ported or multi-ported. An ROV hot stab pressure bleed port 186 may be provided in this embodiment.

Figure 10B:
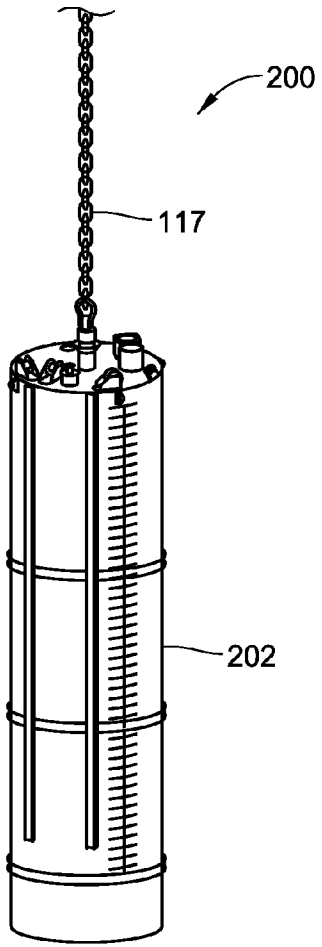
FIGS. 10A and 10B illustrate schematic perspective views of a suction pile useful in the systems and methods within the present disclosure.
Figure 10A:
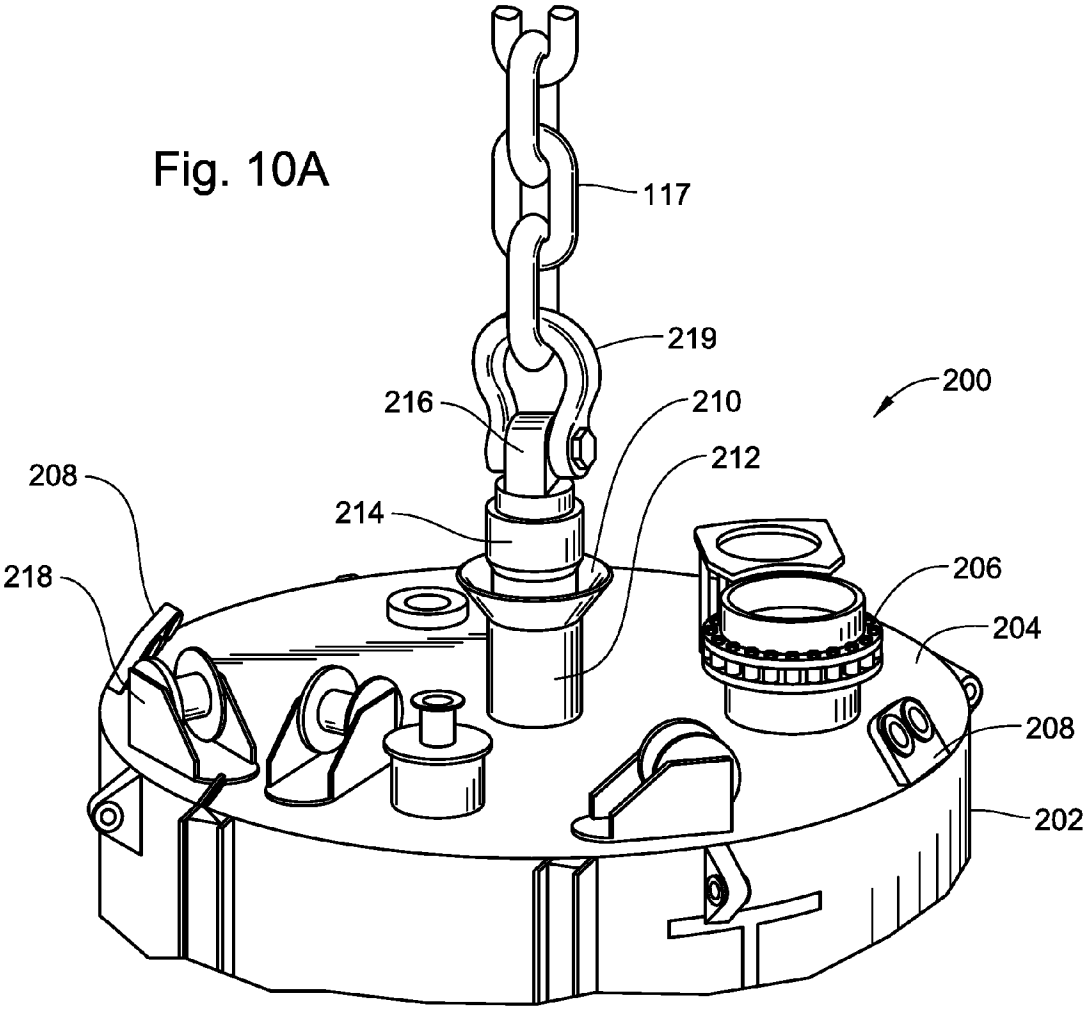

FIGS. 10A and 10B illustrate schematic perspective views of a suction pile assembly embodiment 200 useful in the systems and methods within the present disclosure, including a cylindrical casing 202, a top plate 204, a flanged connection 206 for pumping seawater in or out of cylindrical casing 202, and various connections to help manipulate suction pile 200. A funnel connection 210 and vertical extension 212 may provide guidance when landing a piston 214, such as available from Balltec, of Lancashire, UK. A pad eye extension 216 and U-connector may allow connection of the suction pile to the LRA using tether chain 117. Installation of suction pile 200 in the seabed may proceed by pumping out seawater from the device through connection 206. Subsea pressure forces cylindrical casing 202 into the seafloor. Such installations methods are known, and are discussed for example in US published patent application 20020122696.

Figure 11A:
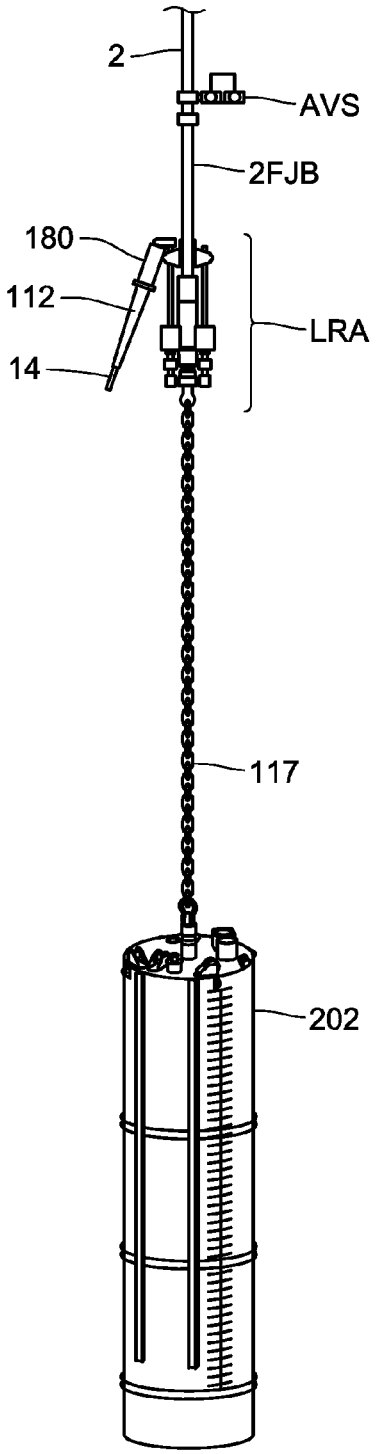
FIG. 11A is a schematic perspective view of the suction pile illustrated schematically in FIG. 10 attached to an LRA embodiment and riser.
Figure 11B:
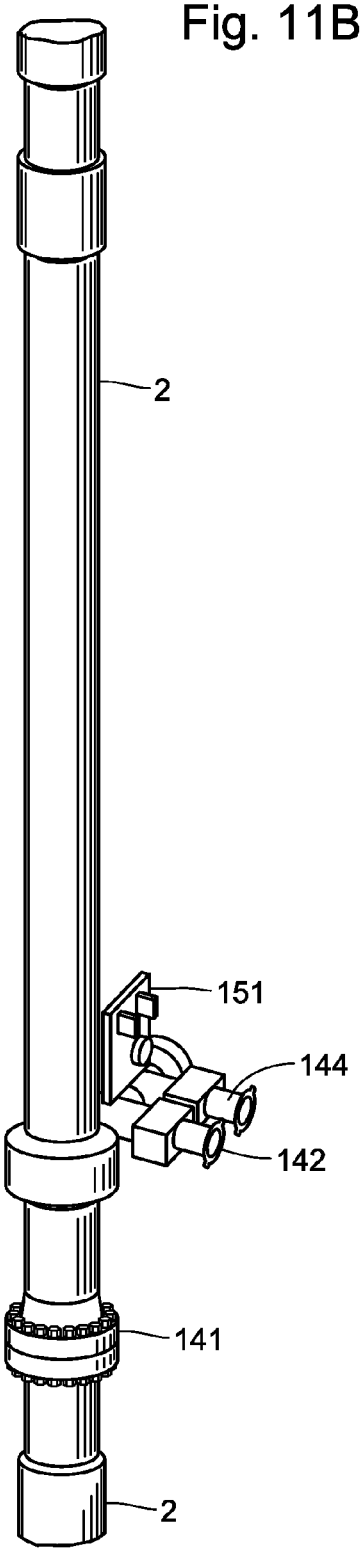
FIG. 11B is a more detailed schematic perspective view of a portion of the riser illustrated in FIG. 11A, illustrating one possible position of a riser annulus vent sub.

FIG. 11A is a schematic perspective view of suction pile cylindrical casing 202 illustrated schematically in FIG. 10 attached to an LRA via chain tether 117, illustrating one possible position of an annulus vent sub AVS just above the LRA, with FIG. 11B being a further perspective view of the LRA embodiment 8 and annulus vent sub AVS, illustrating annulus vent sub valves 142 and 144.

In various embodiments, the system FSRs may be anchored to the seabed 10 by means of a suction pile assembly as illustrated in FIG. 11A. The suction piles may be identical or different. In one embodiment, they may be 14 feet in diameter and 70 feet long. A new Balltec male suction follower handling tool may be used with the existing female receptacle on the suction pile. Once the suction pile is embedded into the seabed, it may be anchored to the FSR by means of a Balltec connector, shackles and chain tether as illustrated. The foundation tether chains may be selected to accommodate the maximum base tension of 550 kips (2450 kilonewtons) (i.e. largest survival load case). The suction pile may be designed for a minimum pull-out safety factor of 3 over this maximum base tension.

In one embodiment similar to that illustrated in FIGS. 3A-3J, the LRA weight may be approximately 30 kips (130 kilonewtons) in air, 26 kips (116 kilonewtons) submerged, and may be attached to the suction pile with 90 feet of 117 mm R-4 studless chain with a breaking strength of 2,915 kips (13,000 kilonewtons) and a 250 ton (about 227,000 kilograms) Crosby G-2140 shackle with a breaking strength of 2,750 kips (12,200 kilonewtons). The LRA in this embodiment may be comprised of a 15K Vetco H-4 subsea wellhead, specially machined with 2×7-⅙ inch (5×18 cm) 10,000 psi (70 MPa) inlets to accommodate either multiple flexible jumper connections, or as illustrated in FIG. 3, one production jumper and a ROV interface for methanol injection.

Figure 12C:
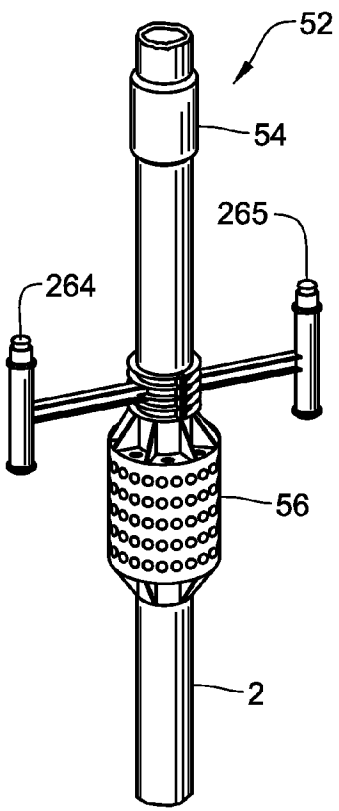
FIGS. 12A, 12B, and 12C are schematic perspective views of a storm clamp, a riser position clamp, and riser tension monitoring subsystem in accordance with the present disclosure.
Figure 12B:
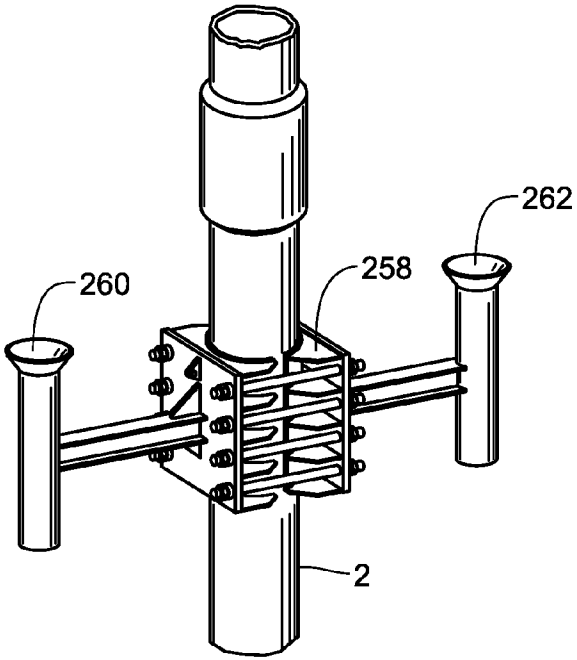
Figure 12A:
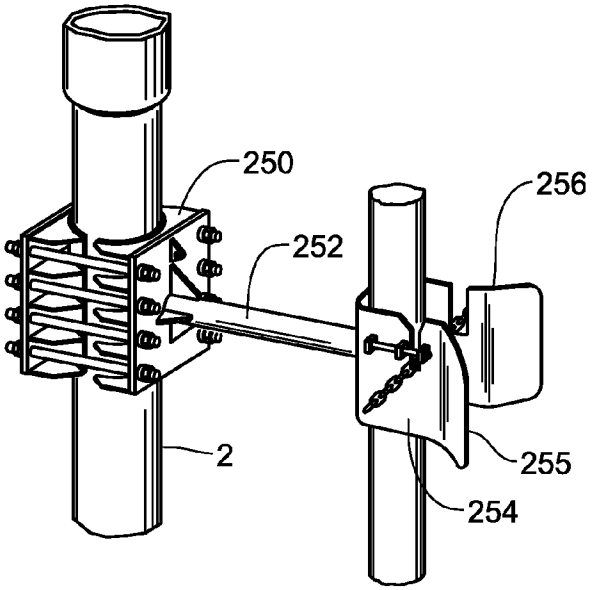

FIGS. 12A, 12B, and 12C are schematic perspective views of a storm clamp sub-system, a riser positioning system, and riser tension monitoring sub-system in accordance with the present disclosure. The storm clamp sub-system illustrated in FIG. 12A comprises a riser clamp 250, horizontal extension 252, flexible jumper clamp (ROV operable) 254 (total of four on one embodiment). Jumper clamp 254 may comprise guides 255, 256 that serve to guide the flexible conduit into flexible jumper clamp 254. The riser positioning system may comprises a riser position clamp 258, and a pair of acoustic sources or beacons 260, 262. Suitable acoustic beacons are available from Sonardyne International Ltd in the UK, and from Sonardyne Inc., Houston, Tex. Acoustic positioning is well-known and requires no further explanation herein, however, its use in subsea containment disposal methods and systems is not known.

FIG. 12C illustrates a tension monitoring system 52, including a subsea connector 54, tension monitoring module 56, and acoustic beacons 264 and 265. As noted, such acoustic beacons are commercially available, and riser tension monitoring is known, however, not in methods of subsea containment disposal.

In the event of a planned or unplanned disconnect event, the upper flexible jumper conduit may be designed to be lowered in a controlled manner to the side of the FSR and constrained in the flexible jumper clamps by ROV. The riser position clamp with two acoustic beacons may be deployed anywhere on the riser, but in one embodiment may be deployed near the top of the riser. These beacons may be integrated with the containment vessel dynamic positioning (DP) systems in order to provide continuous relative location of the top of the riser that may feed directly into the management of vessel stationkeeping limits. The riser tension monitoring unit may be strain-based and may be installed anywhere along the length of the riser, and in multiple locations. In one embodiment the riser tension monitoring unit may be installed on the outer riser with 2 acoustic beacons transmitting tension values to the containment vessel at preset continuous intervals.

Figure 13A:
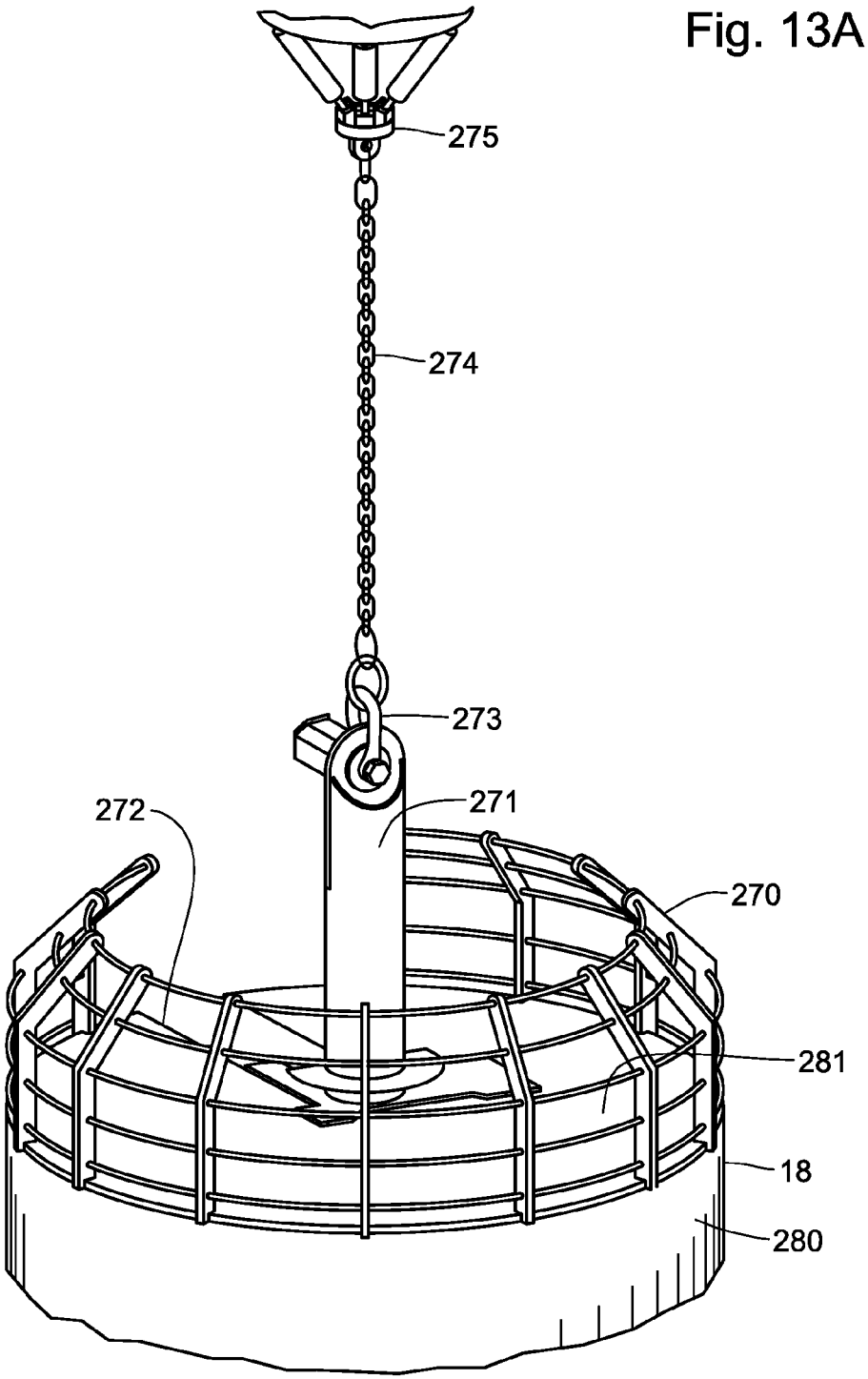
FIGS. 13A, 13B, and 13C are schematic perspective views of a buoyancy assembly, with FIG. 13C illustrating schematically its connection to an upper riser assembly embodiment in accordance with the present disclosure.
Figure 13B:
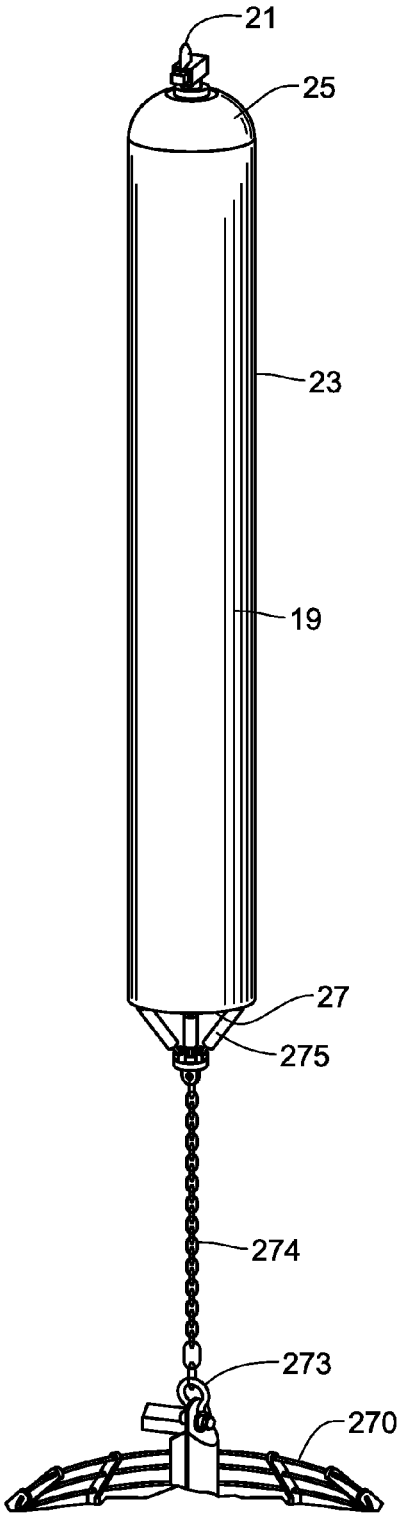
Figure 13C:
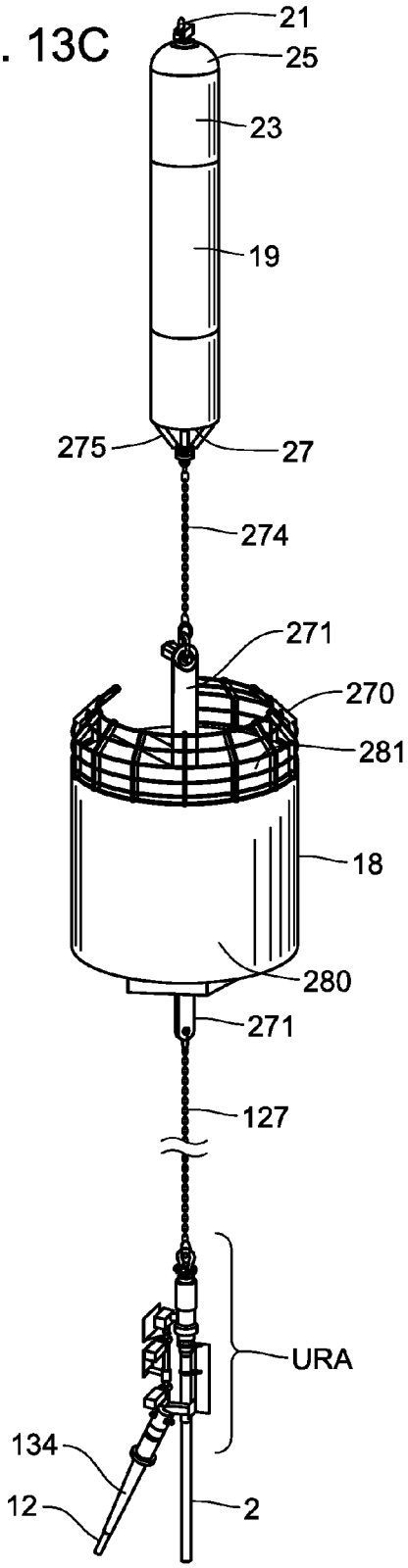

FIGS. 13A and 13B are schematic perspective views of a buoyancy assembly useful in the methods and systems of this disclosure. A railing 270 may be provided, along with a central support conduit 271, and slot 272 in a top surface 281 of a primary air can cylinder 280 of air can 18. A padeye 273 may be provided, along with tether chain 274 and tensioning apparatus 275. FIG. 13C illustrates how the buoyancy assembly may connect to the upper riser assembly (URA), and illustrates a lifting and fill connection for an auxiliary air can 19 and its cylinder 23. Auxiliary air can 19 may include a top 25 including a filling valve 21 for filling, and a bottom 27.

Figure 14:
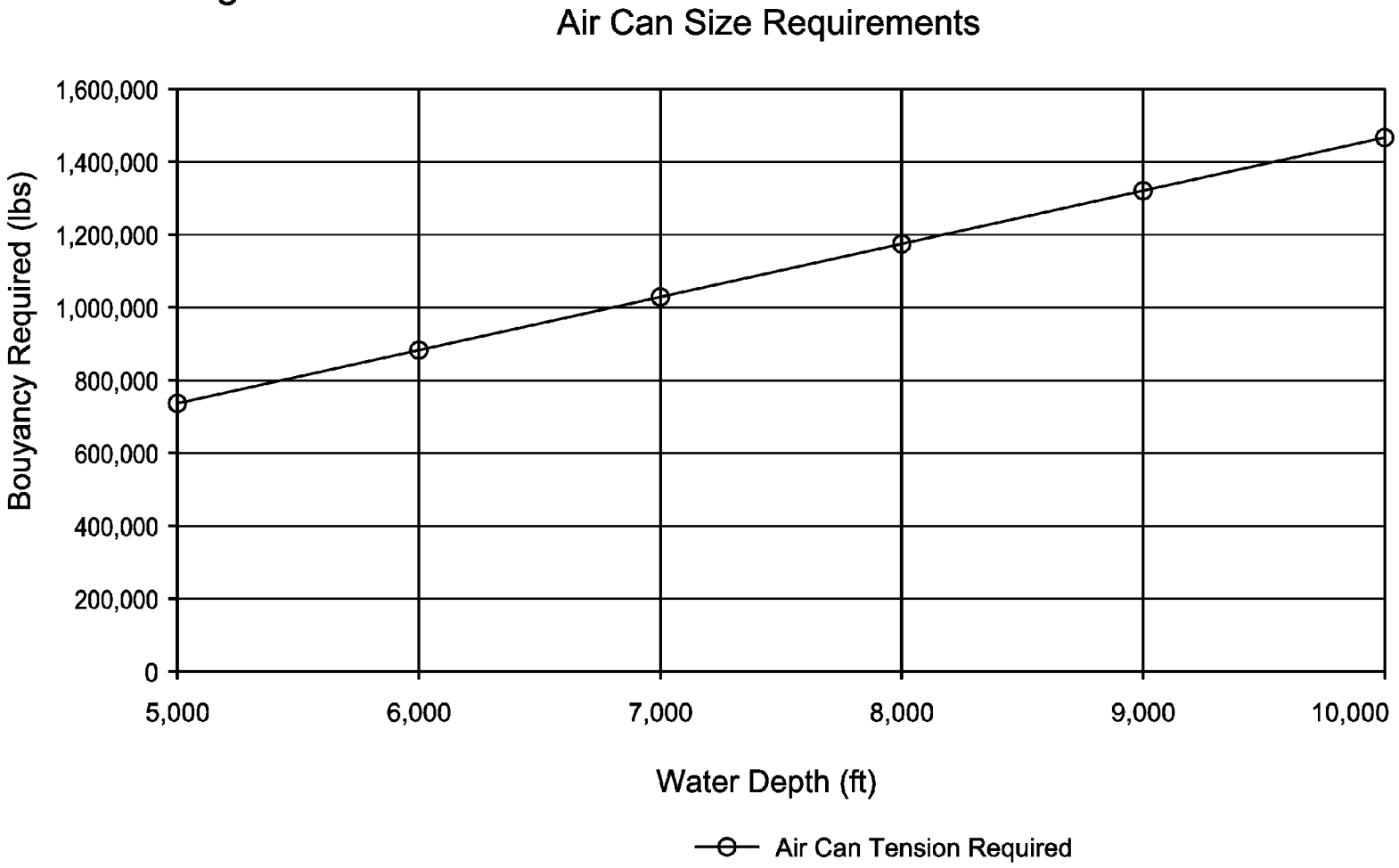
FIG. 14 is a graphical display of air can buoyancy and size requirements.

FIG. 14 is a graphical display of air can buoyancy requirement (in pounds) as a function of subsea water depth (in feet). The line indicates the amount of air can tension required.

Figure 15:
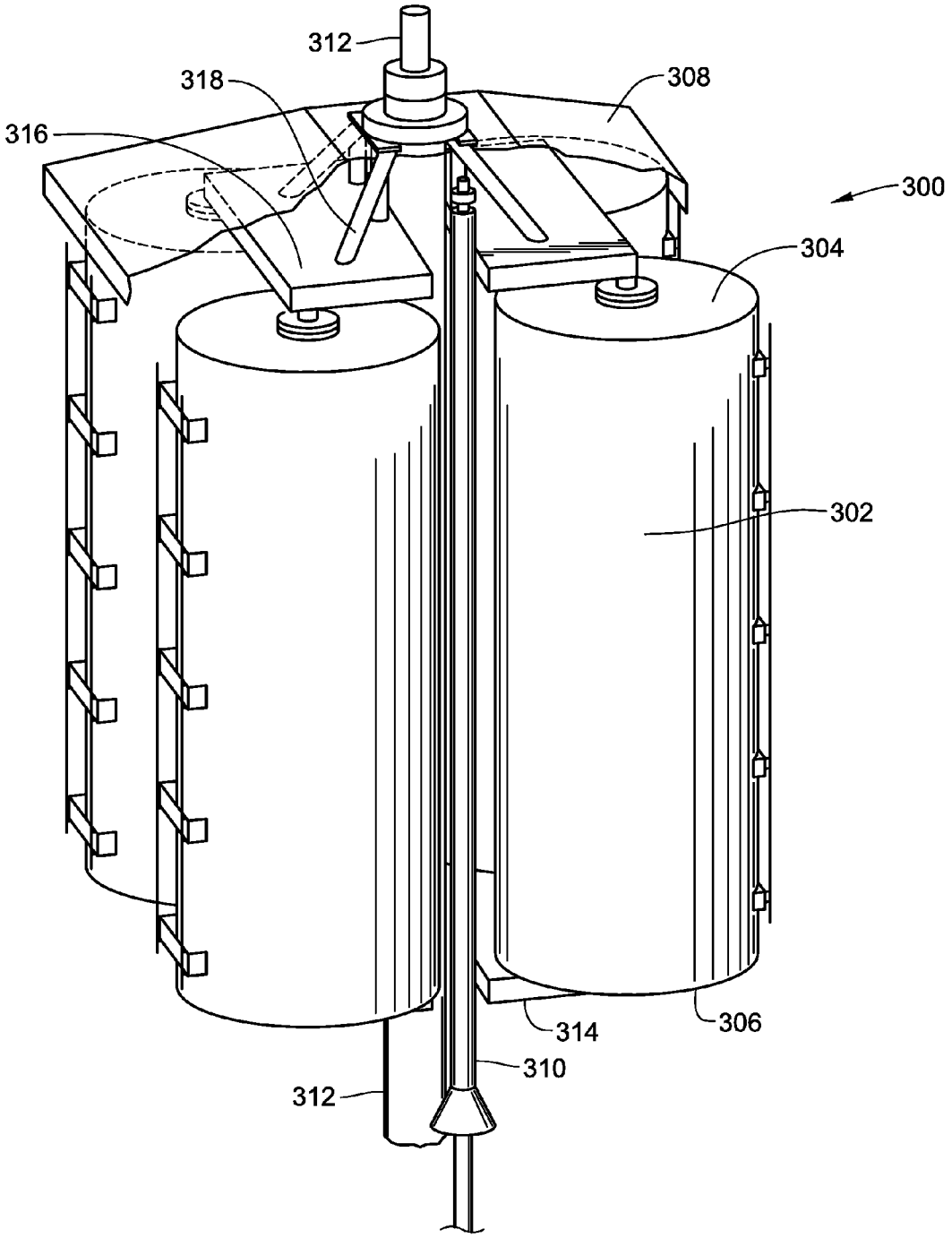
FIG. 15 is a schematic perspective view of another air can buoyancy assembly.

FIG. 15 is a schematic perspective view of another air can buoyancy assembly 300 that may be useful in certain embodiments, comprising four non-integral cylinders 302, each having a top 304, and individual bottom supports 306 for each cylinder 302. Each cylinder may include four chambers, but they may comprise more or less chambers. Each cylinder may be 16 feet (4.9 m) in diameter, but may be more or less in certain embodiments. Each cylinder may have a length of 45 feet (13.7 m) in this embodiment, but in certain embodiments may have more or less length. Embodiment 300 may also comprise a top surface or roof 308, a tether 310, and a central support conduit 312. Apparatus 300 may include bottom support pads 314 (four in this embodiment) and two top support panels 316 supported by struts 318. FIG. 15 illustrates a conceptual design for an aircan that may provide sufficient buoyancy for a containment FSR system even in 10,000 feet (about 3,000 m) of water depth. At shallower depths, fewer chambers may need to be aired, creating additional overall system redundancy. Shilling, et al., "*Development of Fatigue Resistant Heavy Wall Riser Connectors For Deepwater HPHT Dry Tree Riser Systems*", OMAE2009-79518.

Figure 16:
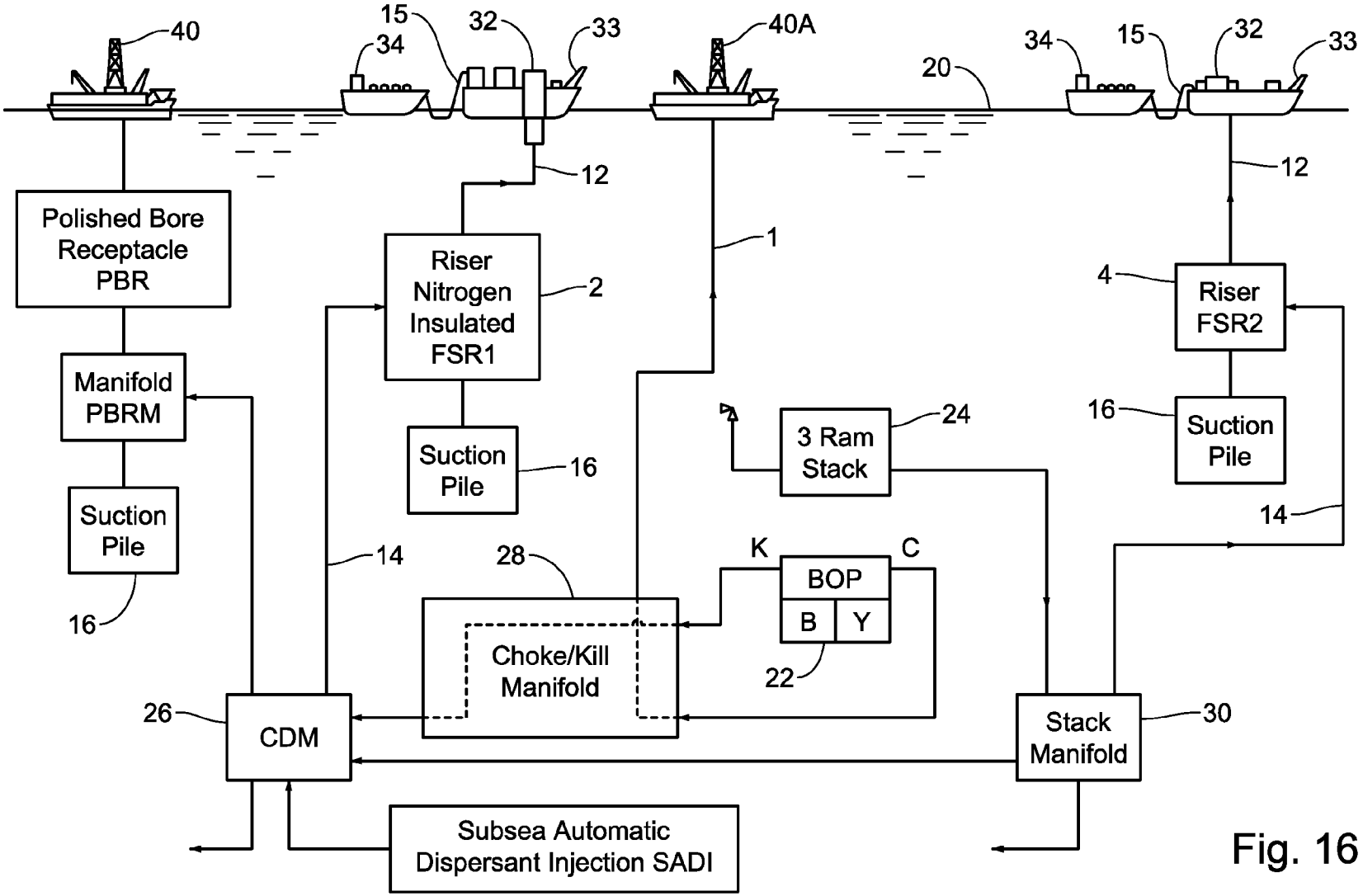
FIG. 16 is a schematic illustration of a system embodiment of the present disclosure.

FIG. 16 is a schematic block diagram of a free-standing riser-based containment disposal system in accordance with the present disclosure that include four routes for subsea source fluids to four separate surface structures. Along with previously mentioned features (FSRs 2 and 4 and their associated surface structures), this embodiment may include a surface structure 40 that may accept fluids from a subsea source through a seabed-secured polished bore receptacle (PBR), seal stem, and riser assembly, and a PBR manifold (PBRM). The riser may have a seal stem attached to its distal end, and the seal stem may then be stabbed into the PBR. The PBR may be anchored to seabed 10 by its own suction pile 16. Embodiments of a PBR, riser, and seal stem arrangement are more fully described in assignee's pending application Ser. No. 61/479,695, filed Apr. 27, 2011. Another surface structure 40A may accept subsea source fluids through a separate riser 1 from CKM 28 and choke line C from subsea BOP, 22. Separately, the PBR, seal stem, and riser may accept subsea source fluids from a kill line K of subsea BOP 22, the fluids passing through CKM 28 and CDM 26, then through the PBR, seal stem, and riser to surface structure 40.

FIG. 16 also illustrates generally where a subsea automatic dispersant injection (SADI) system may reside on seafloor 10. In one embodiment, the SADI may comprise one or more flexible bladders filled or partially filled with dispersant chemical or mixture of chemicals. Each bladder may be equipped with a weight on its top surface, so that if a burst disc fails in the containment disposal system, or other pressure-lowering event occurs in the system, the dispersant chemical may be automatically dispersed in the vicinity of the leaking equipment to disperse hydrocarbons and other material, such as drilling fluids, in the seawater until the containment disposal system comprising risers, LRA, and URA can be deployed in accordance with the teaching of the present disclosure.

Figure 17:
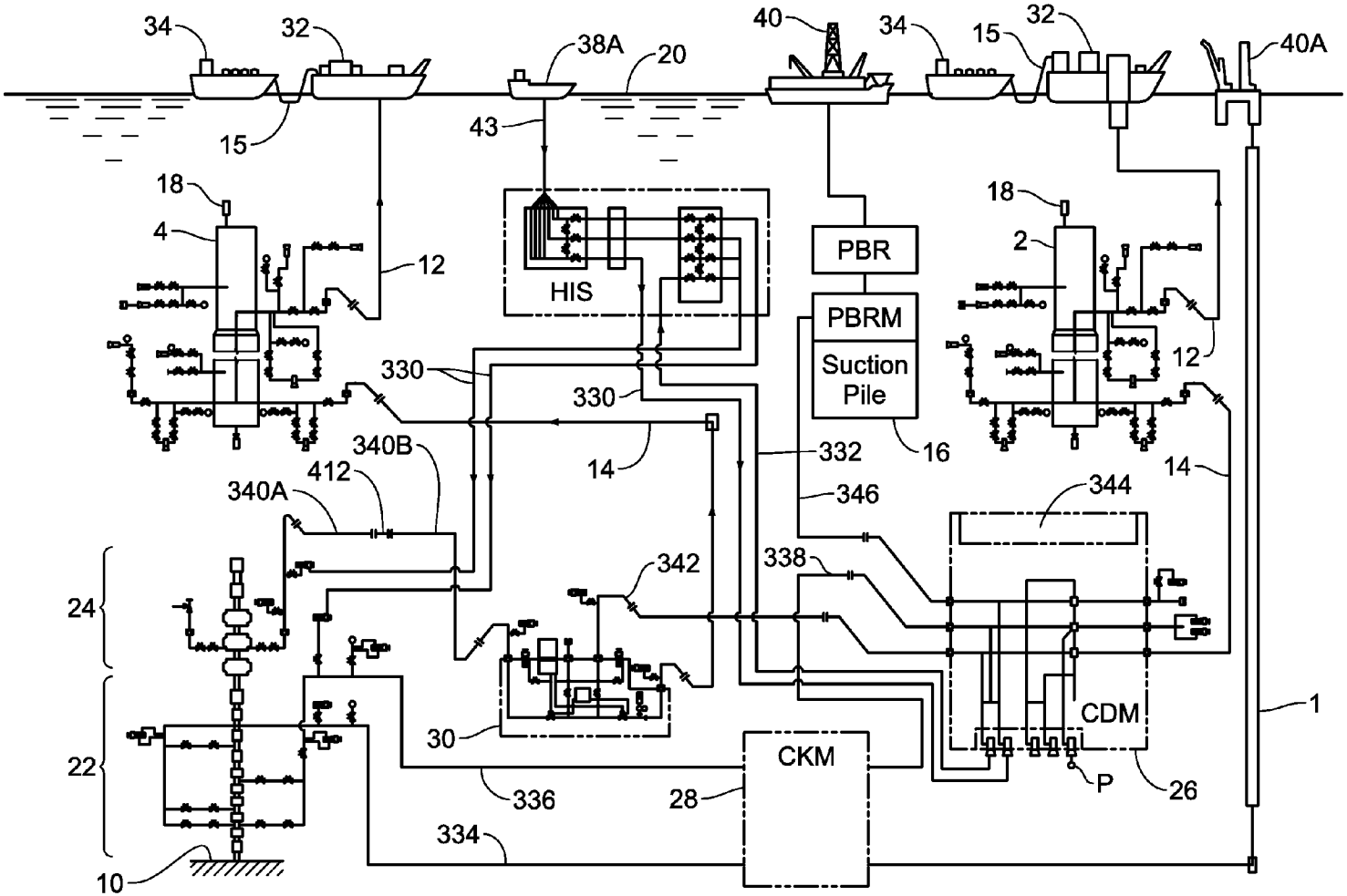
FIG. 17 is a more detailed schematic illustration of a system embodiment of the present disclosure.

FIG. 17 is a more detailed schematic illustration of a containment and disposal system embodiment of the present disclosure, and in particular illustrating how a hydrate inhibition system (HIS) may be integrated into the systems and methods. FIG. 17 illustrates hydrate inhibition chemical supply lines 330 supplying chemical to BOP stack cap 24, BOP 22, and to subsea flexible conduits 14 through the CDM 26. When circulating the chemical, it may return to vessel 38A through a return line 332. The HIS is described in more detail below with reference to FIGS. 26 and 27. Chemical may also be delivered to the choke and kill lines 334 and 336, respectively, via CKM (28). Also disclosed are flexible conduit 338 connecting CKM to CDM; flexible conduit 340 (340A and B) connecting stack cap 24 to stack manifold 30; a flexible conduit 342 connecting stack manifold 30 to CDM (26); and a flexible conduit connecting CDM 26 to PBRM.

Figure 18:
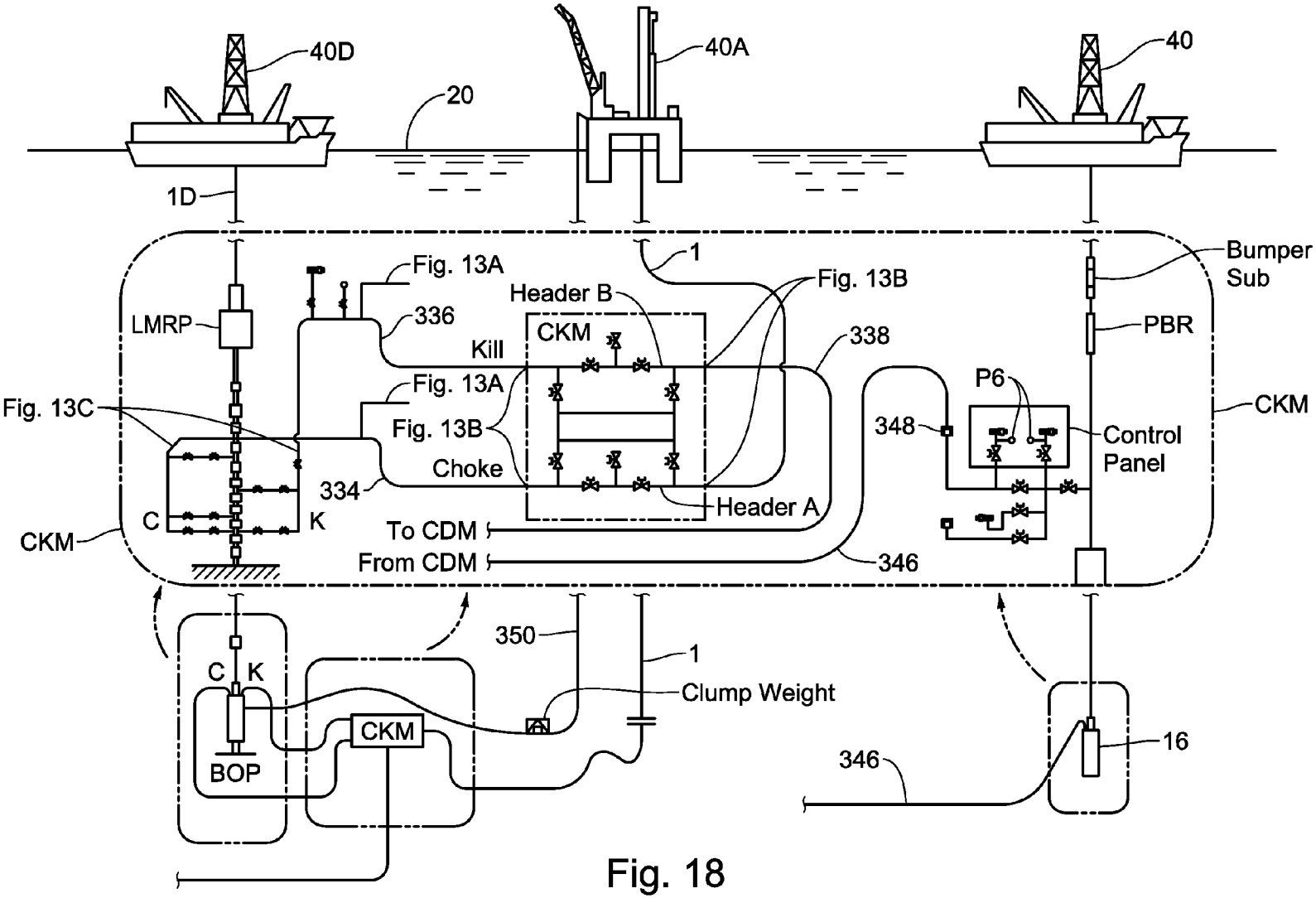
FIG. 18 is a detailed schematic diagram of a choke/kill manifold useful in the systems and methods of the present disclosure.
Figure 18A:
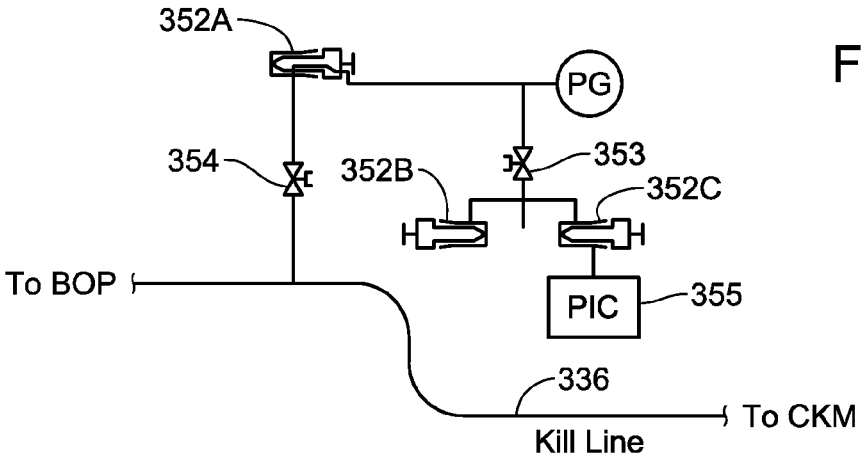
FIGS. 18A-18C are schematic piping diagrams of three hot stabs useful in the choke/kill manifold illustrated schematically in FIG. 18.
Figure 18B:
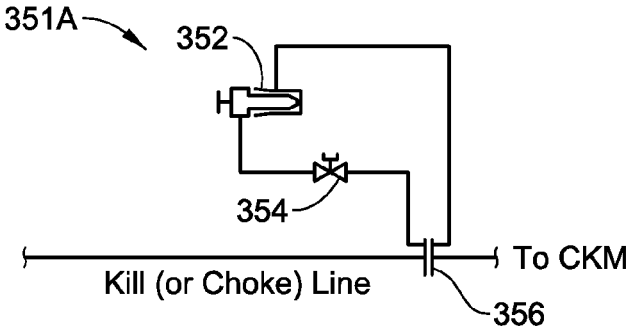
Figure 18C:
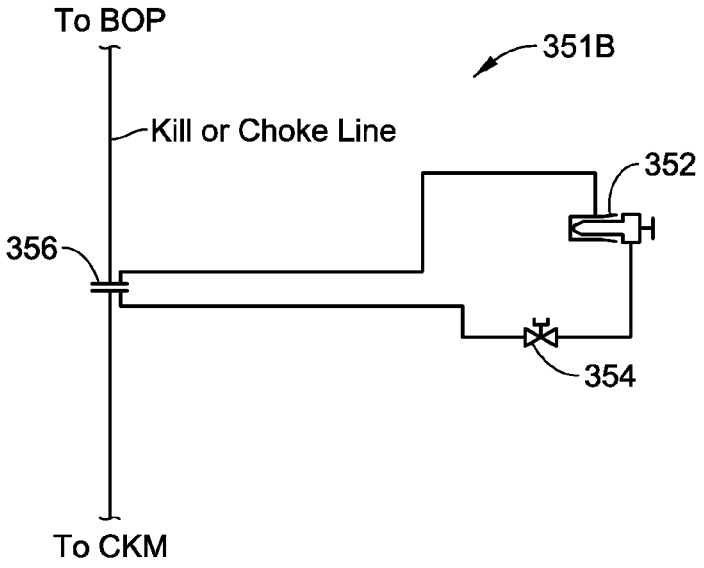

FIG. 18 is a detailed schematic diagram of a choke/kill manifold (CKM, 28) useful in the systems and methods of the present disclosure. In this embodiment, reference is made in FIG. 18 to detailed FIGS. 18A, 18B, and 18C, where indicated. For example, kill line 336 may include a hot stab connection as more particularly detailed in FIG. 18A; headers A and B in CKM may include connectors referenced in more detail in FIG. 18B, and choke and/or kill lines on the BOP may use connections as detailed in FIG. 18C. FIGS. 18A, B, and C illustrate hot stab connections 352A, B, and C, which may be API 17H standard hot stabs. A ¼-turn globe valve 353 is provided in the embodiment of FIG. 18A. A pressure reading may be taken in kill line 336 using pressure gauge PG (FIG. 18A) and hot stab 352A, while hot stabs 352B and 352C may allow other kill line parameters to be measured, for example, temperature, viscosity, and the like. Similarly, these parameters may be measured using the arrangements illustrated in FIGS. 18B and C in the kill and/or choke lines leading to and from the CKM, in the vicinity of ROV-operated subsea clamps 356. A pressure indicating controller, PIC, may be provided as indicated in FIG. 18A, which may allow pressure control through telemetry from the surface.

Figure 19:
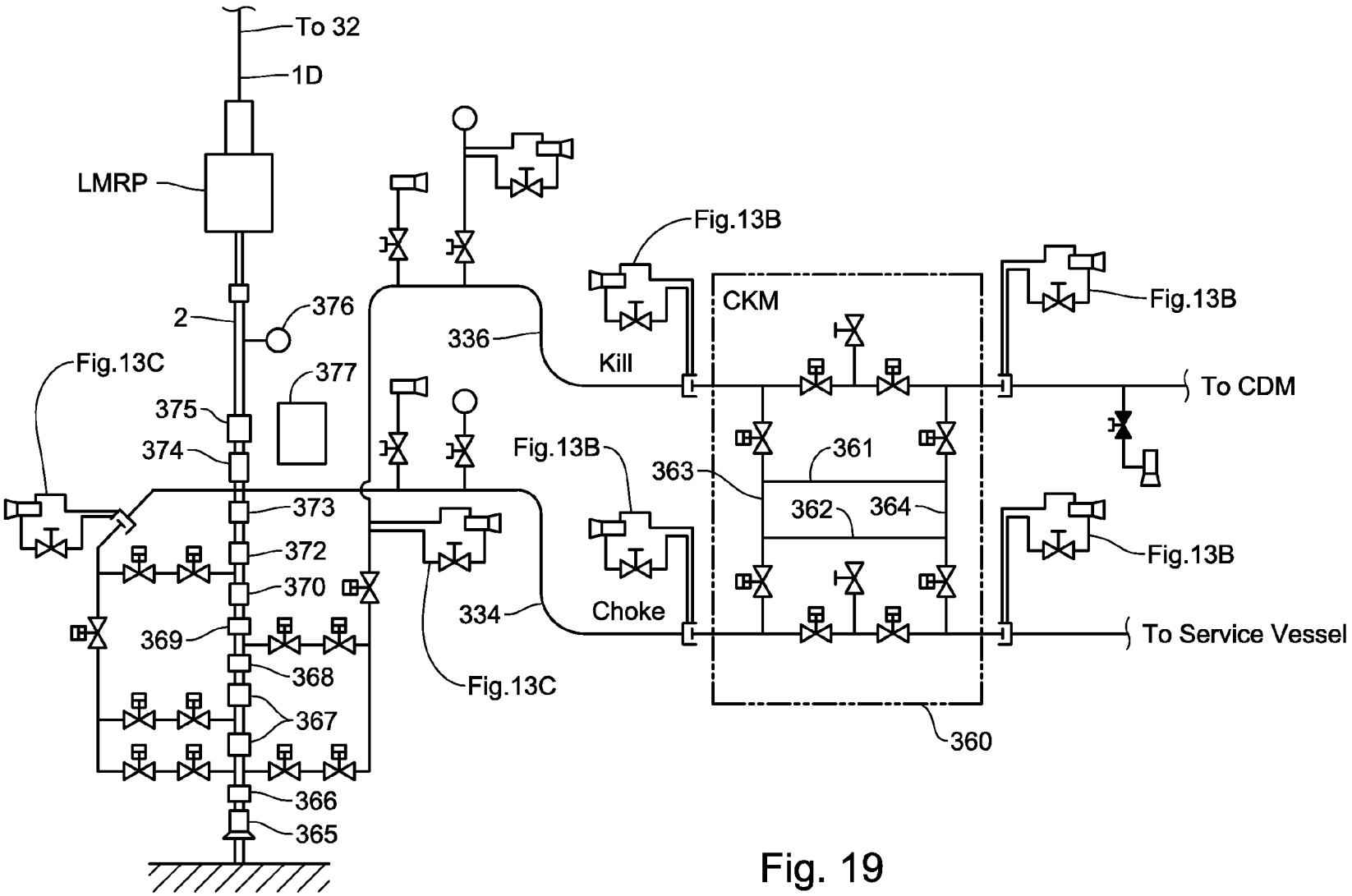
FIG. 19 is a schematic P&ID diagram of a lower marine riser package (LMRP), blow put preventer (BOP) stack, and junk shot manifold useful in certain embodiments of systems and methods of the present disclosure.

FIG. 19 is a schematic P&ID diagram of an LMRP, BOP stack, and junk shot manifold (JSM) 360 useful in certain embodiments of systems and methods of the present disclosure. JSM includes, in this embodiment, main headers 361 and 362, and cross-over connections 363, 364. BOP stack includes a stack connector 365 to the wellhead, a set of test rams 366 and two sets of pipe rams 367, casing shear rams 368, blind/shear rams 369, a riser connector 370, and a lower annular ram 372 and upper annular ram 373. A riser stress joint 374 connects to a riser adapter 375. Annulus vent sub 376 is indicated on riser 2. Also depicted is a replacement yellow pod 277 (supplied by SCM).

Figure 20:
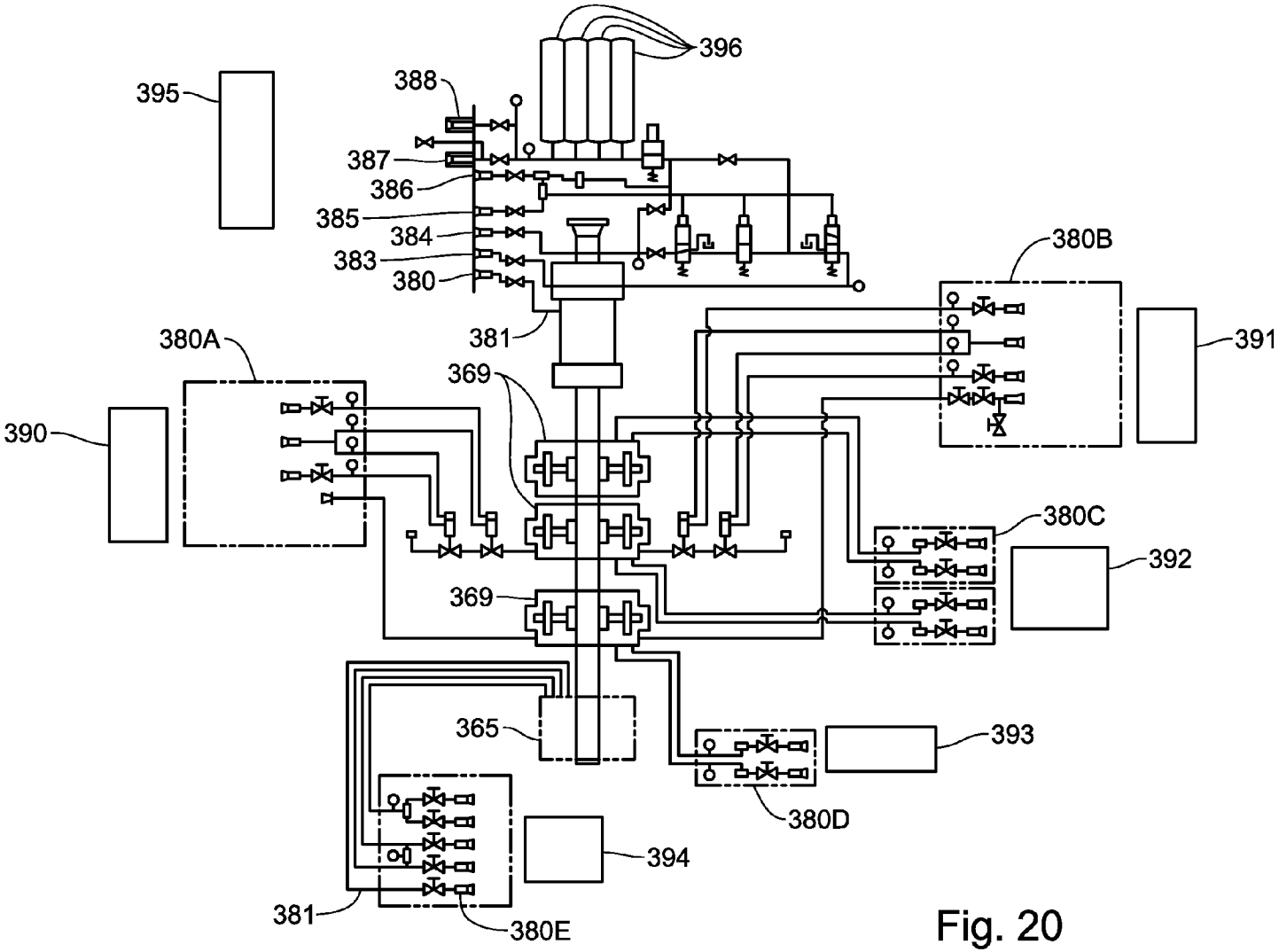
FIG. 20 is a schematic diagram, partially in cross-section, of a BOP stack and associated control panels useful in certain embodiments of systems and methods of the present disclosure.

FIG. 20 is a schematic diagram, partially in cross-section, of a BOP stack and associated control panels useful in certain embodiments of systems and methods of the present disclosure. In addition to features previously discussed, FIG. 20 discloses a series of ROV-operated control panels 380A-380E, associated with various ROV-operated valves and ports for performing various functions. For example, a kill panel 390 may have a set of ROV-operated connections, detailed in box 380A, including ports for closing and opening inner and outer kill valves, and a three-way valve for glycol/methanol flush, as well as a 12 pin wet mate connector. A choke panel 391 may have a set of ROV-operated connections, detailed in box 380B, including ports for closing and opening inner and outer kill valves, and a valve for HPHT probes. A double ram BOP panel 392 may have ports for closing and opening upper shear rams 369. A single ram BOP panel 393 may include controls detailed in box 380D to close and open lower shear ram 369. A hydrate control panel 394 may include primary unlatch, secondary unlatch, latch, an auxiliary gasket release, and a hydrate flush port control including a hydrate supply line 381, as detailed in box 380E for wellhead connection 365. ESD panel 395 may include panel options for an ROV intervention latch 383, an ROV intervention unlatch 384, a pilot supply from ROV hot stab 385, a pilot supply from surface controls 386, flying leads 387 to panels and/or accumulator skids, and a ½-inch minimum surface supply connection, 388.

The pilot supply pilots subsea solenoid valves via dedicated spare lines in an IWOCS umbilical (not illustrated). The solenoid valves when piloted may direct pressurized fluid from local accumulators 396 on the seabed to the corresponding valve, ram or connector actuator. Local subsea accumulators 396 may be supplied hydraulic pressure via a hydraulic conduit line (not illustrated) from a surface vessel. Emergency shut-in and disconnect may be achieved by direct electric or acoustic signal. The acoustic signal may be part of an acoustic deadman package having acoustic transceivers and an acoustic control unit (not illustrated).

Figure 21:
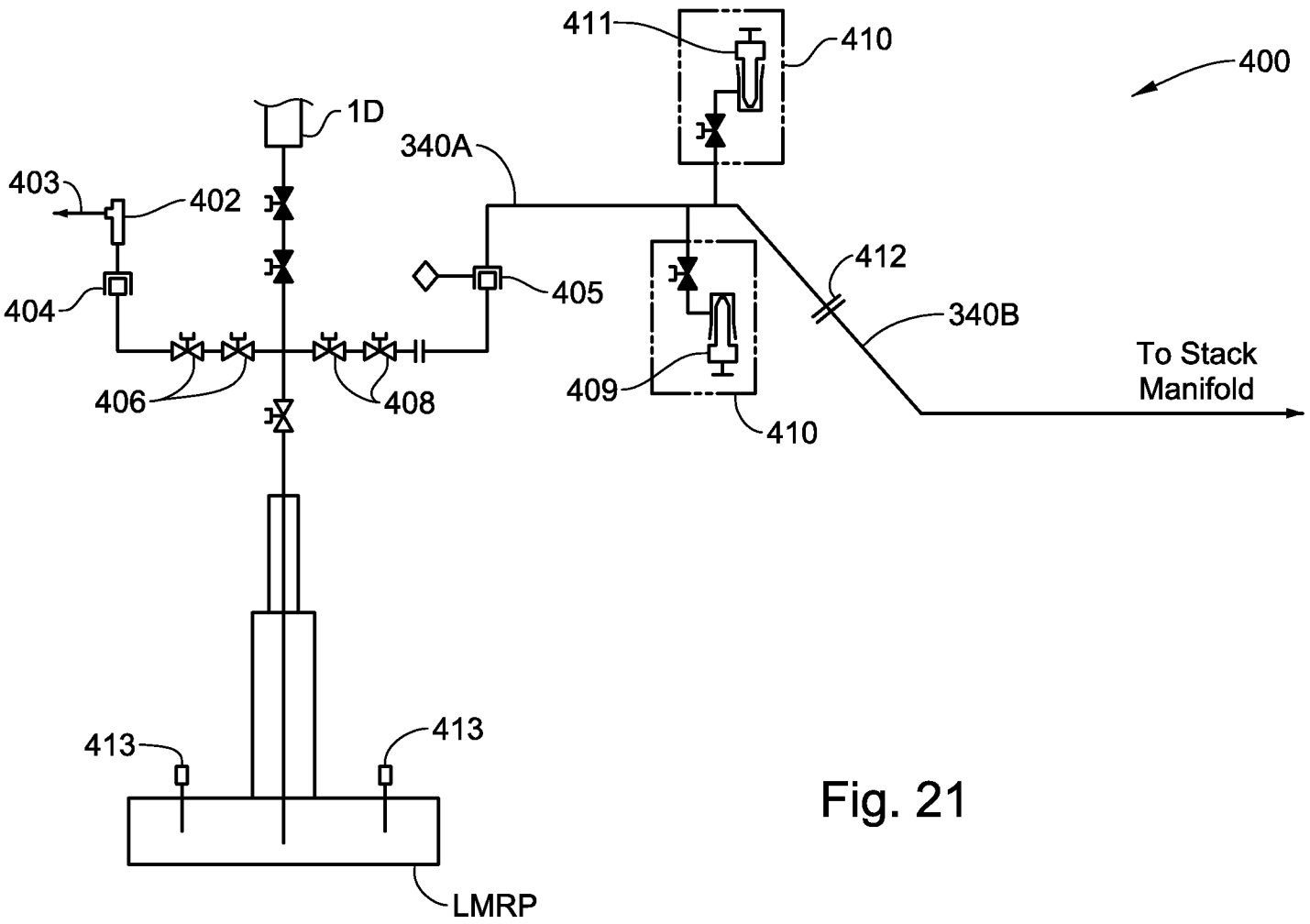
FIG. 21 is a schematic piping and instrumentation diagram (P&ID diagram) of a source interface useful in certain embodiments of systems and methods of the present disclosure.

FIG. 21 is a schematic P&ID diagram of a source interface 400 useful in certain embodiments of systems and methods of the present disclosure. Detailed in FIG. 21 are subsea choke 402, subsea choke vent 403, a subsea choke hub and mini-Cameron connection 404, and a subsea kill hub and mini-Cameron connection 405. Subsea choke and kill valves are illustrated at 406, 408. An API 17D hot stab is included at 409 on ROV-operated panel 410 on line 340A. Another ROV-operated panel 410 and Moffat hot stab receptacle is included for redundancy on line 340A, which is connected to line 240B by an API flange 412. A pair of 3-inch mini-Cameron connectors are associated with Lower Marine Riser Package (LMRP).

Figure 22:
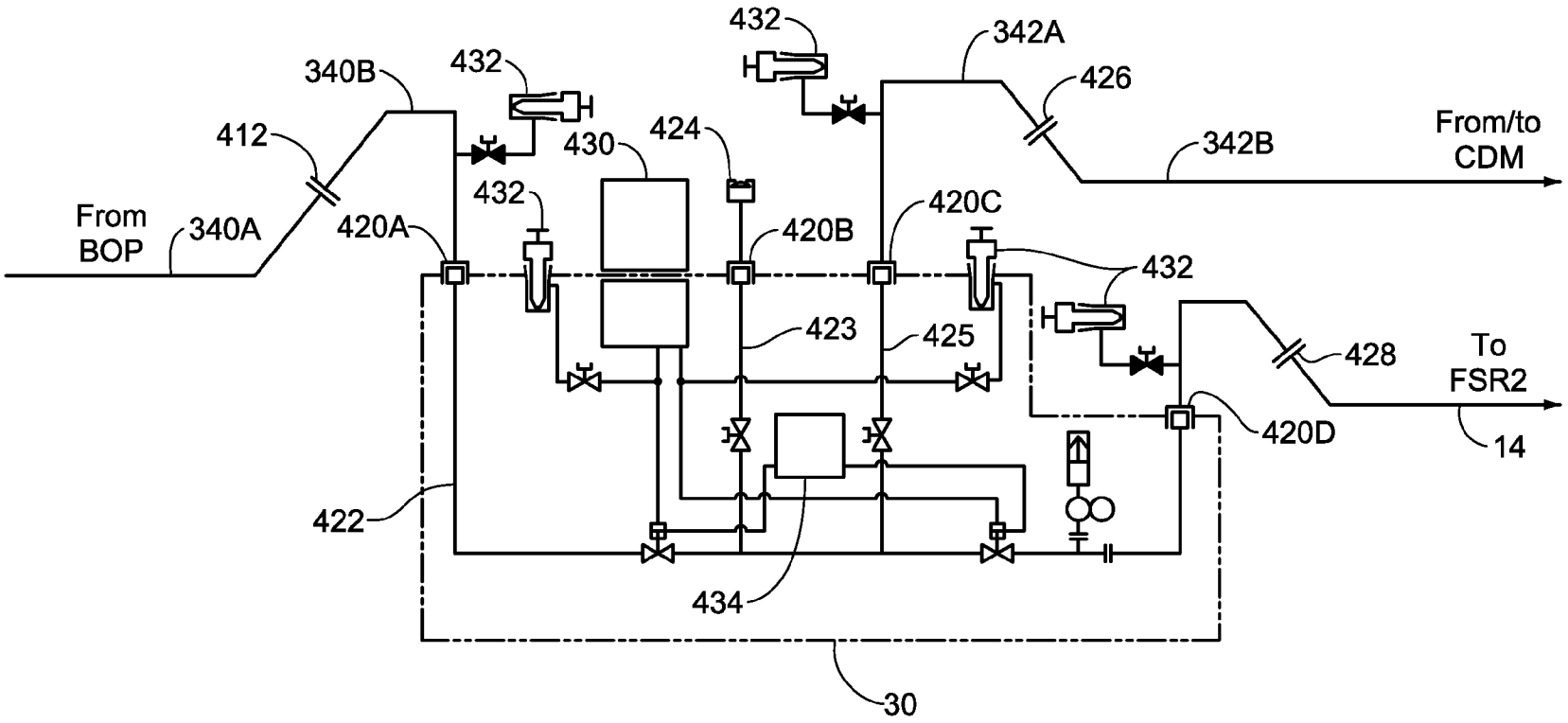
FIG. 22 is a schematic P&ID diagram of one embodiment of a stack manifold useful in certain embodiments of systems and methods of the present disclosure.

FIG. 22 is a schematic P&ID diagram of one embodiment of a stack manifold 30 useful in certain embodiments of systems and methods of the present disclosure. In this embodiment, stack manifold 30 includes four subsea connectors 420 A, B, C, and D. Connector 420A fluidly connects subsea conduit 340B from the BOP with main header 422 of stack manifold 30. An API flange 412 connects subsea flexible conduit 340A from the BOP to line 340B. Similarly, API flange 426 connects flexible subsea conduit 342B to line 342A, and to subsea connector 420C and gooseneck header 435. Header 423 connects to a burst disc 424 through subsea connector 420B. Line 422 connects to subsea flexible 14 trough subsea connector 420D and API flange 428. This embodiment also includes an ROV-operated control panel 430, and various API 17H or D hot stabs for pressure, temperature, and other measurements. Sea chest 434 is used as a pressure-balancing control with control valves as indicated.

Figure 23:
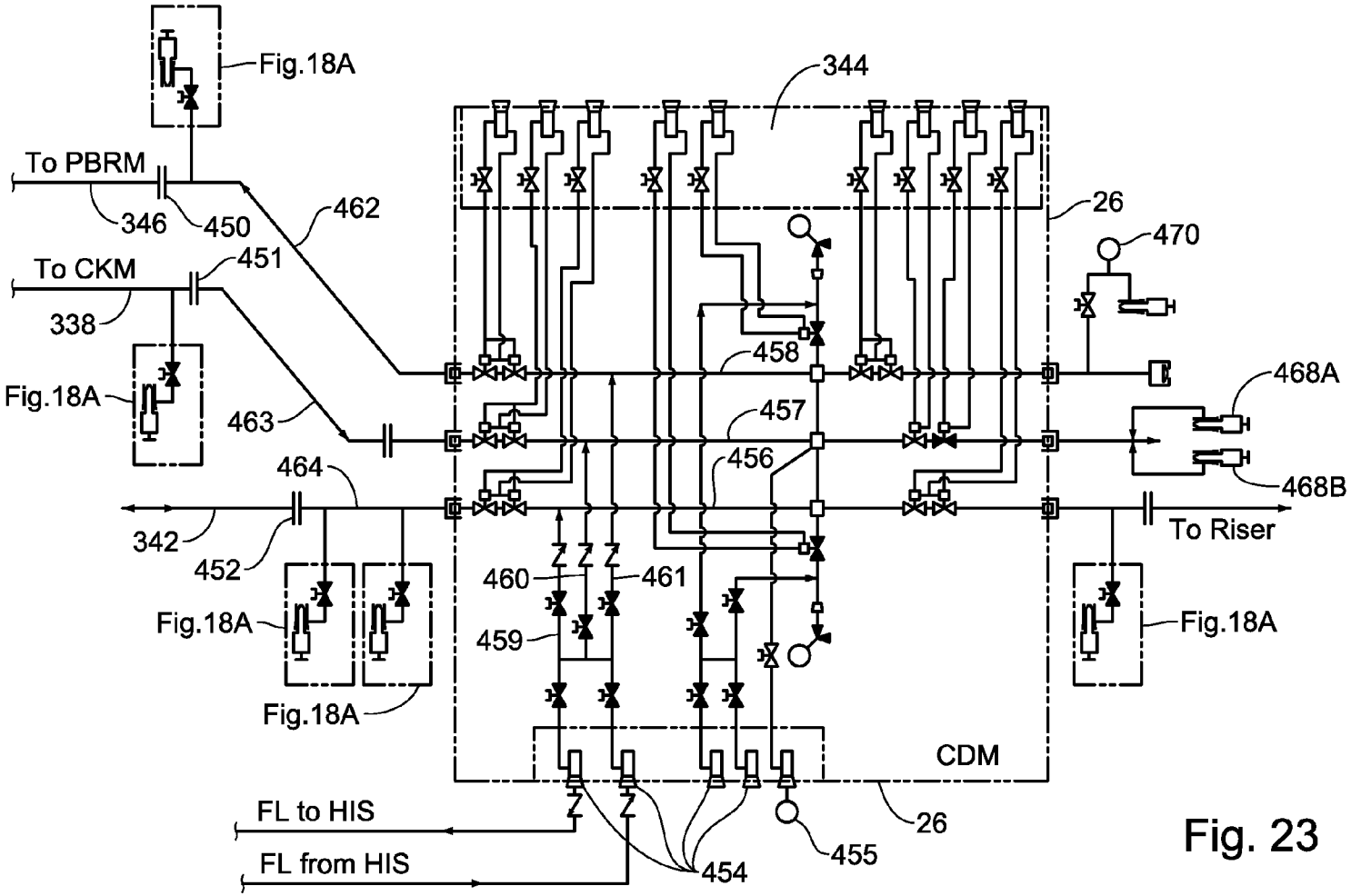
FIG. 23 is a schematic P&ID diagram of one embodiment of a choke/kill manifold useful in certain embodiments of systems and methods of the present disclosure, with FIG. 23A a more detailed schematic piping diagram of connections for supply of a hydrate inhibition chemical to the manifold.

FIG. 23 is a schematic P&ID diagram of one embodiment of a containment disposal manifold (CDM, 26) useful in certain embodiments of systems and methods of the present disclosure, which includes three main headers in this embodiment, 456, 457, and 458, where header 456 fluidly connects to gooseneck 456G through a subsea connector 456C. Similar connectors are employed for connecting header 457 to vent 468C, and header 458 to line 458A to burst disc 458C. Cross-over conduits 459, 460, and 461 allow a functional fluid, for example a hydrate inhibition chemical, such as methanol, to be pumped into the CDM and circulate back to the HIS for hydrate remediation and/or inhibition through ½-inch single port API 17D hot stab ports 454 (a pair of dummy or spare hot stabs 454 are provided). Another hot stab is provided for pressure monitoring, as indicated at 455.

Figure 23A:
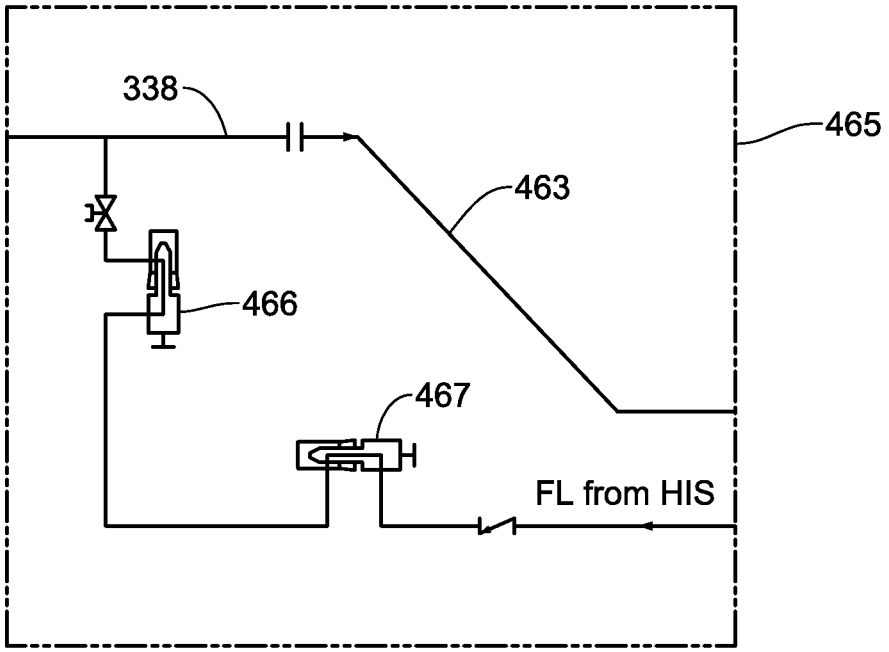

The embodiment of FIG. 23 may include flying leads "FL" from and to the HIS. A gooseneck 462 connects API flange 450 and CDM, while another gooseneck 463 connects an API flange 451 and the CDM. Another gooseneck 464 connects API flange 452 and the CDM. Detail A illustrates (in FIG. 23A) an ROV panel 465 on gooseneck 463, and includes the start-up configuration where hydrate inhibition chemical is initially pumped from the HIS into the various conduits in and leading to the CDM. FIG. 23A illustrates flexible conduit 338 connecting to gooseneck 463 through API flange 451. The start-up hydrate inhibition chemical supply arrangement may include a ¼-inch dual port API 17H hot stab receptacle 466 plumbed to a ½-inch single port API 17D high-flow hot stab receptacle 467 and a check valve 467A. Other hot stab arrangements indicated in FIG. 23 as "FIG. 23A" are similar valve and hot stab arrangements as illustrated in FIG. 23A.

Hot stabs 468A and B on vent line 468C may allow local pressure monitoring. FIG. 23B indicates a pressure monitoring arrangement on burst disc line 458A leading to burst disc 458C, including a ¼-inch (0.64 cm) dual port API 17H hot stab receptacle 458B, valve 458D, and pressure indicator 470.

Figure 24:
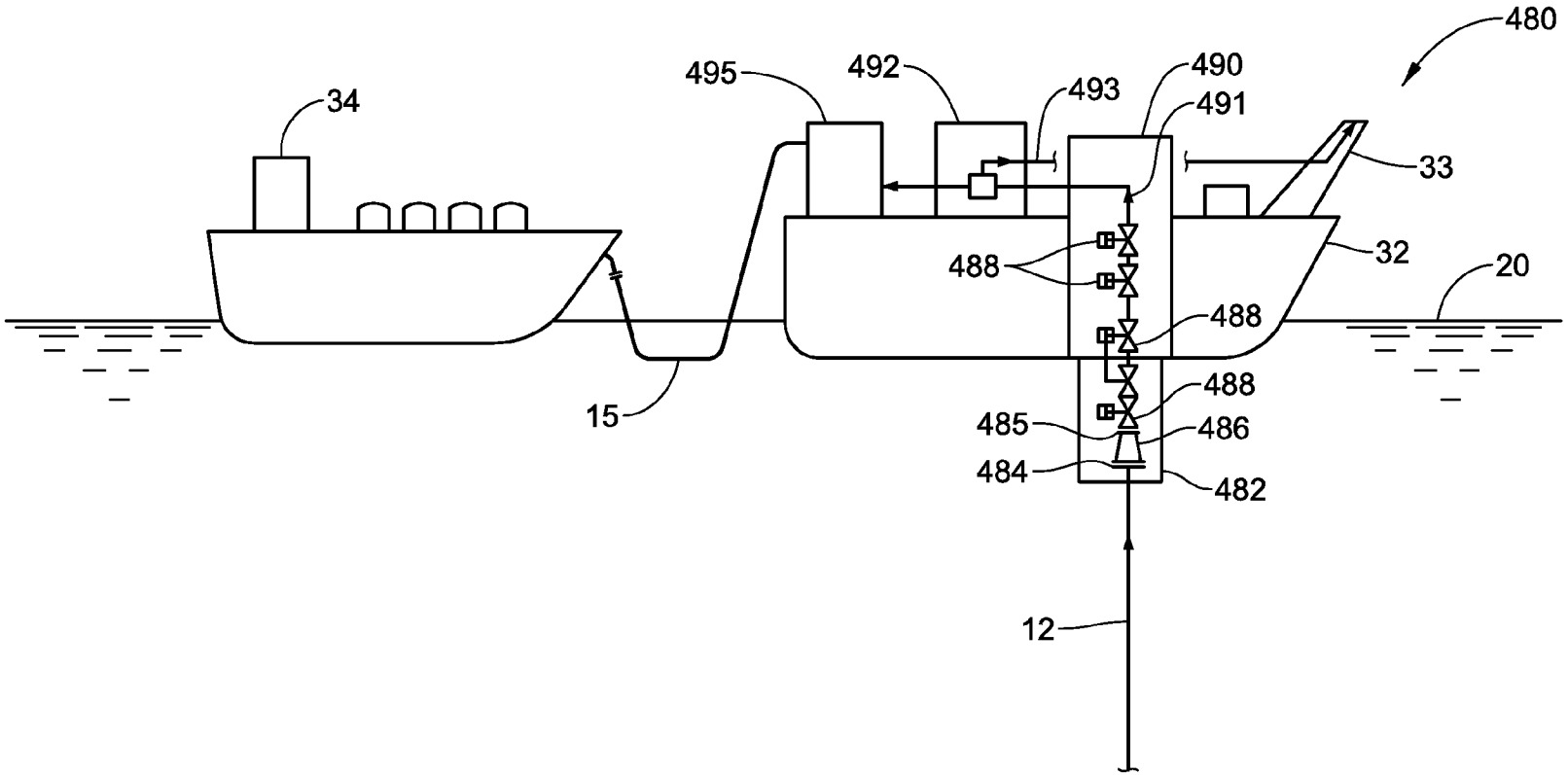
FIGS. 24 and 25 are schematic side elevation views of two arrangements of process and collection vessels useful in systems and methods of the present disclosure.
Figure 25:
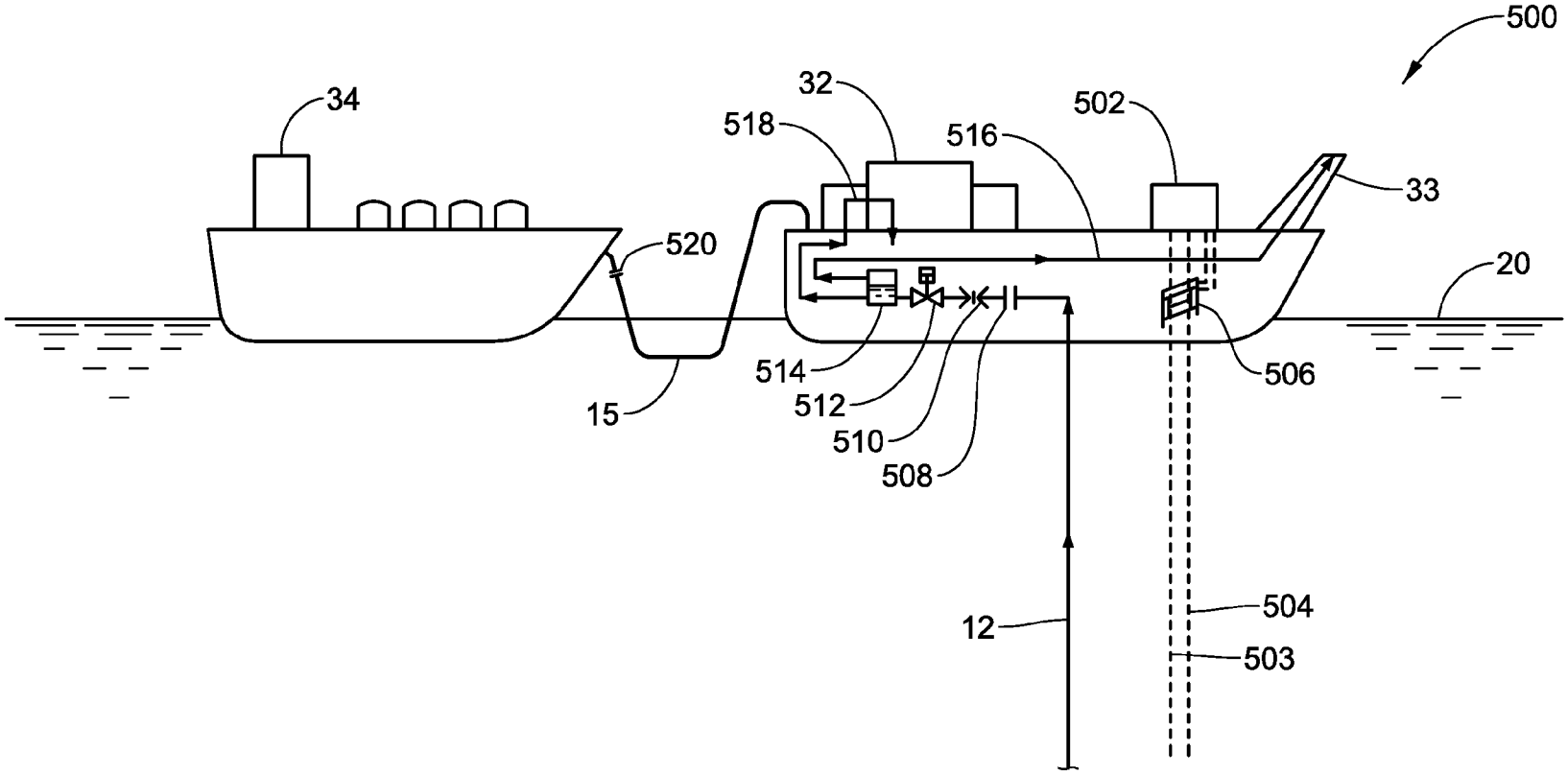

FIGS. 24 and 25 are schematic side elevation views of two arrangements of process and collection vessels useful in systems and methods of the present disclosure. Embodiment 480 illustrated schematically in FIG. 24 includes a quick connect/disconnect buoy 482, API flanges 484, 485, an adapter spool 486, and four pressure letdown valves 488. Embodiment 480 may further include a ship turret 490. A line 491 connects valves 488 to gas/liquid process unit 492, which separates gases from liquids in the containment stream, the gases proceeding through a line 493 to a flare 33 or other containment vessel, while liquids proceed to an accumulator 495, and on through flexible conduit 15 to collection vessel 34. Embodiment 500 illustrated in FIG. 25 is similar but does not include a quick connect/disconnect buoy, but rather includes a guillotine 506 which cuts ½-inch (1.3 cm) hydraulic hoses 503, 504 from the HPU to subsea equipment in an emergency situation. Lines 503 and 504 are supplied from HPU 502 on vessel 32. Also provided are an API hub connection 508, a quick connect/disconnect 510, and a backpressure control valve 512. Gas/liquid separation equipment 514 feeds a gas phase containment fluid to line 516 and a liquid phase containment fluid to line 518, which leads to storage inside vessel 32, and then passes through flexible 15 through a 20-inch (51 cm) NSCA (National Society for Clean Air (UK), now Environmental Protection UK) connector 520 to storage tanker 34. A control panel 501 is provided on vessel 32 (see FIG. 26A) for the HPU.

Figure 26A:
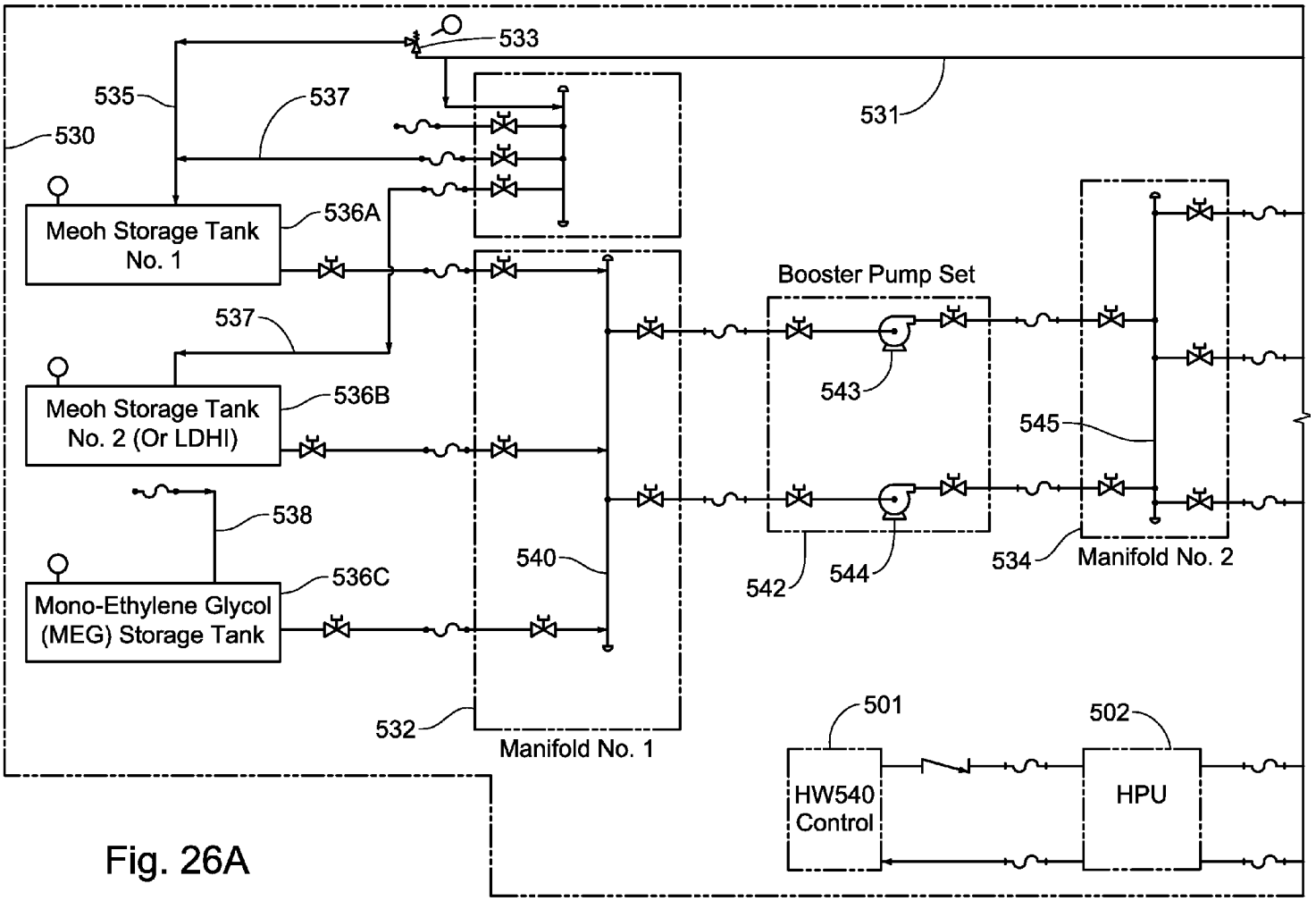
FIGS. 26A, 26B and 27 are a schematic P&ID diagrams of one embodiment of a hydrate inhibition system useful in certain embodiments of systems and methods of the present disclosure.
Figure 26B:
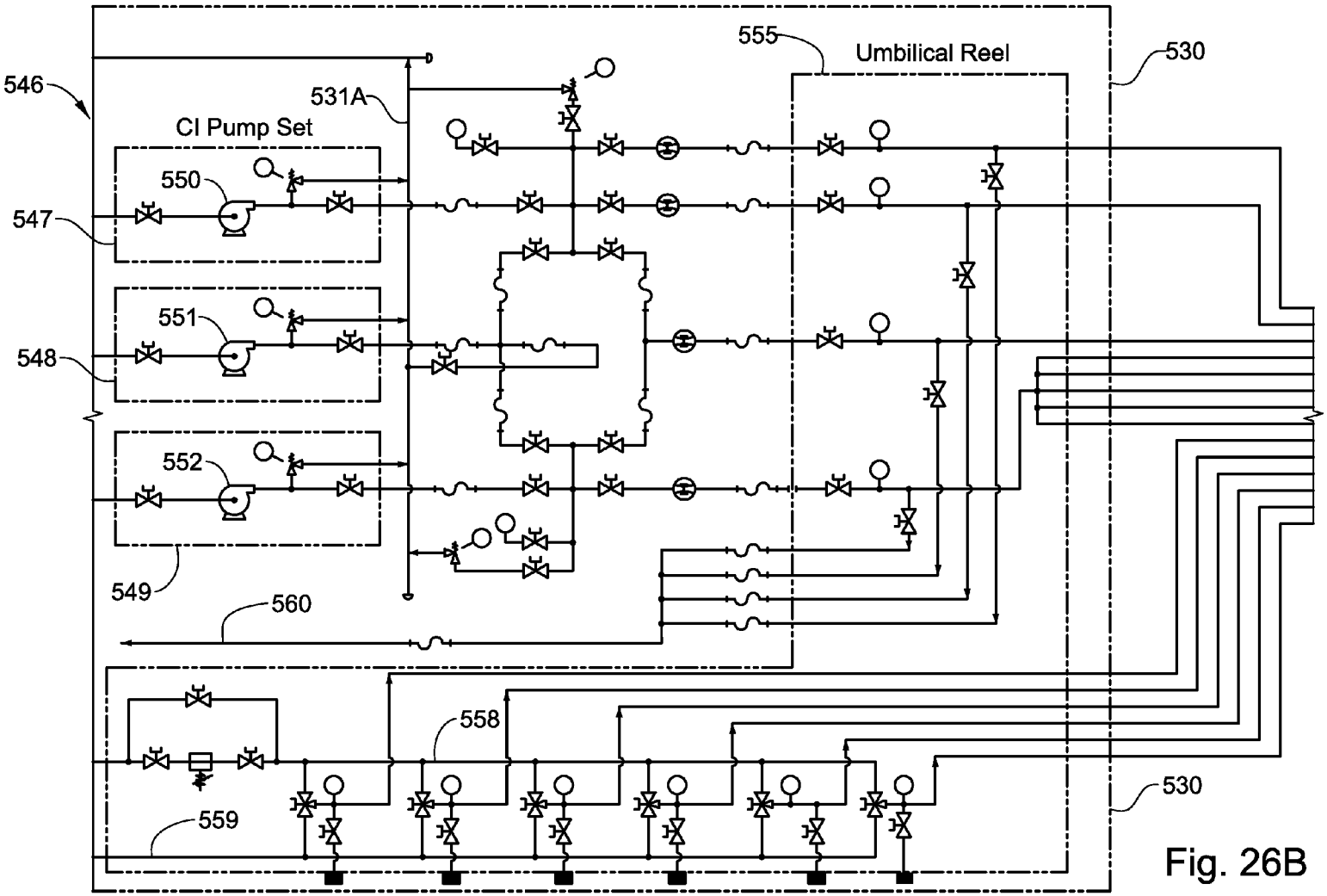
Figure 27:
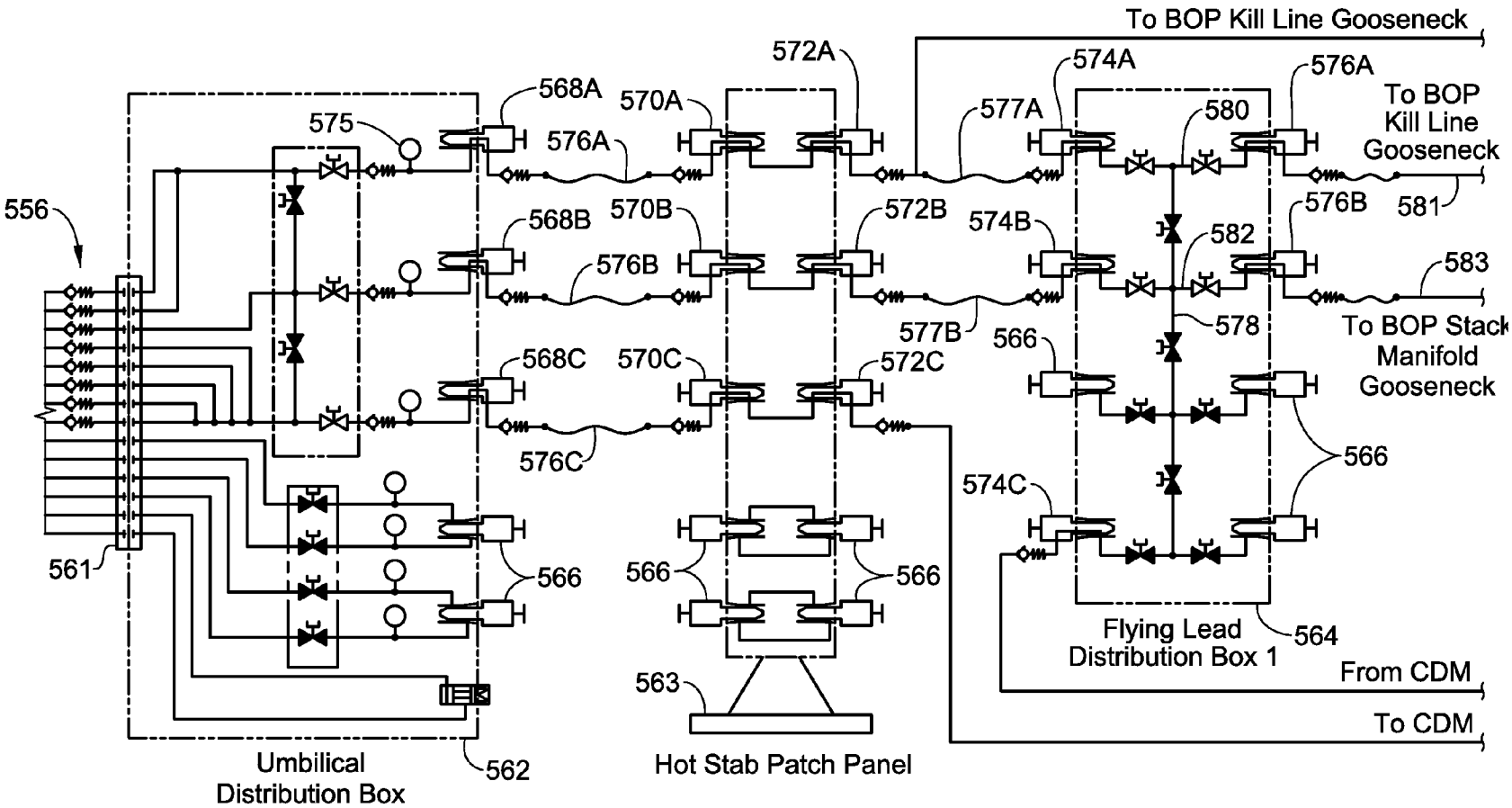

FIGS. 26A, 26B and 27 are a schematic P&ID diagram of one embodiment of a hydrate inhibition system (HIS) useful in certain embodiments of systems and methods of the present disclosure. The chemical tanks 536A, B, C, booster air-driven pumps 543, 544, and main chemical injection pumps 550, 551, 552 are located at the surface in this embodiment, in a vessel, as indicated by the outer dashed box 530 in FIGS. 26A and 26B. Manifold 532 and header 540 connect chemical tanks 536 to pumps in the booster pump area 542, and manifold 534 and header 545 connect booster pumps 543 and 544 fluidly with diesel-driven chemical injection pumps 550, 551, 552 located in pump areas 547, 548, 549. Chemicals are supplied to vessel 530 through separate bulk chemical supply vessels (or one bulk chemical supply vessel with separate tanks of different chemicals) as indicated at 537, 538. A pressure relief line 535 relieves through a pressure relief valve (PRV) 533 back into one of the surface vessel tanks 536A. An umbilical reel is indicated in dashed box 555. A pressure relief header 531A connects the discharge conduits of pumps 550, 551, 552 to relief header 531 and PRV 533. An HPU supply header 558 and return header 559 for hydraulic fluid are illustrated, which may be ½-inch (1.3 cm) diameter hoses, as well as a chemical return header 560. A plurality of hoses, in this embodiment eight hoses, are combined in one umbilical for hydrate chemical injection into subsea equipment, with another four hoses for hydraulic fluid, and two smaller diameter umbilicals for forwarding and retracting a cable cutting tool from the surface using a subsea ROV.

Referring now to FIG. 27, the subsea portion of the HIS may include a series of subsea connectors 561 connecting the chemical, hydraulic, and tool lines to a subsea umbilical distribution box (UDB) 562, which in turn fluidly connects hydrate inhibition chemical lines to a subsea hot stab patch panel 563 through as series of hot stabs 568A, B, C, 570A, B, C and jumpers 576A, B, and C. Another set of hot stabs 572A, B and 574A, B, and 576A, B may fluidly connect hot stab patch panel 563 to a flying lead distribution box 564 through jumpers 577A and B. Also illustrated are dummy or spare hot stabs 566, and flexible subsea conduits to and from the CDM. Cutting tool 584 is illustrated as part of the UDB, but it could just as well have its own dedicated UDB. Any number of subsea pressure indicators 575 may be provided, as indicated in the UDB. Flying lead distribution box 564 may include a primary header 578, and secondary headers 580, 582. Header 580 fluidly connects to a jumper 581, which fluidly connects to the BOP kill line gooseneck, controllably supplying hydrate inhibition fluid there through hot stab 576A. Similarly, header 582 fluidly connects to a jumper 583, which fluidly connects to the BOP stack manifold gooseneck, supplying hydrate inhibition chemical through hot stab 576B in a controllable fashion to that gooseneck.

Figure 28:
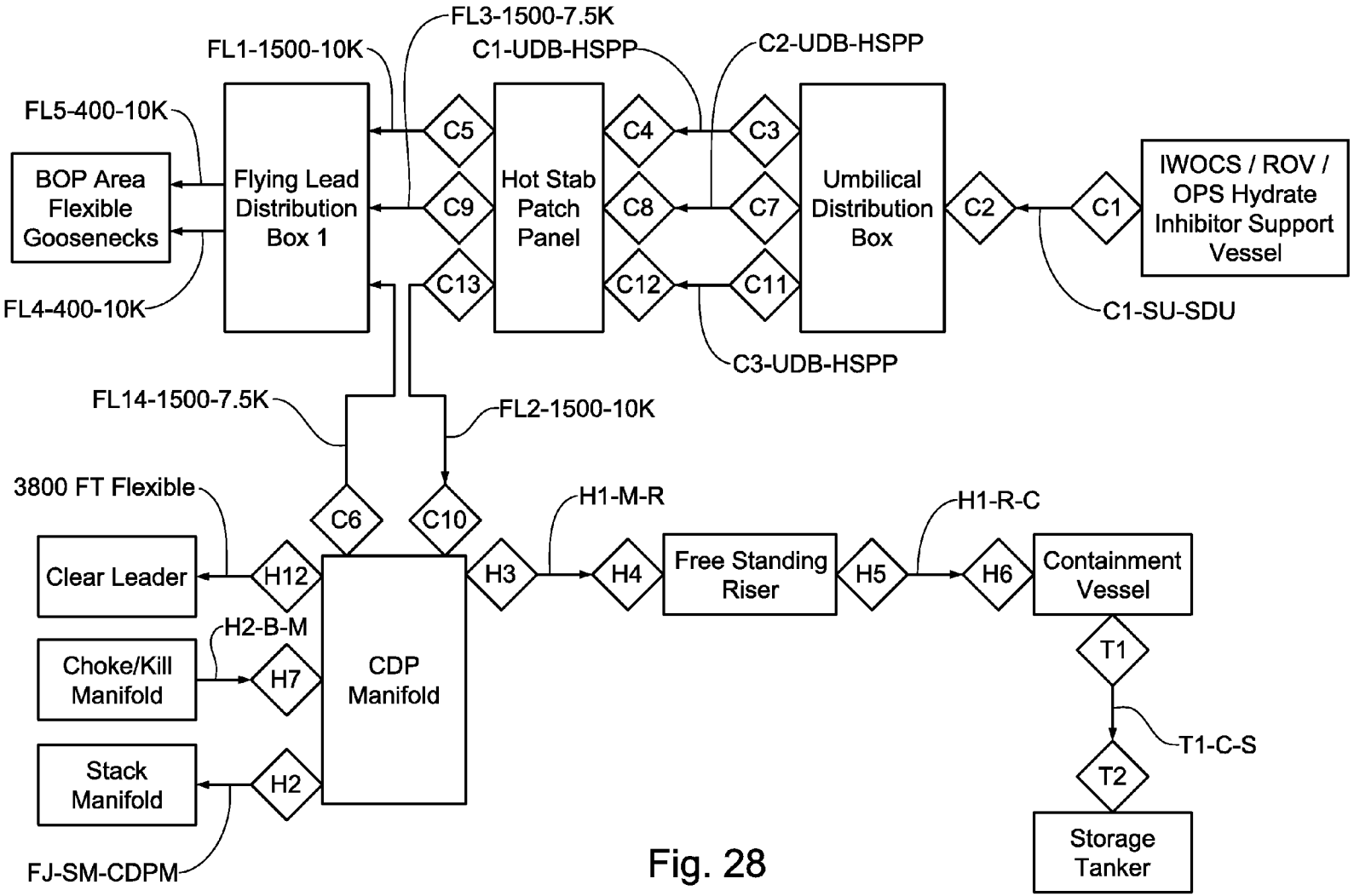
FIGS. 28 and 29 are schematic block diagrams illustrating two possible tie-in schedules for concentric free-standing riser systems in accordance with the present disclosure.
Figure 29:
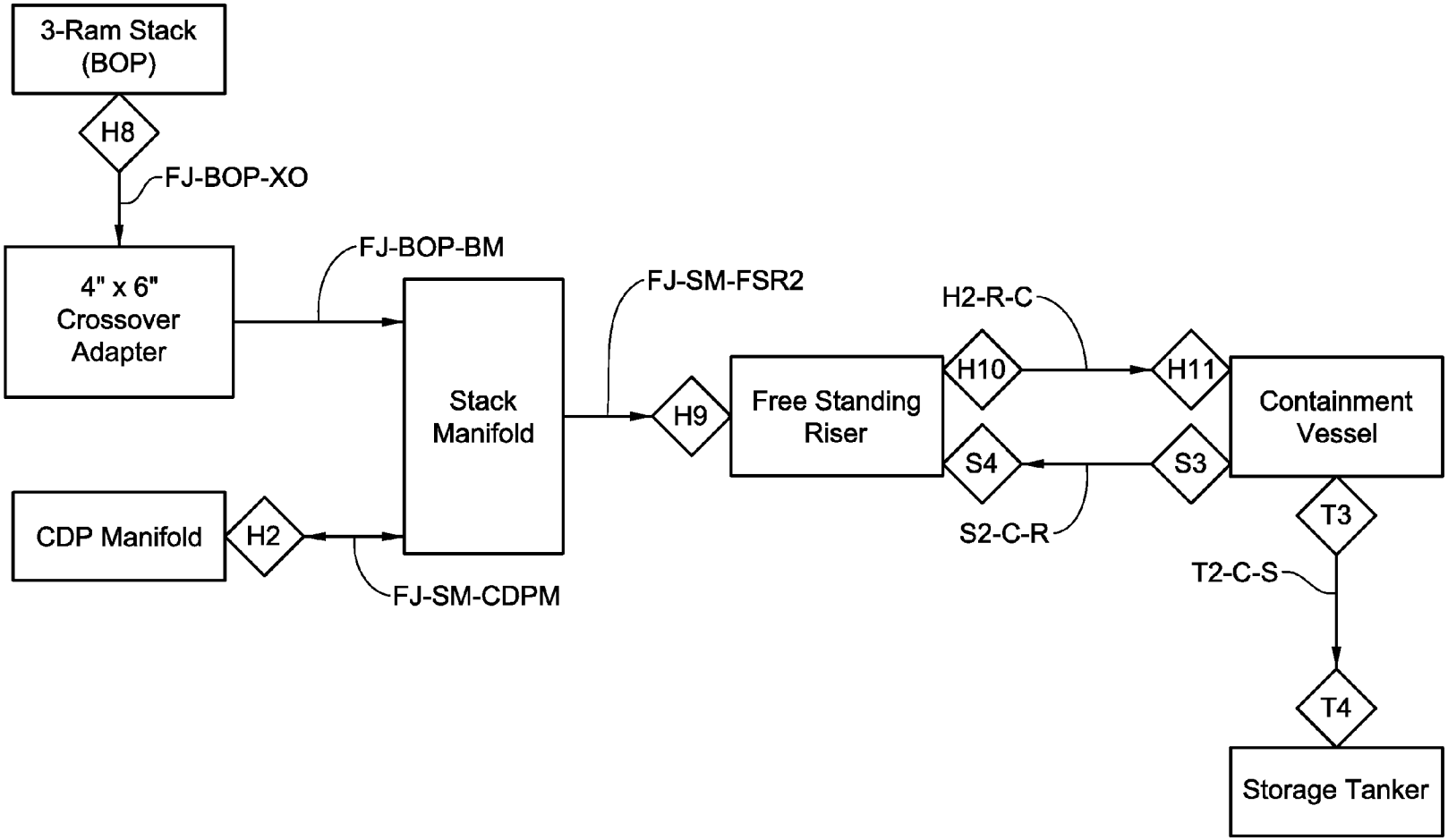

FIGS. 28 and 29 are schematic block diagrams illustrating two tie-in schedules for concentric free-standing riser systems 2 and 4 of FIG. 1 in accordance with the present disclosure.

In one embodiment, the aircan system configuration may comprise one primary aircan (available from SMB-IMODCO Inc., Houston, Tex., USA) with a U-slot, tension joint and chain/shackle tether. It may be a pressure balanced system installed flooded and aired up once in place by an ROV. The aircan may be comprised of 6 independent ballastable compartments, and when pressure balanced, may be run and used over a wide range of depths below mean water level. A 36-inch (91 cm) tension joint with thrust collar, pad eyes and shackles may provide the interface between the riser and the primary aircan. A secondary (auxiliary) aircan (for example manufactured by Dril-Quip Inc., Houston, Tex., USA) may be needed in order to provide additional buoyancy to the FSR system. A chain tether may be used as the interface between the primary and auxiliary aircans. Fully aired, the system may provide a buoyancy upthrust of 806 kips (3590 kilonewtons) (700 kips (3100 kilonewtons) SBM-IMODCO aircan+122 kips (542 kilonewtons) Drill-Quip aircan-13.4 kips (60 kilonewtons) wet weight of sealed tension joint-2.5 kips (11 kilonewtons) wet weight of Dril-Quip chain tether).

Certain systems and methods of the present disclosure may be scalable over a wide range of water depths, well pressures and conditions. In certain embodiments the FSRs may be capable of handling over 40,000 bbl. per day (about 4800 cubic meters per day) each with the 6-inch (15 cm) ID flow path in the inner riser. Existing dry tree riser hardware may be used to construct the FSRs. In these embodiments the outer riser joints may be 13.813-inch (35.085 cm) OD×0.563-inch (1.430 cm) wall thickness X-80 steel material and rated to 6,500 psi (45 MPa). X-80 material may be used in order to successfully weld on premium riser connectors that have external and internal metal-to-metal seals that meet the fatigue performance requirements of the anticipated service life. (X-80, or X80, is a number associated with API standard 5L.)

In general, in substantially concentric pipe-in-pipe risers useful in certain systems and methods of the present disclosure, the diameter of the outer riser may be dictated by the diameter of the inner riser, understanding that an annulus of certain inner and outer diameter is desired. In certain embodiments, for example, for temporary solutions, a single riser may be sufficient. Furthermore, more than two substantially concentric risers may be employed in certain embodiments. In embodiments having more than one substantially concentric riser, the inner-most riser may have an outer diameter (OD) ranging from about 1 inch up to about 50 inches (from about 2.5 cm up to about 127 cm), or from about 2 inches up to about 40 inches (from about 5 cm up to about 107 cm), or from about 4 inches up to about 30 inches (from about 10 cm up to about 76 cm), or from about 6 inches up to about 20 inches (from about 15 cm up to about 51 cm). The outer riser, in embodiments comprising two substantially concentric risers, may have an inner diameter (ID) such that the ratio of outer riser ID to inner riser OD may be at least 1.1, or at least 1.3, or at least 1.5, or at least 2.0, or at least 3.0 or higher. Ratios larger than 3.0 may be unacceptable from a cost viewpoint, or from a handling standpoint, but otherwise there is no upper boundary on this ratio.

Over the past several years, BP has participated in a comprehensive 15/20 Ksi (103/138 MPa) dry tree riser qualification program which focuses on demonstrating the suitability of using high strength steel materials and specially designed threaded and coupled (T&C) connections that are machined directly on the riser joints at the mill. See Shilling et al., "*Development of Fatigue Resistant Heavy Wall Riser Connectors for Deepwater HPHT Dry Tree Riser Systems*", OMAE2009-79518. These connections may eliminate the need for welding and facilitate the use of high strength materials like C-110 and C-125 metallurgies that are NACE qualified. (As used herein, "NACE" refers to the corrosion prevention organization formerly known as the National Association of Corrosion Engineers, now operating under the name NACE International, Houston, Tex.) Use of high strength steel and other high strength materials may reduce the wall thickness required, enabling riser systems to be designed to withstand pressures much greater than can be handled by X-80 materials and installed in much greater water depths due to the reduced weight and hence tension requirements. The T&C connections may eliminate the need for third party forgings and expensive welding. It will be understood, however, that the use of third party forgings and welding is not ruled out for risers, URAs, and LRAs described herein, and may actually be preferable in certain situations. The skilled artisan, having knowledge of the particular depth, pressure, temperature, and available materials, will be able design the most cost effective, safe, and operable system for each particular application without undue experimentation.

Using high strength steel materials and connectors to design a fully rated 15 ksi (103 MPa) FSR system in accordance with the present disclosure, the outer riser may actually be downsized from the 13.813-inch (35.085 cm) OD to 10.75-inch (27.31) OD×0.75-inch (1.91 cm) wall thickness, with a 7-inch (17.8 cm) OD×0.453 (1.15 cm) wall thickness C-110 inner riser. FIG. 14 shows the required air can tension for this FSR system from 5,000 foot to 10,000 foot water depth (1524 meters to 3048 meters depth).

Materials, Methods of Construction, and Installation

The risers and the primary components of the LRAs and URAs described herein (offtake spools, intake spools, hanger spools, generally cylindrical members, tubing heads, casing heads, tubing spools, high pressure subsea connectors, stem joints, riser stress joints, and the like) are largely comprised of steel alloys. While low alloy steels may be useful in certain embodiments where water depth is not greater than a few thousand (for example 5000) feet (about 1524 meters), activities in water of greater depths, with wells reaching 20,000 ft. (about 6000 meters) and beyond may be expected to result in above normal operating temperatures and pressures. In these "high temperature, high pressure" (HPHT) applications, high strength low alloy steel metallurgies such as C-110 and C-125 steel may be more appropriate.

The Research Partnership to Secure Energy for America (RPSEA) and Deepstar programs have initiated a long term, large scale prequalification program to develop databases of fatigue data for, and derive derating factors on, high strength materials for riser applications with the contribution of major operators, engineering firms and material vendors. High strength steels (such as X-100, C-110, Q-125, C-125, V-140), Titanium (such as Grade 29 and possibly newer alloys) and other possible material candidates in the higher strength category may be tested for pipe applications, and pending those results, they may be useful as materials for the risers, LRAs, and URAs described herein. Higher strength forging materials (such as F22, 4330M, Inconel 718 and Inconel 725) either have been or will soon be tested for component applications in the coming years, and may prove useful for one or more components of the described LRA and/or URA assemblies, and/or risers. The test matrix will be designed to reflect various production environments and different types of riser configurations, such as single catenary risers (SCR's), dry tree risers, and drilling and completion risers. The project is currently scheduled to be divided into three separate Phases. Phase 1 will address tensile and fracture toughness, FCGR and S-N tests (both smooth and notched) on strip specimens of high strength pipes, high strength forging materials and nickel base alloy forgings in air, seawater, seawater plus Cathodic Protection (CP) and sour environment (non-inhibited) and a completion fluid known as INSULGEL (BJ Services Company, USA) with sour environment (non-inhibited) contamination (2008). Phase 2 is scheduled to be Intermediate Scale Testing (2009), and Phase 3, Full Scale Testing with $H_2S/CO_2$/sea water (2010). For further information, please see Shilling, et al., *Development of Fatigue Resistant Heavy Wall Riser Connectors for Deepwater HPHT Dry Tree Riser Systems*, OMAE (2009) 79518 (copyright 2009 ASME). See also RPSEA RFP2007DW1403, *Fatigue Performance of High Strength Riser Materials*, Nov. 28, 2007. As stated previously, the skilled artisan, having knowledge of the particular depth, pressure, temperature, and available materials, will be able design the most cost effective, safe, and operable system for each particular application without undue experimentation.

Materials of construction for gaskets, flexible conduits, and hoses useful for constructing and using the systems and methods described herein will depend on the specific water depth, temperature and pressure at which they are employed. Although elastomeric gaskets may be employed in certain situations, metal gaskets have been increasingly used in subsea application. For a review of the art circa 1992, please see Milberger, et al., "*Evolution of Metal Seal Principles and Their Application in Subsea Drilling and Production*", OTC-6994, Offshore Technology Conference, Houston Tex., 1992. See also API Std 601—*Standard for Metallic Gaskets for Raised-face Pipe Flanges & Flanged Connections*, and API Spec 6A—*Specification for Wellhead and Christmas Tree Equipment.*

Gaskets are not, per se, a part of the present systems and methods, but as certain LRA and URA embodiments may employ gaskets (such as gasket 716 mentioned in connection with the LRA embodiment of FIG. 3J), mention is made of the following U.S. patents which describe gaskets which may be suitable for use in particular embodiments, as guided by the knowledge of the ordinary skilled artisan: U.S. Pat. Nos. 3,637,223, 3,918,485, 4,597,448, 4,294,477, and 7,467,663. In certain embodiments, the gasket material known as DX gasket rated for 20 ksi may be employed.

Another gasket that may be used subsea is that known under the trade designation Pikotek VCS, available from Pikotek, Inc., Wheat Ridge, Colo. (USA). This type of gasket is believed to be described in U.S. Pat. No. 4,776,600, incorporated by reference herein.

Various burst disks mentioned herein, such as burst disk 45 on CDM, burst disk 162 for the annulus, stack manifold burst disk 424, and CDM burst disk 458C, as well as additional burst disks not heretofore mentioned, may in certain embodiments be retrievable burst disks. In certain embodiments the URA may have a retrievable burst disk, allowing venting of the URA to the atmosphere. Burst disk 162 may allow, among other things, venting of the annulus above the LRA, and in certain embodiments may allow pumping of a functional fluid such as nitrogen into the annulus near the top of the FSR. Burst disks may allow pressure and/or temperature measurement of the flow stream (inside inner riser) or annulus between inner and outer risers. In addition to burst disks, high flow hot stabs may be employed in various equipment, for example, in the emergency disconnect systems.

Subsea flexible conduits, sometimes referred to herein as simply as "flexibles", or "flexible jumpers", are known to skilled artisans in the subsea hydrocarbon drilling and production art. For example, U.S. Pat. No. 6,039,083 discloses that flexible conduits are commonly employed to convey liquids and gases between submerged pipelines and offshore oil and gas production facilities and other installations. U.S. Pat. No. 6,263,982 discloses subsea flexible conduits may comprise a flexible steel pipe such as manufactured by Coflexip International of France, under the trade designation "COFLEXIP", such as their 5-inch (12.7 cm) internal diameter flexible pipe, or shorter segments of rigid pipe connected by flexible joints and other flexible conduit known to those of skill in the art. Other patents of interest, assigned to Coflexip and/or Coflexip International, are U.S. Pat. Nos. 6,282,933; 6,067,829; 6,401,760; 6,016,847; 6,053,213 and 5,514,312. Other possibly useful flexible conduits are described in U.S. Pat. No. 7,770,603, assigned to Technip, Paris, France. U.S. Pat. No. 7,445,030, also assigned to Technip, describes a flexible tubular pipe comprising successive independent layers including helical coils of strips or different sections and at least one polymer sheath. At least one of the coils is a strip or strips of polytetrafluoroethylene (PTFE). This list is not meant to be inclusive of all flexible conduits useable in systems and methods of the present disclosure.

Hoses, which may also be referred to herein as flexible jumpers in certain embodiments, suitable for use in the systems and methods of this disclosure may be selected from a variety of materials or combination of materials suitable for subsea use, in other words having high temperature resistance, high chemical resistance and low permeation rates. Some fluoropolymers and nylons are particularly suitable for this application except for conduits of extremely long length (several kilometers or more) where permeation may be problematic. A good survey of hoses and materials may be found in U.S. Pat. No. 6,901,968, presently assigned to Oceaneering International Services, London, Great Britain, which describes so called "High Collapse Resistant Hoses" of the type used in deep sea applications, which, in use, must be able to resist collapsing due to the very large pressures exerted thereon. In certain embodiments it may be necessary or desirable to splice one hose to another hose, or to replace a damaged hose. In these instances, the ROV-operable hose splicing devices of assignee's U.S. provisional patent app. Ser. Nos. 61/479,486 and 61/479,489, both filed Apr. 27, 2011, may be useful. The '489 application describes ROV-operable hydraulically-powered hose splicing devices, while the '486 application describes ROV-operable non-hydraulically-powered (mechanical) hose splicing devices. Each device may provide a full-bore connector while allowing full-pressure service. A simple stab motion employing a guide funnel minimizes the dexterity required of the ROV pilot. The hydraulically-powered devices include at least two chambers and a least one self-engaging mechanical lock per chamber, wherein after a hose is stabbed into a chamber, the ROV pilot energizes the device and the connection is made without further need to move the ROV manipulators, and the hydraulic pressure can be released from the chambers. An ROV hotstab may be used in certain embodiments to connect the device to an ROV hydraulic power unit to energize and operate the device.

Systems of the present disclosure may, in certain embodiments, be installed by a MODU and then accommodate flexible jumper installation after the pipe-in-pipe riser has been run. In embodiments using a MODU, the upper flexible may be connected to the URA during installation from the MODU and clamped at intervals hanging vertically along the riser. The lower subsea flexible may be connected later to the LRA by one or more subsea installation vessels, for example one or more ROVs or AUVs, after the FSR is connected and tensioned to the suction pile.

In certain embodiments, riser tension may be maintained using a non-integral aircan system chain tethered above the riser string. The aircans may provide the necessary buoyancy upthrust required for global stability and motion performance control and may ensure that positive 100 kips (445 kilonewtons) effective tension is experienced at the base of the riser under all loading conditions, including failure of one or more aircan chambers. As noted previously, however, pneumatic-hydraulic tensioners may augment or replace air-cans.

The containment vessel may be equipped with a quick disconnect/connect system (QDC system) for the upper flexible. A disconnectable buoy may be used to support the vessel end of the upper flexible during an emergency disconnect. The buoy may be attached to provide both buoyancy and drag and ensure the upper flexible is not damaged by too rapid a decent (i.e. excessive compression exceeding the minimum bend radius) after it released to free fall in the water column. In the event of a planned or unplanned disconnect, the upper flexible may be disconnected from the containment vessel in a controlled manner and lowered by a support vessel to hang along the side of the FSR, where it may be clamped in place via ROV.

In certain embodiments both FSR 1 and FSR 2 may be capable of 10,000 psia (70 MPa) extreme operating pressure load cases, and upwards of 12,000 psi (84 MPa) for survival pressure load cases. The FSR's may be designed to survive a 100 year hurricane, 100 year winter storm or a 100 year loop current in their undamaged condition and 10 year loop currents with 1 air can chamber damaged.

In certain embodiments the upper riser assembly may allow for flow control of both the inner riser, as well as the annulus between the inner and outer riser. The inner riser flow path may have provisions for pressure and temperature sensors; a fail close hydraulic actuated emergency shutdown valve controlled from the surface vessel; a ROV hot stab pressure bleed port; and an ROV operated manual gate valve. The annulus may incorporate provisions for ROV hot stab nitrogen injection, and one or more temperature and pressure sensors. A pressure safety valve (PSV) set at 4,500 psi (31 MPa) on the riser annulus may prevent failure due to overpressure of the outer riser in the event of a hydrocarbon leak from the inner riser.

In certain embodiments the lower riser assembly may provide ROV hot stab access to both the riser annulus and production flow path for injection, venting, pressure and temperature monitoring. In certain embodiments two ROV operated 3-inch (7.6 cm) valves on the annulus vent sub may provide larger bore access to the annulus for nitrogen purging and venting operations. In certain embodiments the lower riser assembly flow path may be comprised of two spools, each equipped with an ROV operated 5-inch (12.7 cm) 10 Ksi (69 MPa) valves and ROV operated clamps (such as available from Vector Subsea) for subsea connection of flexible production jumpers.

In certain embodiments, conventional pressure relief valves (or pressure safety valves) may be modified and employed subsea, for example on various subsea manifolds, risers, and URA and LRA. Conventional surface pressure relief valves may include a three-way valve body, a bonnet enclosing a spring, and a cap enclosing an adjusting screw for the spring, a nozzle and seat arrangement in the inlet, and an open discharge outlet. The bonnet typically has a removable plug. These conventional pressure relief valves may be modified or "marinized" by removing the removable plug in the bonnet and drilling one or more holes in the cap. This allows seawater to enter the cap and bonnet, equalizing pressure there with pressure in the discharge outlet (local pressure at depth). The spring and nozzle in these modified pressure relief valves may be changed to a material more compatible with seawater and hydrocarbon use to avoid corrosion issues. Embodiments of modified or "marinized" pressure safety valves are described in assignee's U.S. provisional patent application Ser. No. 61/479,693, filed Apr. 27, 2011.

To limit the corrosion issues, rather than drilling one or more holes in the cap and removing the plug from conventional pressure relief valves, a dead weight arrangement may be employed. A guided weight system may be added to the conventional design, whereby a dead weight (for example a block of metal) is placed in contact with the bonnet on its top, and the spring is removed. One or more guides might guide the weight. Weights could be added or removed subsea, for example by an ROV. The weight may seal to the upper opening of the bonnet via any of various very hard and wear-resistant alloys, such as Inconel 625 overlaid by the material known under the trade designation Stellite, which is an alloy containing cobalt, chromium, carbon, tungsten, and molybdenum. As a rough example, a pressure relief valve having a 3 inch (7.6 cm) diameter nozzle set to relieve at 500 psi (3.4 MPa) would require a steel weight 710 mm in diameter, 600 mm thick, weighing about 1,800 kg. Embodiments of this type of pressure safety valve are described in assignee's U.S. provisional patent application Ser. No. 61/479,671, filed Apr. 27, 2011.

In certain embodiments a source point interface may be required to connect the FSR to a source. For example, in the event of a blowout, in certain embodiments, a riser may be damaged and in some cases may be laying on the seabed. A riser insertion tube may be employed in those instances, the riser insertion tube connecting via a flexible conduit to a new riser or other temporary riser, such as a seabed-secured polished bore receptacle (PBR), as in FIG. 18, and more fully described in assignee's U.S. provisional patent application Ser. No. 61/479,695, filed Apr. 27, 2011. Riser insertion tubes and methods of use are described in assignee's U.S. provisional patent application Ser. Nos. 61/479,769 and 61/479,704, both filed Apr. 27, 2011. If a source is on a BOP, a latch cap may be employed to latch onto the top connection of the BOP, such as described in assignee's U.S. provisional patent application Ser. No. 61/498,933, filed Jun. 20, 2011. In certain embodiments, a transition spool as described in assignee's U.S. provisional patent Application Ser. No. 61/475,032, filed Apr. 13, 2011, may be employed to attach a second BOP or lower marine riser package (LMRP). Subsea connectors such as those known under the trade designation OPTIMA mentioned herein may be employed at an interface between a flexjoint and the LMRP. The patent applications mentioned in this paragraph are incorporated herein by reference. If a PBR is used, a modified bumper sub having both telescoping action as well as swivel action may be employed between the PBR and a surface vessel, such as described in assignee's U.S. non-provisional patent application Ser. No. 13/457,021, filed Apr. 26, 2012.

It may be necessary to evacuate surface vessels and personnel from a particular area above or near a subsea containment disposal site during containment operations due to hurricane, cyclone, or other weather system. In this event, there may be a requirement to vent hydrocarbons in order to control well pressure. During any such release of hydrocarbons, certain embodiments of systems and methods of the present disclosure provide for subsea automatic dispersant injection (continuous or discontinuous) to 1) ensure that surface volatile organic compounds (VOCs) and lower explosion limits (LELs) do not create a hazardous working environment that prevents the rapid resumption of containment operations, and 2) minimize the requirement for subsequent surface dispersant operations, reducing the total volume of dispersant chemical required.

Various embodiments and features of suitable subsea automatic dispersant chemical injection systems and methods are described in assignee's U.S. provisional patent application Ser. No. 61/475,032, filed Apr. 13, 2011. Examples of two dispersants that may be useful in the methods and systems disclosed herein may be found in Table 1. These dispersants are available from Nalco Company, Naperville, Ill., USA.

TABLE 1

Ingredients in COREXIT ® 9500 and 9527 brand dispersants

| CAS Registry Number | Chemical Name |
|---|---|
| 57-55-6 | 1,2-Propanediol |
| 111-76-2 | Ethanol, 2-butoxy-* |
| 577-11-7 | Butanedioic acid, 2-sulfo-, 1,4-bis(2-ethylhexyl) ester, sodium salt (1:1) |
| 1338-43-8 | Sorbitan, mono-(9Z)-9-octadecenoate |
| 9005-65-6 | Sorbitan, mono-(9Z)-9-octadecenoate, poly(oxy-1,2-thanediyl) derivs. |
| 9005-70-3 | Sorbitan, tri-(9Z)-9-octadecenoate, poly(oxy-1,2-ethanediyl) derivs |
| 29911-28-2 | 2-Propanol, 1-(2-butoxy-1-methylethoxy)- |
| 64742-47-8 | Distillates (petroleum), hydrotreated light |

*Note:
This chemical component is not included in the composition of COREXIT 9500.

Systems within the present disclosure may take advantage of existing components of an existing BOP stack, such as flexible joints, riser adapter mandrel and flexible hoses including the BOP's hydraulic pumping unit (HPU). Also, the subsea tree's existing Installation WorkOver Control System (IWOCS) umbilical and HPU may be used in conjunction with a subsea control system comprising umbilical termination assembly (UTA), ROV panel, accumulators and solenoid valves, acoustic backup subsystems, subsea emergency disconnect assembly (SEDA), hydraulic/electric flying leads, and the like, or one or more of these components supplied with the system.

Systems and methods of this disclosure may include well intervention operations. Well intervention operations may proceed via slickline, e-line, coiled tubing or drill pipe (provided the surface arrangement includes a hydraulic workover unit).

The systems and methods described herein may provide other benefits, and the methods are not limited to particular end uses; other obvious variations of the apparatus, systems and methods may be employed.

From the foregoing detailed description of specific embodiments, it should be apparent that patentable methods, systems and apparatus have been described. Although specific embodiments of the disclosure have been described herein in some detail, this has been done solely for the purposes of describing various features and aspects of the methods, systems and apparatus, and is not intended to be limiting with respect to the scope of the methods, systems and apparatus. It is contemplated that various substitutions, alterations, and/or modifications, including but not limited to those implementation variations which may have been suggested herein, may be made to the described embodiments without departing from the scope of the appended claims.

What is claimed is:

1. A free-standing riser system connecting a subsea hydrocarbon fluid source to a surface structure, the system comprising:

a concentric free-standing riser comprising inner and outer risers defining an annulus there between, a lower end of the riser fluidly coupled to the subsea source through a lower riser assembly (LRA) and one or more subsea flexible conduits, and an upper end of the riser coupled to a subsea buoyancy assembly and fluidly coupled to the surface structure through an upper riser assembly (URA) and one or more upper flexible conduits;

wherein the LRA comprises a first generally cylindrical member having a longitudinal bore, a lower end, an upper end, and an external generally cylindrical surface, wherein the first generally cylindrical member comprises a plurality of intake ports extending from the external surface to the bore and configured to flow hydrocarbons from the hydrocarbon fluid source and inflow of a functional fluid, wherein at least one of the intake ports is fluidly connected to an LRA production wing valve assembly, wherein the upper end of the first generally cylindrical member comprises a profile fluidly coupled to the free-standing riser, wherein the lower end of the first generally cylindrical member comprises a connector coupled to a seabed mooring;

wherein the URA comprises a second generally cylindrical member having a longitudinal bore, a lower end, an upper end, and an external generally cylindrical surface, wherein the second generally cylindrical member comprises a plurality of outtake ports extending from the bore to the external surface and configured to flow hydrocarbons from the riser, and at least one port configured to flow a functional fluid into the annulus, wherein at least one of the outtake ports is fluidly connected to a URA production wing valve assembly to fluidly couple the second generally cylindrical member with the upper flexible conduit, wherein the upper end of the generally cylindrical second member comprises a connector coupled to the subsea buoyancy assembly, and wherein the lower end of the second generally cylindrical member comprises a profile fluidly coupled to the free-standing riser.

2. The free-standing riser system according to claim 1, wherein the LRA generally cylindrical member comprises a subsea wellhead housing having a lower end and an upper end, the lower end fluidly connected to a transition joint, the transition joint capped with a first pad eye end forging serving as an anchor point for the free-standing riser, the transition joint comprising said one or more intake ports, at least one of the intake ports fluidly connected to the LRA production wing valve assembly and to an internal tieback connector, the internal tieback connector fluidly connected to the inner riser, the upper end of the subsea wellhead housing fluidly connected to an LRA external tieback connector fluidly connecting the subsea wellhead housing to a riser stress joint, the riser stress joint in turn fluidly connected to the outer riser.

3. The free-standing riser system according to claim 1, wherein the URA comprises a drilling spool adapter fluidly connected at a first end to the free-standing riser and a second end fluidly connected to a tubing head comprising one or more outtake ports, the tubing head connected at a lower end to a casing head, and the casing head connected to a shackle flange adapter capped on its top with a second pad eye end forging serving as an attachment point of the free-standing riser to the buoyancy assembly, the URA production wing valve assembly fluidly connected to one of the outtake ports and to the collection vessel through one of the upper flexible conduits.

4. The free-standing riser system according to claim 1, wherein the subsea source is a failed subsea blowout preventer.

5. The free-standing riser system according to claim 1, wherein the LRA further comprises a hub assembly fluidly connecting the LRA production wing valve assembly with one of the subsea flexible conduits.

6. The free-standing riser system according to claim 2, the transition joint further comprising one or more hot stab ports for ROV intervention and/or maintenance.

7. The free-standing riser system according to claim 2, the transition joint further comprising one or more ports allowing pressure and/or temperature monitoring.

8. The free-standing riser system according to claim 1, further comprising an annulus vent sub coupled to the free-standing riser below the URA, wherein the annulus vent sub includes an annulus valve in fluid communication with the annulus, wherein the annulus valve is configured to be transitioned by a remote operated vehicle (ROV) between an open position allowing access to the annulus through the annulus vent sub and a closed position preventing access to the annulus through the annulus vent sub.

9. The free-standing riser system according to claim 1, wherein at least some portions of the inner and outer risers comprise sections of pipe joined by threaded joints.

10. The free-standing riser system according to claim 1, wherein the URA production wing valve assembly comprises at least one emergency shutdown valve (ESD) selected from the group consisting of one hydraulically-operated ESD, one electrically-operated ESD, and one hydraulically-operated ESD and one electrically-operated ESD where both ESDs are controlled using an umbilical connected to a collection vessel at the surface.

11. The free-standing riser system according to claim 1, wherein the URA production wing valve assembly comprises first and second flow control valves for controlling flow in the inner riser and in the annulus.

12. The free-standing riser system according to claim 1, wherein the inner and outer risers are constructed using high strength steel tubulars using threaded coupled connectors.

13. The free-standing riser system according to claim 1, wherein the lower subsea flexible conduits each comprise a lazy wave flexible jumper with distributed buoyancy modules connected from the base of the FSR to a subsea manifold on the seafloor, the manifold fluidly connected to the subsea source or sources.

14. The free-standing riser system according to claim 2, wherein the internal tieback connector comprises a nose seal which seals into a subsea wellhead profile of the subsea wellhead, the internal tieback connector also latching with dogs both to the subsea wellhead housing and to the riser stress joint in order to create a preloaded structural connection between the subsea wellhead housing and the internal and external tieback connectors, and optionally including an external connector latch which latches the internal tie-back connector to the subsea wellhead housing, the nose seal providing pressure integrity between an internal flow path in the inner riser and the annulus between the inner and outer risers.

15. The free-standing riser system according to claim 1, further comprising a suction pile foundation in the seabed, the suction pile foundation comprising a plunger and a chain tether connecting the plunger to the LRA.

16. The free-standing riser system according to claim 1, further comprising external wet insulation on the outer riser for flow assurance.

17. The free-standing riser system according to claim 1, further comprising a flow assurance fluid in the annulus between the inner and outer riser, the flow assurance fluid selected from the group consisting of nitrogen or other gas phase, heated seawater or other water, or organic chemicals such as methanol, and the like.

18. The free-standing riser system according to claim 1, further comprising external wet insulation on the outer riser and a flow assurance fluid in the annulus between the inner and outer riser for flow assurance.

19. The free-standing riser system according to claim 3, further comprising an inner riser adjustable hanger fluidly connecting the inner riser to the upper riser assembly.

20. The free-standing riser system according to claim 1, wherein the buoyancy assembly comprises one or more air cans.

21. The free-standing riser system according to claim 20, wherein the one or more air cans comprises a non-integral air can system comprising a primary and one or more auxiliary air cans to provide failed chamber redundancy.

22. The free-standing riser system according to claim 10, wherein the URA production wing valve assembly comprises both hydraulic and ROV-operated emergency shutdown valves.

23. The free-standing riser system according to claim 1, wherein the URA production wing valve assembly comprises one or more ROV hot-stab ports allowing a flow assurance fluid to flow into both the inner riser and the annulus, the flow assurance fluid selected from the group consisting of nitrogen or other gas phase, heated seawater or other water, or organic chemicals such as methanol, and the like.

24. The free-standing riser system according to claim 1, wherein the one or more upper flexible conduits comprises one or more flexible surface jumpers comprising a quick disconnect coupling allowing it to be disconnected from the floating production and storage vessel in an either an emergency or planned event (i.e. drive/drift off or hurricane evacuation).

25. The free-standing riser system according to claim 1, wherein the outer riser comprises one or more clamps for immobilizing the upper flexible conduits adjacent the outer riser.

26. The free-standing riser system according to claim 1, wherein the system comprises two or more concentric risers positioned laterally apart in the sea, each separately attached to its own respective ship-based floating production and storage facility, and to the same or different subsea source or sources.

27. The free-standing riser system according to claim 1, wherein the system comprises a hydrate inhibition system fluidly connected to the subsea source.

28. The free-standing riser system according to claim 1, wherein the LRA generally cylindrical member comprises a forged high-strength steel member fluidly connected to a production riser pup joint via a lower cross-over joint and threaded connector, and a pad eye flange allowing connection of the forged high-strength steel member to a pile assembly on the seabed.

29. The free-standing riser system according to claim 28, the LRA further comprising dual clamp supports for supporting respective dual subsea connectors, the connector fluidly connecting to two production wing valves assemblies, each fluidly connected to the forged high-strength steel member through respective block elbows.

30. The free-standing riser system according to claim 29, wherein each production wing valve assembly includes an ROV-operable valve.

31. The free-standing riser system according to claim 30, the LRA further comprising an additional assembly or sub fluidly connecting to the forged high-strength steel member through a third block elbow, the additional assembly or sub providing a fluid connection to a source of a functional fluid, such as a flow assurance fluid or other fluid.

32. The free-standing riser system according to claim 31, the LRA further comprising a hot stab assembly for injection of a functional fluid, the hot stab assembly allowing for a smaller flow rate of functional fluid than is possible through the additional assembly or sub.

33. The free-standing riser system according to claim 32, the forged high-strength steel member further comprising an internal surface, at least a portion of which is threaded, to threadedly engage mating threads of a tieback ring, the tieback ring including at least one set of internal threads which mate with a set of threads on the inner riser, and further including a seal element comprised of Inconel or other corrosion-resistant metal.

34. The free-standing riser system according to claim 33, the LRA further comprising an annulus vent sub for functional fluid injection (or circulation out) comprising dual inline ROV-operable valves, the annulus vent sub including a bore providing access to the annulus between the inner riser and the forged high-strength steel member and the lower cross-over joint.

35. The free-standing riser system according to claim 8, the URA further comprising components allowing circulation of a functional fluid, such as heated water, through the annulus between the URA and the annulus valve on the annulus vent sub.

36. The free-standing riser system according to claim 35, the URA comprises an offtake spool fluidly connected to a hanger spool, the hanger spool in turn fluidly connectable to a tapered stress joint of the free-standing riser.

37. The free-standing riser system according to claim 36, the URA further comprising a shackle and chain tether allowing the URA to be mechanically connected to a near-surface buoyancy device.

38. The free-standing riser system according to claim 37, the URA further comprising a first block elbow includes an inner bore which intersects with and is substantially perpendicular to a bore in the offtake spool, a second block elbow having an inner bore which is also substantially perpendicular to the offtake spool bore but which does not intersect the offtake spool bore, and a gooseneck conduit fluidly connected to the first block elbow providing a flow path for hydrocarbons in combination with first block elbow bore.

39. The free-standing riser system according to claim 38, the URA further comprising first and second emergency shutdown valves in the gooseneck conduit, the gooseneck conduit fluidly connected to a subsea connector in turn fluidly connected to an upper subsea flexible conduit of the one or more flexible subsea conduits.

40. The free-standing riser system according to claim 38, the URA further comprising a bleed valve in the gooseneck conduit allowing shutting in the URA, bleeding off contents of the gooseneck conduit, and retrieving the upper subsea flexible.

41. The free-standing riser system according to claim 35, wherein the components allowing circulation of a functional fluid through the annulus comprises a subsea connector, a conduit and one or more valves in the conduit, the conduit fluidly connected to the hanger spool.

42. The free-standing riser system according to claim 1, the URA further comprising a production bore offtake spool fluidly and mechanically connected to a substantially vertical conduit and to a production tubing, the production tubing in turn fluidly connected to a bend restrictor through a subsea API flange, a high pressure subsea connector, another subsea API flange connection, and optionally a QDC subsea connector, the bend restrictor connected to the upper subsea flexible conduit which extends in a catenary loop to the collection surface vessel, and wherein the substantially vertical conduit fluidly connects in series to an adapter which in turn fluidly connects to a hanger spool an API flange, a casing head via another API flange, a stem joint welded to the casing head, and to the outer riser via a threaded connection into a stem joint, the offtake spool including a shackle flange allowing connection to the subsea buoyancy device.

43. The free-standing riser system according to claim 42, further comprising an ROV-operable ESD fluidly connected in a section of the conduit.

44. The free-standing riser system according to claim 43, further comprising a support bracket which supports production tubing an angle $\sigma$ to the conduit, and also supports a bend shield which provides a mechanical barrier between the production tubing and the conduit, where the angle $\sigma$ ranges from 0 to about 180 degrees.

45. The free-standing riser system according to claim 44, further comprising a connection to the hanger spool for connecting a gooseneck for delivery of heated water to the hanger spool from a surface vessel.

46. The free-standing riser system according to claim 45, wherein the gooseneck comprises, in order starting at the hanger spool, an API flange, a section of tubing, a high pressure subsea connector, a subsea API connector and API flange, and a bend restrictor.

47. The free-standing riser system according to claim 46, wherein the inner riser is positioned inside of the adapter, the hanger spool, and the casing head, creating the annulus between an inner surface of the hanger spool and the inner riser.

48. The free-standing riser system according to claim 47, comprising a pair of O-ring seals which seal the inner riser into the adapter, and one or more slips which wedge between an inner slanted surface of the hanger spool and the inner riser, firmly securing the inner riser in the hanger spool.

49. The free-standing riser system according to claim 1, the LRA further comprising a forged, high-strength steel intake spool fluidly connected a gooseneck assembly, the gooseneck assembly fluidly connected to the lower flexible conduit, the intake spool also comprising a connector allowing connection to a source of a functional fluid.

50. The free-standing riser system according to claim 49, wherein the gooseneck assembly comprises a subsea API flange connected in series to a tubing spool, a high-pressure subsea connector, another subsea API flange, and a bend restrictor.

51. The free-standing riser system according to claim 50, wherein the intake spool comprises an internal surface adapted to accept and fluidly connect with an internal tieback connector landed in the internal surface of intake spool, the intake spool further comprising a latching mechanism allowing the internal tieback connector to releasably connect to the intake spool, while an O-ring seal provides a fluid-tight seal between a bore of the internal tieback connector and the annulus.

52. The free-standing riser system according to claim 1 wherein the vessel comprises a dynamic positioning system.

53. A free-standing riser system connecting a subsea source to a surface structures, said system comprising:

a concentric free-standing riser comprising an inner and outer riser defining an annulus there between;

wherein a lower end of the free-standing riser is fluidly coupled to the subsea source through a lower riser assembly (LRA), one or more subsea flexible conduits, and one or more subsea manifolds;

wherein an upper end of the free-standing riser is coupled to a buoyancy assembly and fluidly coupled to the surface structure through an upper riser assembly (URA) and one or more upper flexible conduits, and wherein the URA includes a first connection port in fluid communication with the inner riser and a second connection port in fluid communication with the annulus;

an annulus vent sub coupled to the free-standing riser below the URA, wherein the annulus vent sub includes connection port in fluid communication with the annulus;

wherein the connection port of the annulus vent sub and the second connection port of the URA are configured to circulate a fluid through the annulus between the URA and the LRA.

54. The free-standing riser system according to claim 53, wherein the LRA further comprises a subsea wellhead housing having a lower end and an upper end, the lower end fluidly connected to a transition joint, the transition joint capped with a first pad eye end forging serving as an anchor point for the free-standing riser, the transition joint comprising the first connection port on the LRA, the first connection port on the LRA fluidly connected to an LRA production wing valve assembly, the wing valve assembly fluidly connected to the subsea source through the one or more subsea flexible conduits, and the upper end of the subsea wellhead housing fluidly connected to an LRA external tieback connector fluidly connecting the subsea wellhead housing to a riser stress joint, the riser stress joint in turn fluidly connected to the annulus.

55. The free-standing riser system according to claim 53, wherein the URA further comprises:

a drilling spool adapter fluidly connected at a first end to the concentric riser and a second end fluidly connected to a tubing head comprising the first connection port on the URA, the tubing head connected to a casing head, and the casing head connected to a shackle flange adapter capped on its top with a second pad eye end forging serving as an attachment point of the concentric riser to the buoyancy assembly, the URA further comprising one or more URA production wing valve assemblies, the URA wing valve assemblies fluidly connected to the collection vessel through one of the upper flexible conduits.

56. A free-standing riser system connecting one or more subsea sources to one or more surface structures, said system comprising:

a free-standing riser comprising inner and outer risers defining an annulus there between, wherein a lower end of the riser is coupled to one of the subsea sources through a lower riser assembly (LRA) and one or more subsea flexible conduits, and wherein an upper end of the free-standing riser is coupled to a buoyancy assembly and to one or more of the surface structures through an upper riser assembly (URA) and one or more upper flexible conduits;

an annulus vent sub disposed along the free-standing riser below the URA, wherein the annulus vent sub is configured to allow the annulus of the free-standing riser to be open to facilitate circulation of a flow assurance fluid through the annulus between the URA and the annulus vent sub; and a hydrate inhibition system fluidly connected to the one or more subsea sources.

57. The free-standing riser system of claim 56 wherein the free-standing riser is in a near-vertical position beneath their respective buoyancy assemblies.

58. The free-standing riser system of claim 56 wherein the annulus vent sub is coupled to the outer riser of the free-standing riser at a point axially between the LRA and the URA.

59. The free-standing riser system of claim 56 wherein the outer riser of the free-standing riser comprises plurality of annulus vent subs fluidly connected thereto in separate longitudinal locations axially spaced along the outer riser.

60. The free-standing riser system according to claim 58, wherein the annulus vent sub comprises one or more valves controllable by an ROV.

61. The free-standing riser system according to claim 58, further comprising external wet insulation on the outer riser.

62. The free-standing riser system of claim 57 wherein the hydrate inhibition system is based on a surface vessel, and the fluid connection comprises a plurality of umbilicals.

63. The free-standing riser system of claim 62 wherein one of the subsea sources is a malfunctioning subsea BOP, and one of the umbilicals is fluidly connected to locations on the subsea BOP selected from the group consisting of a kill line of the subsea BOP, a choke line of the subsea BOP, and both the kill and choke lines of the subsea BOP.

64. The free-standing riser system of claim 62 wherein one of the subsea sources is a malfunctioning subsea BOP, and one of the umbilicals is fluidly connected to a subsea BOP stack manifold.

65. The free-standing riser system of claim 62 wherein one of the umbilicals is fluidly connected to a subsea manifold.

66. The free-standing riser system of claim 56 wherein the hydrate inhibition system comprises:

(a) a vessel;

(b) one or more tanks secured to the vessel containing a liquid chemical suitable for inhibiting hydrate formation in subsea components;

(c) one or more primary pumps fluidly connected to one or more of the tanks;

(d) one or more booster pumps fluidly connected to one or more of the tanks and to one or more of the primary pumps; and (e) one or more umbilicals fluidly connected to the one or more primary pumps and to one or more subsea components.

67. The free-standing riser system of claim 66 wherein the primary pumps are diesel-driven, the booster pumps are air-driven, and comprising a subsea, ROV-controlled umbilical distribution box fluidly connecting the umbilicals to a subsea ROV-controlled hot stab patch panel, the patch panel in turn fluidly connected to one or more subsea sources.

68. A method of installing a subsea marine free-standing riser-based system, the method comprising the steps of:

(a) constructing one or more concentric free-standing riser systems, each concentric free-standing riser system comprising a concentric free-standing riser, a lower riser assembly (LRA) coupled to a lower end of the free-standing riser, and an upper riser assembly (URA) coupled to an upper end of the free-standing riser, wherein the inner and outer risers defining an annulus there between;

(b) installing the concentric free-standing riser system at a subsea location;

(c) connecting an upper flexible conduit to the URA;

(d) installing a suction pile in the seabed and tensioning the free-standing riser system to the suction pile;

(e) connecting a subsea flexible conduit to the LRA and to a subsea source using a subsea installation vessel;

(f) injecting a flow assurance fluid into the annulus through a first port of the URA;

(g) releasing the flow assurance fluid from the annulus through a second port coupled to the riser below the URA after (f); and (h) maintaining riser tension by connecting the URA to a near-surface subsea buoyancy assembly.

69. The method of claim 68 comprising clamping the upper flexible to a side of the concentric free-standing riser during or after step (c).

70. The method of claim 68 wherein step (b) is performed using a mobile offshore drilling unit (MODU).

71. The method of claim 70 wherein step (b) is performed using a vessel comprising a dynamic positioning system.

72. The method of claim 68 wherein riser tension is maintained using a non-integral aircan system chain tethered above the riser to the buoyancy assembly.

73. The method of claim 72 wherein the aircans provide at least 100 kips (445kilonewtons) effective tension at the base of the riser under all loading conditions, including failure of one or more aircan chambers.

74. The method of claim 68 comprising disconnecting the upper flexible conduit using a quick disconnect (QDC) coupling.

75. The method of claim 68 comprising attaching a disconnectable buoy to the upper flexible near the vessel.

76. The method of claim 68 comprising, in the event of an unplanned or planned disconnect, disconnecting the upper flexible conduit from the vessel in a controlled manner and lowering the conduit using a support vessel to hang the conduit along a side of the free-standing riser.

77. The method of claim 76 comprising clamping the conduit in place substantially adjacent the free-standing riser using an ROV.

78. The method of claim 68 wherein step (a) is performed using existing dry tree riser components and subsea wellhead inventory.

79. The method of claim 68 comprising fluidly attaching a hydrate inhibition system to the subsea marine system.

80. The method of claim 68 wherein step (a) comprises constructing the inner and outer risers using high strength steel tubulars using threaded coupled connectors.

81. A method of producing a fluid from a subsea source, the method comprising the steps of:

(a) deploying a subsea marine system comprising at least one concentric free-standing riser including inner and outer risers defining an annulus there between, a lower riser assembly (LRA), and an upper riser assembly (URA);

(b) fluidly coupling the free-standing riser to the subsea source and to a surface structure;

(c) initiating flow of the fluid from the subsea source though the free-standing riser;

(d) maintaining flow of the fluid though the free-standing riser; and (e) circulating a flow assurance fluid through the annulus between an inlet port proximal an upper end of the free-standing riser and an exit port positioned along the free-standing riser axially below the URA.

82. The method of claim 81 comprising shutting down flow of the subsea source by closing at least one emergency shutdown valve in the URA wing valve assembly.

83. The method of claim 81 wherein the URA comprises one or more production wing valve assemblies, the method comprising controlling flow in the inner riser and in the annulus using first and second flow control valves in the URA production wing valve assemblies.

84. The method of claim 81 wherein step (b) comprises fluidly connecting the free-standing riser to the subsea source and to a surface collection vessel using a subsea flexible conduit comprising a lazy wave flexible jumper with distributed buoyancy modules connected from the base of the free-standing riser to a subsea manifold on the seafloor, the manifold fluidly connected to the subsea source or sources.

85. The method of claim 81 comprising fluidly connecting the inner riser to the LRA employing an internal tieback connector.

86. The method of claim 81 comprising securing the free-standing riser using a suction pile foundation on the seafloor, the suction pile foundation comprising a plunger, and a chain tether connecting the plunger to the LRA.

87. The method of claim 81 comprising assuring flow of fluid through the riser using external wet insulation on at least a portion of the outer riser for flow assurance.

88. The method of claim 81 comprising assuring flow of fluid through the riser using external wet insulation on at least a portion of the outer riser and a flow assurance fluid in the annulus between the inner and outer riser for flow assurance.

89. The method of claim 81 comprising assuring flow of fluid through the riser using external wet insulation on at least a portion of the outer riser, and injecting a second flow assurance fluid into the flow stream inside the inner riser.

90. The method of claim 81 comprising fluidly connecting the inner riser to the upper riser assembly employing an inner riser adjustable hanger.

91. The method of claim 81 comprising maintaining buoyancy of the riser using one or more buoyancy assemblies.

92. The method of claim 91 wherein the one or more buoyancy assemblies comprises a non-integral air can system comprising a primary and one or more auxiliary air cans to provide failed chamber redundancy.

93. The method of claim 82 wherein closing at least one emergency shutdown valve in the URA wing valve assembly comprises closing both an hydraulic and an electrically-operated emergency shutdown valve using an umbilical from the surface.

94. The method of claim 81 comprising wherein the URA production wing valve assembly comprises one or more ROV hot-stab ports allowing nitrogen or other flow assurance fluid injection into both the inner riser and the annulus.

95. The method of claim 81 comprising wherein the LRA production wing valve assembly comprises one or more ROV hot-stab ports allowing nitrogen or other flow assurance fluid injection into both the inner riser and the annulus.

96. The method of claim 81 comprising disconnecting one or more upper flexible conduits using a quick disconnect coupling allowing it to be disconnected from a floating production and storage vessel in an either an emergency or planned event (i.e. drive/drift off or hurricane evacuation).

97. The method of claim 81 comprising immobilizing the upper flexible conduits adjacent the outer riser using one or more clamps attached to the riser.

98. The method of claim 81 comprising positioning two or more concentric free-standing risers vertically and laterally apart in the sea, each separately attached to its own respective ship-based floating production and storage facility, and to the same or different subsea source or sources.

99. The method of claim 81 comprising fluidly connecting a hydrate inhibition system to the subsea source.

100. The method of claim 81 comprising dynamically positioning the surface collection vessel.

101. A method of inhibiting hydrate formation in a subsea free-standing riser-based system, the method comprising the steps of:

(a) installing a concentric free-standing riser comprising inner and outer risers defining an annulus there between, a lower riser assembly (LRA), and an upper riser assembly (URA), wherein the LRA includes an annulus vent sub configured to provide access to the annulus at the LRA;

(b) flowing a flow assurance fluid into the annulus at the URA and out of the annulus at the annulus vent sub; and (c) flowing a hydrate-inhibitor liquid chemical from a surface structure to one or more subsea components.

102. The method of claim 101 wherein the flow assurance fluid is a gas atmosphere consisting essentially of nitrogen.

103. The method of claim 101, further comprising installing a wet insulation on the free-standing riser, wherein the wet insulation comprises a syntactic material.

104. The method of claim 103 wherein the syntactic material comprises a plurality of layers of syntactic polypropylene.

105. The method of claim 101 wherein the hydrate-inhibitor liquid chemical is selected from the group consisting of alcohols and glycols.

106. A free-standing riser system connecting a subsea hydrocarbon source to a surface structure, said system comprising:

a concentric free-standing riser comprising inner and outer risers defining an annulus there between, wherein a lower end of the riser is coupled to the subsea source through a lower riser assembly (LRA) and one or more subsea flexible conduits, and wherein an upper end of the riser is coupled to a buoyancy assembly and the surface structure through an upper riser assembly (URA) and one or more upper flexible conduits, wherein the riser is maintained in an erect substantially vertical position by tension applied by the buoyancy assembly;

wherein the LRA includes a first flow path configured to flow a hydrocarbon fluid from the subsea hydrocarbon source to the inner riser, and a second fluid path configured to flow a functional fluid into or out of the annulus, wherein the first fluid flow path is isolated from the second fluid flow path;

wherein the URA includes a third fluid flow path configured to flow the hydrocarbon fluid out from the inner riser to a surface vessel, and a fourth fluid flow path configured to flow the functional fluid into or out of the annulus, wherein the third fluid flow path is isolated from the fourth fluid flow path.

107. The system of claim 106 wherein the surface structure comprises a dynamic positioning system.

* * * * *